US009387665B2

(12) United States Patent
Schwitzky

(10) Patent No.: US 9,387,665 B2
(45) Date of Patent: Jul. 12, 2016

(54) IN-REGISTER ARRANGEMENT OF PRINTING PLATES ON PRINTING-PRESS CYLINDERS WITH A TEMPERATURE-CONTROL SYSTEM

(71) Applicant: KOENIG & BAUER AKTIENGESELLSCHAFT, Würzburg (DE)

(72) Inventor: Volkmar Rolf Schwitzky, Wurzburg (DE)

(73) Assignee: Koenig & Bauer, AG, Wurzburg (DE)

( * ) Notice: Subject to any disclaimer, the term of this patent is extended or adjusted under 35 U.S.C. 154(b) by 0 days.

(21) Appl. No.: 14/420,994

(22) PCT Filed: Apr. 25, 2013

(86) PCT No.: PCT/EP2013/058596

§ 371 (c)(1),
(2) Date: Feb. 11, 2015

(87) PCT Pub. No.: WO2014/026774

PCT Pub. Date: Feb. 20, 2014

(65) Prior Publication Data

US 2015/0246526 A1 Sep. 3, 2015

(30) Foreign Application Priority Data

Aug. 16, 2012 (DE) ..... 10 2012 214 585

(51) Int. Cl.
*B41F 13/16* (2006.01)
*B41F 27/00* (2006.01)
(Continued)

(52) U.S. Cl.
CPC ..... *B41F 27/005* (2013.01); *B41F 13/22* (2013.01); *B41F 33/0009* (2013.01); *B41F 13/16* (2013.01); *B41P 2213/91* (2013.01)

(58) Field of Classification Search
None
See application file for complete search history.

(56) References Cited

U.S. PATENT DOCUMENTS 3,795,193 A * 3/1974 Johne ..... B41F 27/1231 101/415.1
4,697,515 A * 10/1987 Germann ..... B41F 11/02 101/176

(Continued)

FOREIGN PATENT DOCUMENTS

CH 413 870 12/1966
DE 36 30 876 A1 3/1987

(Continued)

*Primary Examiner* — Jill Culler
(74) *Attorney, Agent, or Firm* — Mattingly & Malur, PC

(57) ABSTRACT

The in-register arrangement of at least two printing plates on at least two plate cylinders of a printing press, with respect to each other, is accomplished. Settings for a temperature of a printing plate, which is arranged on one of the plate cylinders or of a cylinder barrel of the plate cylinder or of a temperature control assembly, which interacts with the printing plate or the at least one printing cylinder, are determined depending on a printing image which is printed onto a printing material. One temperature of the printing plate or of the cylinder barrel or of the temperature control assembly is changed according to the settings in such a way that subsequently, an image form element, which is arranged on the printing plate, and an image form element, which is arranged on another of the printing plates, are situated in a predefined relative position with respect to one another, at least in an axial direction relating to a plate cylinder. The printing press has a press unit which has a transfer cylinder which is in contact with a plurality of plate cylinders and to a system for register regulation.

15 Claims, 11 Drawing Sheets

(51) Int. Cl.
*B41F 33/00* (2006.01)
*B41F 13/22* (2006.01)

(56) References Cited

U.S. PATENT DOCUMENTS

| | | | | |
|---|---|---|---|---|
| 4,803,634 | A | 2/1989 | Ohno et al. | |
| 4,938,134 | A | 7/1990 | Dorsam et al. | |
| 5,042,378 | A * | 8/1991 | Germann | B41F 11/02 101/152 |
| 5,398,609 | A | 3/1995 | Stiel | |
| 5,443,007 | A * | 8/1995 | Buenz | B41F 31/002 101/479 |
| 5,488,904 | A * | 2/1996 | Kleinschmidt | B41F 13/16 101/415.1 |
| 5,500,801 | A | 3/1996 | Loffler | |
| 5,802,973 | A | 9/1998 | Mueller et al. | |
| 6,557,469 | B1 | 5/2003 | Schneider et al. | |
| 6,637,337 | B2 | 10/2003 | Hauck | |
| 7,066,088 | B2 | 6/2006 | McLean et al. | |
| 7,536,955 | B2 | 5/2009 | Bernard et al. | |
| 7,614,343 | B2 | 11/2009 | Eckert | |
| 7,730,836 | B2 | 6/2010 | Schnell | |
| 8,499,690 | B2 | 8/2013 | Schwitzky | |
| 2006/0174792 | A1 | 8/2006 | Brost et al. | |
| 2007/0157831 | A1 * | 7/2007 | Eckert | B41F 13/025 101/180 |

FOREIGN PATENT DOCUMENTS

| | | | |
|---|---|---|---|
| DE | 37 31 039 | A1 | 3/1989 |
| DE | 41 29 831 | A1 | 7/1992 |
| DE | 42 26 565 | A1 | 2/1993 |
| DE | 42 39 089 | A1 | 11/1993 |
| DE | 42 35 393 | A1 | 4/1994 |
| DE | 43 35 351 | A1 | 4/1995 |
| DE | 43 41 431 | A1 | 6/1995 |
| DE | 296 08 124 | U1 | 9/1996 |
| DE | 195 11 956 | A1 | 10/1996 |
| DE | 298 15 085 | U1 | 12/1998 |
| DE | 199 24 784 | A1 | 12/2000 |
| DE | 101 37 166 | A1 | 3/2002 |
| DE | 10 2005 012 913 | A1 | 10/2005 |
| DE | 10 2004 052 820 | A1 | 5/2006 |
| DE | 10 2004 052 826 | A1 | 5/2006 |
| DE | 10 2007 057 455 | A1 | 6/2008 |
| DE | 10 2008 005 878 | A1 | 8/2008 |
| EP | 579 017 | A1 | 1/1994 |
| EP | 711 664 | A1 | 5/1996 |
| EP | 1 820 650 | A2 | 8/2007 |
| EP | 1 958 769 | A1 | 8/2008 |
| WO | 93/03925 | A1 | 3/1993 |
| WO | 2004/014654 | A1 | 2/2004 |
| WO | 2005/007406 | A2 | 1/2005 |
| WO | 2005/072967 | A2 | 8/2005 |

* cited by examiner 17
143; 144
VIII VII
134
44
VIII VII
134
07
106; 107
43
17

21
07
134
131
61

39; 41
21
43; 44
07
134
61

17
143; 144
66; 61; 101
07
141
144
142
17

IN-REGISTER ARRANGEMENT OF PRINTING PLATES ON PRINTING-PRESS CYLINDERS WITH A TEMPERATURE-CONTROL SYSTEM

CROSS-REFERENCE TO RELATED APPLICATIONS

This application is the U.S. national phase, under 35 U.S.C. 371, of PCT/EP2013/058596, filed Apr. 25, 2013; published as WO 2014/026774A1 on Feb. 20, 2014 and claiming priority to DE 10 2012 214 585.0, filed Aug. 16, 2012, the disclosures of which are expressly incorporated herein by reference.

FIELD OF THE INVENTION

The present invention relates to a method for in-register arrangement of at least two printing plates and a system for register control.

BACKGROUND OF THE INVENTION

In printing presses, forme cylinders are often used that are designed as plate cylinders and carry printing formes in the form of printing plates. These printing plates can be exchanged. For this, a device is necessary that fixes the printing plate to the forme cylinder detachably. With increasing demands on the precision of the print products produced using the printing press, the demands on the precision with which the printing plate is arranged on the forme cylinder also increase. For example, in security document printing, demands are made that necessitate a precision of the position of the printing plates at least relative to one another in the region of micrometers. Such accuracies are not achievable using plate clamps of conventional sheet printing presses.

In each of DE 41 29 831 A1 and DE 10 2004 052 826 A1 and DE 199 24 784 A1, a plate cylinder is known, the plate cylinder having a channel in which a clamping device is arranged that has a radially outer clamping element that is arranged immovably relative to a main body of the clamping device, and the clamping device having a pressure element that radially is arranged further inside than the radially outer clamping element and the clamping device having an adjusting element, by means of which the pressure element is at least partially movable at least in and/or against a clamping device relative to the radially outer clamping element.

From DE 195 11 956 A1, a plate cylinder is known that has a radially internal clamping element that is held in a defined position with respect to a circumferential direction by means at least of a front pressure element.

From DE 42 26 565 A1, a device is known for tensioning and adjusting flexible printing plates on plate cylinders of rotary printing presses.

From DE 37 31 039 A1, a plate cylinder is known that has a channel in which a rear clamping device is arranged that has a radially outer clamping element, the clamping device having at least one pressure element that is partly arranged further inside than the at least one radially outer clamping element, and the clamping device having at least one control element, by means of which the at least one pressure element and the radially outer clamping elements are movable at least partially relative to one another at least in and/or against a clamping direction.

From DE 43 41 431 A1, a plate cylinder is known that has a channel in which to clamping devices are arranged, which in each case have a main body, relative to which in each case at least one clamping element is arranged immovably and relative to which in each case at least one further clamping element is arranged movably. One of the clamping devices is supported against a channel wall by means of screws. The other clamping device is supported against another channel wall by means of supporting bolts.

From DE 298 15 085 U1, a plate cylinder is known that has a channel, in which two clamping devices are arranged. At least one of the clamping devices has a main body, is arranged immovably relative to the at least one clamping element and is arranged movably relative to the least one other clamping element. This clamping device is supported against a channel wall by means of screws and pressure springs.

From DE 296 08 124 U1, a plate cylinder is known that has a channel, in which is arranged at least one clamping device that has a main body, relative to which at least one clamping element is arranged immovably and relative to which at least one further clamping element is arranged movably. The at least one clamping device is supported in the circumferential direction against a cylinder barrel of the plate cylinder by means of at least three supporting sites. No details can be inferred whether a shaft serving for the connection of main body and cylinder barrel is arranged rigidly relative to the main body or rigidly relative to the barrel or both movably relative to the barrel and movably relative to the main body.

From DE 41 29 831 A1, it is furthermore known that the clamping device has a radially inner clamping element that is always held in a defined position with respect to a circumferential direction by means of at least one front pressure element.

From W0 93/03925 A1, a plate cylinder is known that has a channel, in which is arranged a tensioning device which has a clamping device movable on a slide within the channel.

From DE 42 39 089 A1, EP 0 579 017 A1 and EP 0 711 664 A1, methods and devices for the tensioning and for the register correction of printing plates are known. EP 0 579 017 A1 furthermore shows a plate cylinder of a printing press, the plate cylinder having at least one tensioning device arranged in a channel of the plate cylinder.

From DE 42 35 393 A1, a register adjusting device and a method for register adjustment are known, register marks being used.

From DE 10 2007 057 455 A1, a device is known in which a printing plate lying on a plate cylinder can be deformed. For adjustment of the printing plate in a circumferential direction, adjustments of the printing plate already carried out in an axial direction are firstly again made retrogressive.

From US 2006/0174792 A1 a method is known in which an ink jet printhead is deformed by thermal expansion in order to react to a change of a width of a web form synthetic material print substrate.

From DE 101 37 166 A1 a method for in-register printing is known, where for in-register printing in the case of narrower/wider printing, adjustments occurring for at least one temperature at least of one printing plate arranged on the at least one plate cylinder and/or at least one cylinder barrel of the at least one plate cylinder and/or at least one temperature control means interacting with this printing plate and/or this at least one plate cylinder are made, such that a temperature-dependent deformation of the printing plate is adjusted to a trapezoidal deformation of the print substrate produced by at least one preceding printing operation. This is done independently of printing forms employed in the previous printing operation.

From DE 43 35 351 A1 a method for in-register printing is known, where a print substrate has at least one register pattern, that in each case has at least two reference elements, which originate from different printing plates and where in an inspection process actual positions compared to desired positions of all reference elements of the at least one register pattern are recorded.

From DE 10 2005 012 913 A1 a method for the in-register arrangement in each case of at least one printing plate on at least two plate cylinders of a printing press is known. It is disclosed that a print substrate has at least one register pattern, that in each case has at least two reference elements, that originate from different printing plates and that in an inspection process actual positions are recorded compared to desired positions.

From WO 2005/007406 A1 a method for influencing a fan-out effect in a printing press is known. The printing press has at least one printing unit having at least one printing couple and at least one inking unit, where a print substrate has at least one register pattern, that in each case has at least two reference elements, that originate from different printing plates and where in an inspection process actual positions compared to desired positions of all reference elements of the at least one register pattern are recorded.

From DE 42 39 089 A1 a method for register correction of printing plates is known. Printing plates are clamped and tensioned. The printing plate is measured and in the case of deviations from actual positions of register punchings to desired positions of register punchings adjustments with respect to page register, circumferential register and/or diagonal register are performed relative to the plate cylinder by adjustment of the plate cylinder itself or of clamping devices.

From WO 2005/072967 A1 a method and a printing press are known, in which method or in which printing press printing parts of plates defining print images are arranged from the start on plate cylinders such that by means of this arrangement a deformation of a print substrate taking place between individual printing positions of individual printing units can be compensated at least partially by this arrangement.

From WO 2004/014654 A1 a printing press is known which has a common transfer cylinder, which is in contact with a plurality of forme cylinders. It can be inferred that disadvantages are thereby avoided that could take place in a plurality of printing gaps by deformations of the print substrate between printing gaps.

The same applies for EP 1 958 769 A1 and CH413 870.

SUMMARY OF THE INVENTION

The invention is based on the object of creating a method for the in-register arrangement of at least two printing plates and a system for register control.

The object of the present invention may be achieved by the provision of a method for the in-register arrangement of at least two printing plates on at least two plate cylinders of a printing press to each other. The printing press has at least one printing unit, which has at least one transfer cylinder in the contact area of which a print gap is established with a further cylinder. The at least one transfer cylinder is in contact with a plurality of plate cylinders. In dependence on at least one print image printed on a print substrate, adjustments for at least one temperature of at least one printing plate, arranged on at least one of the at least two plate cylinders and/or at least one cylinder barrel of the at least one plate cylinder and/or at least one temperature control means interacting with this printing plate and/or this at least one plate cylinder are determined. The at least one temperature of this at least one printing plate and/or this at least one cylinder barrel and/or this at least one temperature control means is changed in accordance with the adjustments. The at least one plate cylinder has at least one channel, in which is arranged at least one tensioning device, which contains at least one front clamping device, in which a front end of a respective printing plate is clamped. At least one rear clamping device, in which a rear end of this respective printing plate is clamped and where at least one register pattern of the print substrate is recorded, and in dependence thereon adjustments for at least one adjusting element of the at least one tensioning device are determined. At least one adjusting element of the at least one tensioning device may be configured as at least one front contact body, by means of which a distance of the at least one front clamping device from the first channel of the at least one channel is adjustable and/or is designed as at least one rear spacer, by means of which a distance of the at least one rear clamping device from the second channel wall of the at least one channel is adjustable. The at least one tensioning device may be configured as at least one axial drive, by means of which a position of the at least one rear clamping device is adjustable with respect to the axial direction (A) parallel to an axis of rotation of the respective plate cylinder.

The object of the present invention may also be achieved by the provision of a system for register control, where the system has at least one printing press, at least one machine control of the at least one printing press and at least one data input of the machine control for the recording of register data at least of one printing plate of the printing press. The printing press has at least one printing unit which has at least one transfer cylinder, in the contact area of which with a further cylinder, a print gap is established. At least one transfer cylinder is in contact with a plurality of plate cylinders. The system has at least one temperature control system connected by circuitry to the machine control, by the use of which, at least one temperature of the at least one printing plate, arranged on at least one of the plate cylinders of the printing press and/or at least a cylinder barrel of the at least one plate cylinder and/or at least a temperature control assembly interacting with the at least one printing plate and/or this at least one plate cylinder is controllable and/or regulable in dependence on the register data recorded. In at least one channel of the at least one plate cylinder, there is arranged at least one tensioning device of the plate cylinder, which has at least one front clamping device and at least one rear clamping device. At least one adjusting element of the at least one tensioning device is configured as at least one front contact body, by the use of which, a distance of the at least one front clamping device from the first channel wall of the at least one channel is adjustable. Alternatively, the at least one adjusting element of the at least one tensioning device is configured as at least one axial drive, by the use of which a position of the at least one rear clamping device, with respect to the axial direction parallel to an axis of rotation of the respective plate cylinder is adjustable. Alternatively, the at least one rear clamping device may be part at least of a slot of the at least one tensioning device and the at least one slot may be arranged to be movable by the use of at least one tensioning drive within the at least one channel along a tensioning path to the at least one front clamping device. At least one adjusting element of the at least one tensioning device may be configured as at least one rear spacer, by the use of which, a distance of the at least one rear clamping device from a second the channel wall of the at least one channel is adjustable.

The advantages achievable using the invention consist in particular in that an in-register application and/or arrangement of printing plates to forme cylinders designed as plate cylinders is feasible simply and with high precision. In particular, the corresponding device is also simply constructed and contains few movable components. A preferred high reproducibility of the position of the printing plates on the plate cylinders is also advantageous. High clamping forces likewise increase the precision of the position of the printing plate. In particular, in preferred printing presses in which a plurality of forme cylinders interact with a common transfer cylinder, the advantage of particularly high precision results thereby, as here only one position is available at which the print substrate is provided with printing ink and therefore the precision of the print image depends exclusively on the precision of the position of the printing inks on the common transfer cylinder and thus lastly on the precision with which the printing plates are arranged on the forme cylinders and with which the forme cylinders are arranged relative to each other.

Preferably, a plate cylinder, in particular a plate cylinder of a printing press, which preferably has at least one channel, in which preferably at least one clamping device is arranged, the at least one clamping device preferably having at least one radially outer clamping element, in particular at least one radially outer clamping strip, which is or are preferably arranged immovably relative to a main body of the at least one clamping device, preferably the at least one clamping device having at least one pressure element, which is arranged radially further inside than the at least one radially outer clamping element and preferably the at least one clamping device having at least one adjusting element, by means of which the at least one pressure element is at least partially movable in and/or against a clamping device relative to the at least one radially outer clamping element and further preferably relative to a cylinder barrel of the plate cylinder at least, has one or more of the features described below. The at least one adjusting element is preferably designed, for example, as a clamp release drive, in particular clamp release hose.

Preferably, the at least one clamping device has at least two pressure elements and the at least one adjusting element is arranged between the at least two pressure elements in the circumferential direction with respect to the plate cylinder. A clamping force of this clamping device is then doubled in contrast to only one pressure element of equal spring stiffness. A force to be used by the adjusting element is, however, just as great, because instead of this an adjustment path of the at least one adjusting element is doubled, since the at least one adjusting element arranged between the at least two pressure elements can in each case be moved on both adjusting elements. If a release hose, in particular clamp release hose, is employed as an adjusting element, accordingly for a doubled control force in the clamp release hose no higher pressure must be achievable or be achieved than with only one adjusting element.

Preferably, at least one linear connecting line between the at least two pressure elements of the at least one clamping device intersects the at least one adjusting element of this at least one clamping device. Preferably, the at least one pressure element is movable at least in and/or against the clamping device at least partially relative to the cylinder barrel of the plate cylinder by means of the at least one adjusting element.

Preferably, the at least one clamping device has at least one radially inner clamping element and further preferably the at least one radially inner clamping element can be acted on and/or is acted on by means of the least one or the preferably at least two pressure elements in the clamping device towards the at least one radially outer clamping element with a force and preferably together with the at least one radially outer clamping element forming a clamping gap. Then, advantageously a clamping gap is fixed in its shape and/or its positioning by at least two clamping elements and is actuatable reproducibly and preferably without unwanted movements of a printing plate during its clamping. This applies in particular, if as preferred, the at least one radially inner clamping element is arranged to be exclusively linearly movable.

Preferably, the at least one radially outer clamping element is at least one radially outer clamping strip, which extends in an axial direction with respect to an axis of rotation of the plate cylinder over at least 75% of the axial length of the at least one channel and/or the at least one radially inner clamping element is at least one radially inner clamping strip that extends in an axial direction with respect to the axis of rotation of the plate cylinder over at least 75% of the axial length of the at least one channel. Preferably, the at least two pressure elements are in each case designed as at least one leaf spring. The axial direction here is preferably oriented parallel to the axis of rotation of the plate cylinder.

Preferably, the at least one adjusting element is designed as at least one clamp release hose, which further preferably can be acted on by a pressure for the release of a clamp. There is then an advantage therein that this clamp release hose is of simple design and is manufacturable and operable inexpensively. Moreover, such a clamping can be achieved with a deactivated adjusting element.

Preferably, the at least one radially inner clamping element is connected by means at least of one connecting element to the at least two pressure elements.

Preferably, at least one front clamping device designed in such a way and at least one rear clamping device designed in such a way is arranged in the at least one channel. The advantages mentioned are then preferably doubly exploited. Preferably, the at least one front clamping device is designed for the acceptance of one end of a printing plate running forward in the printing operation.

Preferably, at least one clamping device is designed as at least one rear clamping device and part at least of one slide of the at least one tensioning device and the at least one slide is arranged movably within the at least one channel along a tensioning path towards the at least one front clamping device by means at least of a tensioning drive within the at least one channel. Preferably, the tensioning path extends orthogonally to an axis of rotation of the plate cylinder. Preferably, the tensioning path extends within a plane, the surface normal of which is oriented parallel to the axis of rotation of the plate cylinder. This slide can then preferably be employed both for plate tensioning as well as for facilitation of a replacement of the printing plate.

Preferably, the tensioning path extends at least partially in and/or against the peripheral direction or in and/or against a tensioning direction tangential to the circumferential direction. Preferably, the at least one tensioning drive is designed as at least one tensioning hose. Then the same advantages preferably result as with the clamp release hose, in particular in that it can be of simple design and can be produced and operated inexpensively.

Preferably, a maximum displacement of the least one slide relative to the cylinder barrel of the plate cylinder in and/or opposite to the tensioning direction is at least as great as an extension measured in the tensioning direction of an intended or further preferred actual contact surface of a printing plate clamped in the at least one rear clamping device with the at least one radially external clamping element of the at least one rear clamping device.

Preferably, the at least one tensioning device and further preferably precisely one tensioning device extends in the axial direction with respect to the axis of rotation of the plate cylinder over at least 75% of the axial length of the at least one channel.

Preferably, in the at least one channel is arranged at least one tensioning device that has at least one front clamping device and at least one rear clamping device and preferably the at least one front clamping device has at least one front adjusting element, in particular at least one front clamp release drive for opening and closing at least one front clamp gap, and at least two pre-tensioning drives for adjusting in each case one front contact body aligned to a first channel wall to and preferably the at least one rear clamping device has at least one rear adjusting element, in particular at least one rear clamp release drive for opening and closing at least one rear clamping gap and at least one axial drive for adjusting a position of the at least one rear clamping device with respect to the axial direction parallel to an axis of rotation of the plate cylinder. A reproducible and rapid adjustment of the tensioning device is then possible.

Preferably, the at least one front clamp release drive and the least two pre-tensioning drives and the at least one rear clamp release drive and the at least one axial drive are controllable and/or controlled by means of a machine control and are of regulable and/or regulated design. Preferably, at least one rear clamping device has at least two distance drives in each case of a rear spacer or at least two rear stop drives in each case of a rear stop adjusting element for adjusting at least a distance of the at least one rear clamping device from a second channel wall and preferably the at least one front clamp release drive and the at least two pre-tensioning drives and the at least one rear clamp release drive and the at least one axial drive and at least two distance drives or rear stop drives are designed to be controllable and/or controlled and/or to be regulable and/or regulated by means of the machine control. Preferably, the at least one rear clamp device has at least one slide, which is preferably movable in at least one direction orthogonal to the axis of rotation of the plate cylinder by means at least of one tensioning drive and preferably the at least one tensioning drive is likewise controllable and/or controlled and/or regulable and/or regulated by means of the machine control. By means of the machine control, a high precision and a remote adjustment of the tensioning device and/or of the at least one clamping device is possible.

Preferably, the at least one clamping device is supported by means of at least three support points in the circumferential direction against a cylinder barrel of the plate cylinder and preferably stands on a first support point of the at least one main body of the at least one front clamping device, or a component of the least one front clamping device arranged rigidly to the at least one main body is connected directly with the first channel wall or a component arranged rigidly to the cylinder barrel of the plate cylinder and preferably in each case a contact body of the at least one front clamping device adjustable relative to the at least one main body in its position and movable together with the at least one main body stands on at least two second support sites and together with the at least one main body is connected to the first channel wall or a component arranged rigidly to the cylinder barrel of the plate cylinder. Position corrections and tensioning corrections of the printing plate can then be adjusted particularly precisely and reproducibly.

Below, a method is described for the arrangement of at least one printing plate on at least one plate cylinder, which preferably has at least one channel, in which preferably at least one front clamping device and at preferably least one rear clamping device are arranged, the rear clamping device preferably being part of at least one slot. The method preferably has one or more of the process operations described below.

The method is preferably a method for preferably in-register arrangement of at least two printing plates on at least two plate cylinders of the printing press, in particular sheet-fed printing press, where the at least two plates cylinders preferably in each case have at least one channel, in which preferably in each case at least one tensioning device is arranged, which in each case preferably has at least one front clamping device, in which a front end of a respective printing plate is clamped and in each case preferably has at least one rear clamping device, in which a rear end of this respective printing plate is clamped and where preferably in an inspection process preferably at least one register pattern of a preferably sheet-fed print substrate is preferably recorded by means of at least one register sensor and in dependence thereon preferably in an evaluation operation preferably new adjustments for at least one adjusting element, further preferably at least one front adjusting element in a circumferential direction and/or at least one rear adjusting element in a circumferential direction are determined and are preferably calculated and preferably in a first fitting process preferably at least one, for example, incorrectly tensioned, printing plate is at least partially and further preferably completely slackened with respect to a circumferential direction and remains clamped here in the at least one front clamping device and the at least one rear clamping device and preferably is subsequently tensioned corresponding to the newly determined and preferably calculated adjustments for the at least one adjusting element, in particular the at least one front adjusting element and the at least one rear adjusting element changed in circumferential direction on the respective plate cylinder. Preferably, in the at least partial release of the least one printing plate a tensioning force acting on this printing plate is released by preferably at least 50%, further preferably at least 75% and even further preferably at least 90%. Preferably, in the case of a complete release of the at least one printing plate a tensioning force acting on this printing plate is reduced by 100%.

Preferably, the new adjustments for the at least one adjusting element are determined and further preferably calculated by means of a computer, further preferably of the machine control or of a computer connected by circuitry to the machine control. Preferably, the least one register sensor is designed as at least one optical register sensor, for example, an area scan camera. Preferably, the at least one register sensor is connected to the machine control by circuitry.

Preferably, the method is distinguished in that the print substrate has at least one register pattern, which in each case has at least two reference elements, in particular register marks, which originate from different printing plates and are preferably printed using different printing inks and in that preferably with respect to each register pattern a reference element, in particular a register mark, will be or is set as a base reference element, in particular base register mark, and in that in the inspection process actual positions of or reference elements of the at least one register pattern are recorded, in particular compared to desired positions of all reference elements, in particular desired positions of all reference elements of the at least one register pattern. Preferably, register marks of the at least one register pattern are preferably recorded relative to the base reference element, in particular the base register mark of the respective at least one register pattern, further preferably of the at least one register sensor. This means in particular that the actual positions of the reference elements of the at least one register pattern are compared with the desired positions of the reference elements of the at least one register pattern.

Preferably, the method is distinguished in that in the case of at least one deviation of an actual position compared to a desired position occurring in the circumferential direction, exceeding a tolerance range, in the evaluation process and preferably taking into consideration further recorded register patterns. New adjustments for at least one adjusting element of the at least one tensioning device, are determined and preferably calculated, in which the at least one printing plates, for example, is or was tensioned erroneously, which has caused the at least one register mark deviating in the circumferential direction, and in a first fitting process at least this at least one, for example, erroneously tensioned printing plate is released at least partially and further preferably completely at least with respect to the circumferential direction and subsequently changed in circumferential direction is tensioned on the respective plate cylinder.

Preferably, the method is distinguished in that in the evaluation process new adjustments for in each case at least one adjusting element at least of two and further preferably of all tensioning devices are determined and further preferably calculated, in which in each case at least one printing plate, for example, is or was erroneously tensioned and in the first fitting process at least please at least two and preferably all, for example, erroneously tensioned printing plates are at least partially and further preferably completely released with respect to the respective circumferential direction and in this case remains clamped in the respective at least one front clamping device and the respective at least one rear trapping device, in particular of the respective at least one tensioning device, and subsequently preferably tensioned by means of the respective at least one tensioning device corresponding to the newly determined, preferably calculated, adjustments for the respective at least one adjusting element changed in circumferential direction of the respective plate cylinder.

Preferably, the method is distinguished in that in the evaluation process the new adjustments for a plurality of adjusting elements of one or more tensioning devices are determined and preferably calculated at the same time and/or taking into consideration mutual influences of the plurality of adjusting elements.

Preferably, the method is distinguished in that the first fitting process at least of two, for example, erroneously tensioned printing plates takes place simultaneously at least timewise.

Preferably, the method is distinguished in that in at least one sample printing operation preceding the inspection operation at least two register patterns are printed on the print substrate, which are composed of in each case at least two reference elements and in particular register marks originating from at least two different printing plates. In particular, the printing ink thereof was thus transferred to the print substrate from different printing plates starting directly or preferably indirectly. The at least two register patterns are arranged spaced from one another preferably parallel to a transport direction of the print substrate and/or orthogonal to a transport direction of the print substrate.

Preferably, the method is distinguished in that in the first fitting process a tensioning within the at least one printing plate remains unchanged with respect to the axial direction.

Preferably, the method is distinguished in that the at least one adjusting element of the at least one tensioning device is designed as at least one front contact body, by means of which a distance of the at least one front clamping device from the first channel wall of the at least one channel is adjustable and/or in that the at least one adjusting element of the at least one tensioning device is designed as at least one rear spacer, by means of which a distance of the at least one rear clamping device from the second channel wall of the at least one channel is adjustable and/or in that the at least one adjusting element of the at least one tensioning device is designed as at least one axial drive, by means of which a position of the at least one rear clamping device is adjustable parallel to an axis of rotation of the respective plate cylinder with respect to the axial direction.

Preferably, the method is distinguished in that at least two register patterns at a distance from one another diagonal to a transport direction of the print substrate and/or at a distance from one another in an axial direction based on the at least one plate cylinder and/or at least two register patterns in the circumferential direction based on the at least one plate cylinder are determined in the inspection process and are processed in the evaluation process.

Preferably, the method is distinguished in that at least two register patterns arranged on opposite surfaces of the print substrate are recorded in the inspection process, preferably by sensors, in particular register sensors, coupled to one another mechanically and/or by circuitry, and/or [sic] jointly processed in the evaluation process. Simultaneous recording offers the advantage that it is ensured thereby that the print substrate can not have been removed between a recording of the front side and a recording of a back side. As preferably the position of the at least two sensors to one another is also known and/or constant, precise data about the register of front side and back side to one another can be obtained therefrom. Preferably, recording areas of the least two register sensors point to one another. Further preferably, the print substrate is arranged between the at least two register sensors on recording of the at least two simultaneously recorded register marks. Further preferably, the print substrate on recording of the least to simultaneously recorded register marks is arranged between the at least two register sensors. Joint processing offers the advantage that opposing influences can be taken into consideration. For example, a changed adjustment of a front adjusting element can require a changed adjustment of a rear adjusting element initially already appearing to be perfectly adjusted. This relates both to a print image on the front side of the print substrate relative to a print image on the back side of the print substrate, as well as different partial print images on a common side of the print substrate.

Preferably, the method is distinguished in that a number of register patterns recorded and evaluated under mutual consideration is at least as large as a sum of adjusting elements of one of the at least two plate cylinders designed as front contact bodies and/or rear spacers. Further preferably, this number is at least eight per pressure plate, even further preferably at least fourteen per pressure plate. In particular, register patterns both of a front side as well as of a back side of the print substrate are preferably recorded and evaluated.

Preferably, the method is distinguished in that in particular in the case of at least one deviation of an actual position compared to a nominal position in the evaluation process occurring in the axial direction and exceeding a tolerance range, preferably taking into consideration further recorded register patterns, new adjustments for at least one temperature at least of one printing plate, for example incorrect in its axial extent, arranged on the at least one plate cylinder and/or at least of a cylinder barrel of the at least one plate cylinder and/or at least of a temperature control means, in particular temperature control fluid, interacting with this printing plates and/or this at least one plate cylinder, are determined and preferably calculated, and in a second fitting process the at least one temperature of this at least one printing plate and/or of this at least one cylinder barrel and/or of this temperature control means, in particular temperature control fluid, is changed according to the new adjustments. This is based on the fact that in cases in which a number of register patterns are compared, which are arranged in different axial positions and in which a certain printing ink is arranged axially differently relative to the other printing inks, this error can be compensated using the temperature, if an error remediable by means of customary side register devices, for example, a constant axial shift of the printing plate and/or of the plate cylinder, is concerned. An advantage in particular consists in the fact that there by a uniform change of a width of the corresponding print image at least of the corresponding printing ink can be achieved, in particular independently of a position of the printing form in the circumferential direction and in particular over a total print image length and in particular independently of the print images of the remaining printing inks. Preferably, the at least one temperature control fluid is at least one temperature control liquid, for example essentially water, optionally with additives such as rust inhibitors or the like.

Particularly preferably, independently of adjustments of clamping devices and/or tensioning devices, a preferred method for the in-register arrangement of at least two printing plates on at least two plate cylinders, preferably interacting with a common transfer cylinder, of a printing press to one another results, where preferably depending on at least one print image and further preferably at least one register pattern of a print substrate preferably new adjustments for at least a temperature of at least one, in particular first of the at least two plate cylinders arranged, in particular first printing plate, and/or at least one cylinder barrel of the at least one, in particular first plate cylinder, and/or at least one temperature control means interacting with this in particular first printing plate and/or this at least one, in particular first plate cylinder are determined and preferably the at least one temperature of this at least one, in particular first, printing plate and/or this at least one cylinder barrel and/or this at least one temperature control means is changed according to the new adjustments.

Preferably, the at least one temperature of this at least one, in particular first, printing plate and/or this at least one cylinder barrel and/or this at least one temperature control means changes according to the new adjustments in such a way that preferably thereafter and in particular only thereafter at least one image forming element arranged on the at least one, in particular first, printing plate, in particular a register forming element and further preferably at least two image forming elements arranged on the at least one, in particular first printing plate, in particular register forming elements on the one hand and at least one image forming element arranged on another, in particular second of the at least two printing plates, in particular a register forming element and preferably at least two image forming elements arranged on the other, in particular second, of the at least two printing plates, in particular register forming elements on the other hand, are located at least with respect to an axial direction based on at least one, in particular first, plate cylinder and at least one image forming element, in particular register forming element, arranged on the other, in particular second of the at least two printing plates, on the other hand at least with respect to an axial direction, based on a at least one, in particular first, plate cylinder are situated in a relative position to one another specified preferably independently of a recording and further preferably before the recording of the at least one register pattern. Preferably, this other, in particular second, of the at least two printing plates is arranged on another, in particular second, of the at least two plate cylinders. In particular, using the method in each case at least one printing plate is preferably arranged on at least two plate cylinders.

The advantage in particular results therefrom that printing plates not exactly in register relative to one another can nevertheless be used for qualitatively high-grade printing. Errors in the register accuracy of the printing plates to one another can result for example from the different temperatures of the corresponding printing plates in how exposure device and/or different temperatures of optical equipment of the exposure device at the point in time of exposure. Preferably, by means of the change of the at least one temperature of this at least one printing plates and/or this at least one cylinder barrel and/or this at least one temperature control means, according to the new settings the temperature of the printing plates in the circumferential direction is considered uniformly, in particular changes by an essentially constant and further preferably constant amount.

In particular, this advantage results if the printing press has at least one printing units, which has at least one transfer cylinder, in the contact area of which a print gap is fixed with a further cylinder, where the at least one transfer cylinder is in contact with a number of plate cylinders, in particular at least the first and the second plate cylinder. By means of the contact of the transfer cylinder with a number of plate cylinders, partial images firstly transferred by these plate cylinders are firstly collected on the transfer cylinder and transferred to the print substrate together. By this means, the print substrate undergoes need no deformation between the application of a first printing ink and the application of further printing inks.

A print image is to be understood in the following and in the foregoing as meaning a subject depicted on a print substrate by transferred printing ink. Here, preferably at least typesetting and/or at least a detection and/or in particular at least a register mark is concerned. Parts of the print image, which preferably served the purpose of checking a register of partial images, which originate from different printing forms, are preferably designated as reference elements, further preferably as register marks. As reference elements or register marks, for example, parts of an anyway desired print image are used. Preferably, the reference elements or register marks, however, are used exclusively for the determination of the register and especially printed for this purpose and are in each case part at least of a register pattern. An image form element is generally to be understood as meaning such an area of a printing plates which intentionally transfers printing ink or is at least capable thereof thus contributes to the creation of a print image or at least partial print image. A particular form of an image form element is a register form element. A register form element is an area of the printing plate and transfers printing ink as intended and thus contributes to the creation of a print image or partial print image designed as a reference element or register mark.

Preferably, the method is distinguished in that thereafter and in particular only thereafter at least a distance between midpoints measured in the axial direction of at least two register form elements arranged on the at least one printing plate is identical to a distance measured in the axial direction between midpoints of at least two register form elements arranged on another of the at least two printing plates.

Preferably, the method is distinguished in that in the evaluation process at least a temperature at least of a further printing plate and/or at least a temperature of the cylinder barrel at least of a further plate cylinder and/or at least a temperature at least of a temperature control means, for example, temperature control fluid of another plate cylinder and/or an ambient temperature of the printing press and/or a temperature of the print substrate in the determination and preferably calculation of the new adjustments for the at least one temperature of the at least one printing plate, for example, incorrect in its axial extent and/or of the least one cylinder barrel and/or of the temperature control means flows in.

Preferably, the new adjustments for the at least one temperature are determined, in particular calculated, by means of a computer, further preferably of the machine control or of a computer connected to the machine control by circuitry. However, it is also possible in principle that these new adjustments are determined by an operating person, for example, by calculation and/or with the aid of prespecified adjustment combinations, for example tables of values.

Preferably, the method according to the invention is distinguished in that after the fitting process the temperature difference between two different printing plates, which are arranged on different plate cylinders, is larger or smaller than before the fitting process.

Preferably, the method is distinguished in that in the expression process at least two register patterns are recorded, which in each case show a reference element originating from an identical printing plate, in particular at least one register mark originating from an identical printing plate.

Preferably, the method is distinguished in that in the evaluation process, preferably taking into consideration further register patterns recorded new adjustments for at least one temperature at least of two, further preferably all, for example, printing plates erroneously determined in the axial extent are determined and preferably calculated, and in the second fitting operation the at least one temperature of these printing plates and/or respective cylinder barrels of the respective plate cylinder and/or temperature control means are changed according to the new adjustments.

Preferably, the method is distinguished in that in the second adjustment process a tension within the least one printing plate with respect to a certain circumferential direction is maintained unchanged. Since an angular position of image points, in particular with a temperature-related change of expansions of the corresponding printing form does not depend on the temperature, it is not necessary after the temperature change to additionally perform adjustments that relate to the angular position and/or circumferential direction D.

Preferably, the method is distinguished in that the adjustment of the at least one adjusting element and further preferably of all newly adjusted adjusting elements is machine-controlled and is performed by means of at least one appropriate drive. In particular in combination with the recording of the at least one register pattern by means of the at least one sensor, in particular register sensor, a method that is automated and automatically capable of running for the arrangement of the at least one printing plate on at least one plate cylinder thus preferably results.

Preferably, the method is distinguished in that the at least one printing plate at least is completely relaxed at least partially and further preferably completely with respect to the circumferential direction in that at least one slot carrying the at least one rear clamping device is removed along a tensioning path from the at least one front clamping device arranged in the same channel and/or in that the at least one printing plate is differently tensioned in that at least one slot carrying the at least one rear clamping device is moved along a tensioning path towards the least one clamping device arranged in the same channel after the at least one adjusting element has been readjusted.

Preferably, the method is distinguished in that the at least one printing plate is tensioned differently in that firstly the at least one slot together with the rear end of the printing plate tensioned in the at least one rear clamping device is moved towards the at least one front clamping device and the first channel wall and in that then at least one rear spacer is adjusted to a position relative to the at least one slot and/or relative to a cylinder barrel of the at least one plate cylinder, which at least in one area of this at least one rear spacer fixes a certain distance of the at least one rear clamping device from the second channel wall independently to a tensioning drive and in that subsequently the tensioning drive is deactivated and the at least one slot together with the at least one rear clamping device is thereby held in its position along the tensioning path, in that a force exerted by the tensioned printing plate presses the at least one slot by means of the least one rear spacer against the second channel wall. In one possible mode of operation, at least two rear adjusting elements are modified differently severely in their position relative to the at least one slot and/or relative to the second channel wall. There by the at least one rear clamping device, and in particular its at least one radially inner and or its at least one radially outer clamping elements is preferably elastically deformed per se, preferably in the circumferential direction. There by the printing form is tensioned accordingly deformed in the circumferential direction to differing degrees along its axial extent. Thus, convex and/or concave errors in the arrangement of print images on print plates, for example, can be accommodated.

Preferably, the method is distinguished in that each adjusting element is assigned exactly one register pattern at least partially agreeing with this respective adjusting elements in its position with respect to the axial direction. It is then possible, relatively simply and directly from the register patterns to derive necessary new adjustments of the adjusting elements. Alternatively, for example, in the case of a too small print substrate in printing presses with a variable print substrate width, adjustments of the adjusting elements are determined, preferably calculated, from positions in each case of a number of register patterns. In particular, this is necessary if, as preferred, print substrate with greatly different widths, for example with widths between 400 mm and 900 mm, are used.

Preferably, in a front opening process the at least one front clamping device is opened. Preferably, in a front insertion process a front end of the printing plate is inserted into a front clamping gap of the at least one front clamping device. Preferably, in a front clamping process the at least one front clamping device is closed and in this case the front end of the printing plate is clamped into the at least one front clamping device. Preferably, in a support process the printing plate is then applied to a jacket surface of the print cylinder.

Preferably, in a rear opening process the at least one rear clamping device is opened and beforehand and/or simultaneously and/or thereafter the at least one slot is moved along the tensioning path from an edge position or spaced edge position around an insertion path towards the at least one front clamping device and the first channel wall in a central or in a position. The spaced edge position is preferably a position in which the at least one slot is arranged around a defined reserve track, for example, is arranged spaced between 4 mm and 6 mm from the second channel wall. This reserve track serves for increasing a potential tensioning path. The term the central position serves here for the differentiation compared to the edge position and/or the spaced edge position and in particular does not state that the position must lie exactly in a centre. Preferably, in a rear insertion process a rear end of the printing plate, which meanwhile was placed around the plate cylinder, is laid on the plate cylinder in such a way that it projects at least with one component in a circumferential direction over an edge connecting a second channel wall with the lateral surface of the plate cylinder and then the at least one slot is moved along the tensioning path from its central or inner position around the insertion track towards the second channel wall into its edge position of preferably its spaced edge position. Preferably, the rear end of the printing plate is enclosed at least partially by at least one rear clamping gap of the least one rear clamping device, while the at least one slide is moved along the tensioning path from its central or inner position towards the second channel wall in its edge position or its spaced edge position. By enclose, it is to be understood here that then at least one linear connection at least of one radially inner clamping element of the at least one rear clamping device intersects the rear end of the printing plate with at least one radially outer clamping element of the at least one rear clamping device. Preferably in a rear clamping process the at least one rear clamping device is closed and thereby the rear end of the printing plate clamps in the at least one rear clamping device.

Preferably, in a tensioning process the at least one slide is to be moved along the tensioning path to the at least one front clamping device and the first channel wall and the printing plate is hereby tensioned. Preferably, in a first section of a tensioning process the at least one slide is moved along the tensioning path to the at least one front clamping device and the first channel wall. Preferably, the printing plate is tensioned here with a first force. Preferably, the printing plate is additionally more greatly tensioned than is provided for the printing operation using this printing plate. Preferably, in a second section of the tensioning process the printing plate is relieved again by again moving the at least one slide to the second channel wall. Preferably, in a third section of the tensioning process the at least one slide is again to be moved to the at least one front clamping device and the first channel wall. Preferably, the printing plate is tensioned here with a second force. Preferably, the first force is equally as great as the second force. Preferably, the printing plate remains clamped in the rear clamping device at least from the start of the first section of the tensioning process up to the end of the third section of the tensioning process. Depending on the embodiment of the at least one rear clamping device preferably employed, preferably one of the two embodiments of the tensioning process described below is used.

In a first embodiment of the tensioning process and in particular the third section of the tensioning process, preferably first the at least one slide is to be moved by means of the at least one tensioning drive together with the rear end of the printing plate tensioned in the at least one rear clamping device to the at least one front clamping device and the first channel wall and then preferably at least one rear spacer, which preferably is part of the at least one slide, is adjusted to a position relative to the at least one slide which establishes a certain distance of the least one rear clamping device from the second channel wall independently of the at least one tensioning device, and is deactivated subsequent to the at least one tensioning drive, and the at least one slide together with the at least one rear clamping device is held thereby in its position along the tensioning path, in that a force exerted by the tensioned printing plates presses the at least one slide against the second channel wall by means of its at least one rear spacer. Preferably, at the latest after deactivation of the at least one tensioning drive the at least one rear spacer is in contact with the second channel wall and at the same time with the at least one slide and the distance of the at least one rear clamping device from the second channel wall is thereby fixed independently of the at least one tensioning drive.

In a second embodiment of the tensioning process, preferably firstly at least one rear stop adjusting element, preferably supported in a bearing arranged stationary relative to the cylinder barrel, is moved relative to the cylinder barrel into an intended stop position and then preferably the at least one slide is to be moved by means of the at least one tensioning drive together with the rear end of the printing plate tensioned in the at least one rear clamping device to the at least one front clamping device and the first channel wall until the at least one rear stop adjusting element touches at least one stop body and then preferably at least one fixing device is clamped and this at least one fixing device preferably holds the at least one slide in its position, for example by reducing a pressure in a slide releaser designed as a slide release hose and preferably to the extent that slide spring assemblies are relaxed and thereby preferably at least one slide clamping element is pressed against a first slide clamping surface and then preferably the at least one tensioning drive is deactivated, for example by reducing a pressure in a tensioning drive designed as a tensioning hose, for example to ambient pressure.

Advantages of this plate cylinder and/or this method consist, for example, in the fact that preferably a tensioning drive can also be used to bring a rear clamping device into such a position that an application of the rear end of the printing plate is facilitated and in particular is made possible in an essentially radial direction and without manual threading of the printing plate into the rear clamping device, as preferably the rear clamping device is moved such that it encloses the rear end of the printing plate, nevertheless the radially external clamping element being immovable relative to the slide and thus a particularly stable clamping being achievable.

A further advantage of a preferred embodiment of the plate cylinder and/or of the method consists, for example, in that in a clamped and/or tensioned state of the printing plate no drive of a clamping device or tensioning device has to be activated.

A further advantage consists in the fact that on repeated use of the method with the same or a different printing plate very precise reproducible results of the position and tensioning of the printing plates are achievable.

The preferred system for register control in particular in the printing press preferably contains at least the printing press, the machine control of the printing press and at least a data input of the machine control for recording of register data at least of one printing plates of the printing press. The system for register control contains at least one temperature control system connected with the machine control by circuitry, for example by means of at least a data line connected temperature control system [sic], by means of which the at least one temperature of the at least one printing plates arranged on at least one plate cylinder of the printing press and/or at least of a cylinder barrel of the at least one plate cylinder and/or at least one temperature control means, interacting with the at least one printing plate and/or this, in particular, a temperature controlling fluid, is controllable and/or regulable depending on the recorded register data. The at least one data line can be designed as a physically present line and/or as a wireless, at least temporarily existing line, for example as a line formed by electromagnetic waves, in particular a radio line. The at least one data input is preferably connected to the at least one register sensor by circuitry. The at least one register sensor is preferably designed as at least one area camera.

Preferably, the method and/or the system for register control and/or the tensioning device is based on the principle that the corresponding printing form is firstly clamped to the forme cylinder and prepared by tensioning it once and slackening again and in that the printing form is then acted upon by a first tensioning force by means of the at least one slide with a first tensioning force that causes a stretching of the printing form and thus of the print image and that then a minimal lowering of the tensioning force to a second tensioning force takes place, in which the printing plate firstly remains tensioned to carry out a sample printing. If it turns out that changes should be performed, then the printing plate is firstly partially and preferably completely slackened and then tensioned by means of the at least one slide with a newly determined third tensioning force, which causes, an altered extension of the printing form and of the print image. Subsequently, in turn a minimal lowering of the tensioning force to a fourth tensioning force takes place, in which preferably a printing operation is carried out. Preferably, the difference between the first tensioning force and the second tensioning force is markedly smaller than a difference between the first tensioning force and the third tensioning force. Preferably, a difference between the third tensioning force and the fourth tensioning force is clearly smaller than a difference between the first tensioning force and the third tensioning force.

Advantages of a preferred safety device of a plate cylinder of a printing press and a method for securing a plate cylinder of a printing press preferably consists in that operating personnel are protected from injuries which otherwise would threaten a failure of a tensioning drive of a tensioning device of a plate cylinder. When using the tensioning drive sometimes very higher forces occur, in particular because the corresponding devices for tensioning and/or aligning printing plates have to apply high forces. If a slide, for example, is situated in a position in which a distance between slides and a channel wall is present and, for example, and the same time still no printing plate or no longer any printing plate is arranged on the plate cylinder, a gap for, for example, fingers of operating personnel is accessible. This represents a danger, because in the case of a failure of that drive, which has moved the slide into this position and holds it there, the slide is possibly to be moved to the channel wall with great force and/or speed. This danger results, in particular due to the greater travel range and/or the movement of the slide without a clamped printing plate.

A safety device of a plate cylinder of a printing press preferably serves for this purpose, the plate cylinder, having at least one tensioning device arranged in a channel of the plate cylinder, which has at least one slide movable in and/or against a tensioning direction and where the tensioning device has at least one safety stop and at least one safety device movable in and/or against a safety direction different from the tensioning direction and where the at least one safety device is arranged movably between a safety position and a release position.

Preferably, the safety device is distinguished in that in the case of a safety device arranged in the safety position a projection of the at least one safety device in the tensioning direction and a projection of the at least one safety stop in the tensioning direction overlap at least partially. An advantage then exists in particular in that in this state the at least one safety device and the at least one safety stop can be brought into contact with one another by a relative movement in the tensioning direction. Preferably, the safety device is distinguished in that in the case of a safety device arranged in the release position a projection of the at least one safety device in the tensioning device and a production of the at least one safety stop in the tensioning direction through not overlap. Then an advantage in particular exists in that the at least one slide can be moved in the tensioning direction unhindered.

Preferably, the safety device is distinguished in that the at least one security body is not in contact with the at least one security stop in the security position and/or in that the at least one safety body can be brought into contact with the at least one security stop in the security position by movement of the at least one slide against the tensioning direction. An advantage then exists in particular in that the at least one slide is prevented in its movement in and/or against the tensioning direction and thus secured.

Preferably, the safety device is distinguished in that the at least one slide has at least one clamping device for at least one printing plate. An advantage then exists in particular in that the movement of the at least one slide facilitates an insertion of a printing plate into this clamping device. This advantage results also and in particular when the safety device is distinguished as preferred in that the at least one slide is arranged movably in and/or against the tensioning direction based in the channel between an edge position and an inner position, and in that the edge position is a position of the at least one slide, in which the at least one slide touches a channel wall and in that the inner position is a position of the at least one slide in which the at least one slide has a spacing from the channel wall.

Preferably, the safety device is distinguished in that the at least one slide is movable in and/or against the tensioning direction by means at least of a tensioning drive. An advantage then in particular exists in that movements of the at least one slide can be performed in automated form.

Preferably the safety device is distinguished in that the at least one security body is movable by means of at least one safety drive and/or at least one security spraying in and/or against the security direction. An advantage then in particular exists in that movements of the at least one security body can on the one hand be carried out in automated form and on the other hand can be carried out in a particularly failsafe manner. Preferably, the safety device is distinguished in that the at least one security spraying is permanently arranged exerting a force acting in the security direction on the at least one security body. An advantage then in particular exists therein in that a failure of the safety drive cannot lead to an endangering of operating personnel.

Preferably, the safety device is distinguished in that the at least one safety stop is arranged firmly connected fixed relative to the at least one slide and/or with the at least one slide and/or in that at least one safety drive of the at least one security body is arranged firmly connected fixed relative to a cylinder barrel of the plate cylinder and/or with the at least one cylinder barrel. An advantage then in particular exists in that supply lines of the safety device do not have to be connected to the at least one movable slide.

Preferably, the safety device is characterized in that the at least one security drive as at least one pneumatic safety drive is configured. Then there is an advantage in particular in that the safety drive is simple and reliable.

Preferably, the safety device is distinguished in that a structural body, on which the at least one safety stop is arranged, acts as a covering of the at least one safety body and/or of the at least one safety drive, in particular, at least as long as and/or provided the at least one slot is situated in the at least one peripheral location of the at least one inner peripheral location. The advantage results therefrom that less or no dirt is carried into the range of motion of the at least one safety body and/or of the at least one safety drive.

Preferably, the safety device is distinguished in that the at least one safety drive is designed as at least one pneumatic safety drive. An advantage in particular then exists in that the safety drive is constructed simply and reliably.

Preferably, the safety device is distinguished in that the at least one security stop is designed wider in an axial direction than the at least one security body. The advantage preferably results thereby in that the at least one slide is also then movable with respect to the axial direction if the at least one security body is situated in the security position. Preferably, this mobility is also guaranteed if both at least one front clamping device as well as at least one rear clamping device are closed. In particular, the at least one slide is preferably also then arranged movably in the axial direction by at least 4 mm and further preferably by at least 8 mm when the at least one security body is situated in the security position. This serves, for example, to adjust a position of the at least one printing plate. The at least one security stop can be designed, for example, as at least one boundary surface at least of a slot extending in the axial direction.

The method is preferably extended and/or extendable to and/or combined and/or combinable with an advantageous method for the safeguarding of a plate cylinder of a printing press, at least one slide of a tensioning device of the plate cylinder being moved in a tensioning direction and firstly at least one security body of a security device of the plate cylinder being arranged in a release position, in which a projection of the at least one security body, in the tensioning direction and a projection at least of one security stop do not overlap in the tensioning direction and in connection the at least one security body being moved from the release position to a security position, in which the projection of the at least one security body in the tensioning direction and the protection of the at least one security stop in the tensioning direction at least partially overlap. Preferably, the method is distinguished in that in the security position the at least one security stop is arranged further in the tensioning direction than the at least one security body.

This is purity of operating personnel is preferably further increased in that it is assessed whether at least one position sensor has recorded the at least one security body within ace prespecified timespan of, for example, less than 10 s (ten seconds) after an activation at least of one tensioning drive. If this should not be the case, this indicates a malfunction. This is then preferably communicated to the operating personnel, for example, by means of at least one optical and/or at least one acoustic signal. Preferably, the method is saving discontinue that this points and/or the at least one tensioning drive is deactivated.

BRIEF DESCRIPTION OF THE DRAWINGS

Preferred embodiments of the present invention are shown in the drawings and are described more closely below.

The figures show.

DESCRIPTION OF PREFERRED EMBODIMENTS

Figure 1:
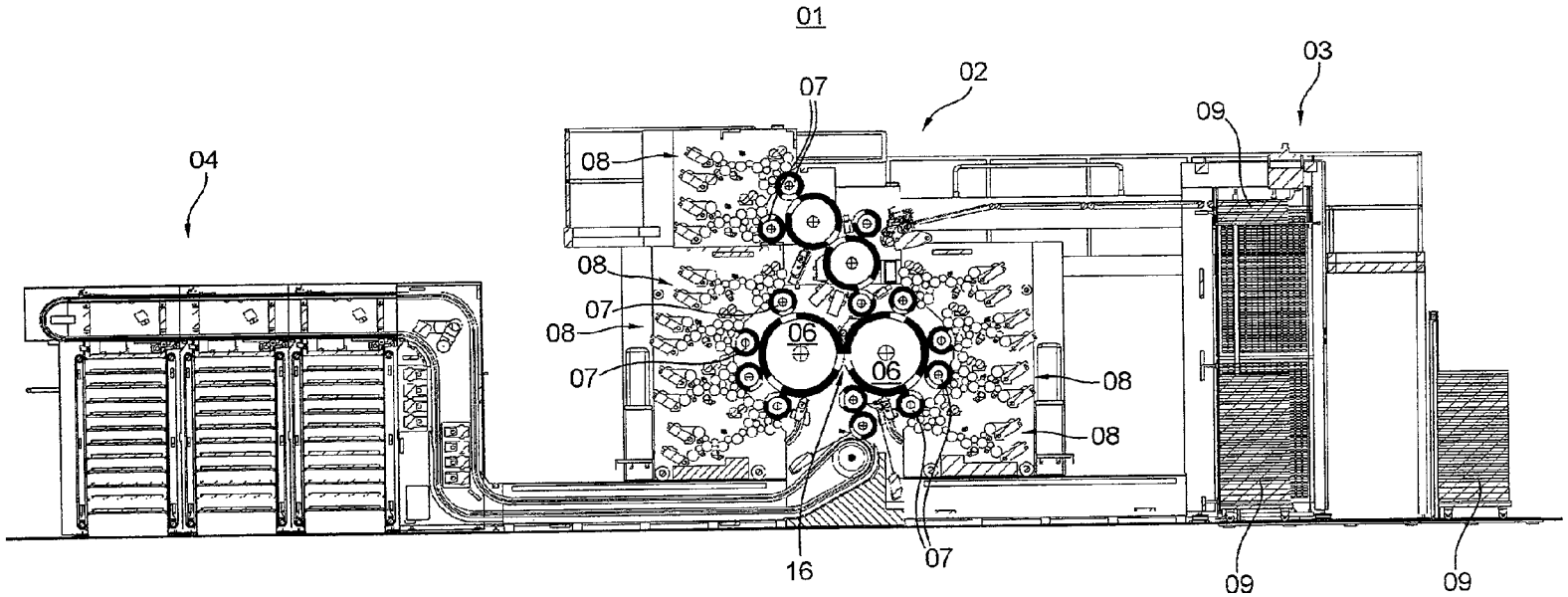
FIG. 1 a schematic representation of an exemplary printing press.
Figure 2:
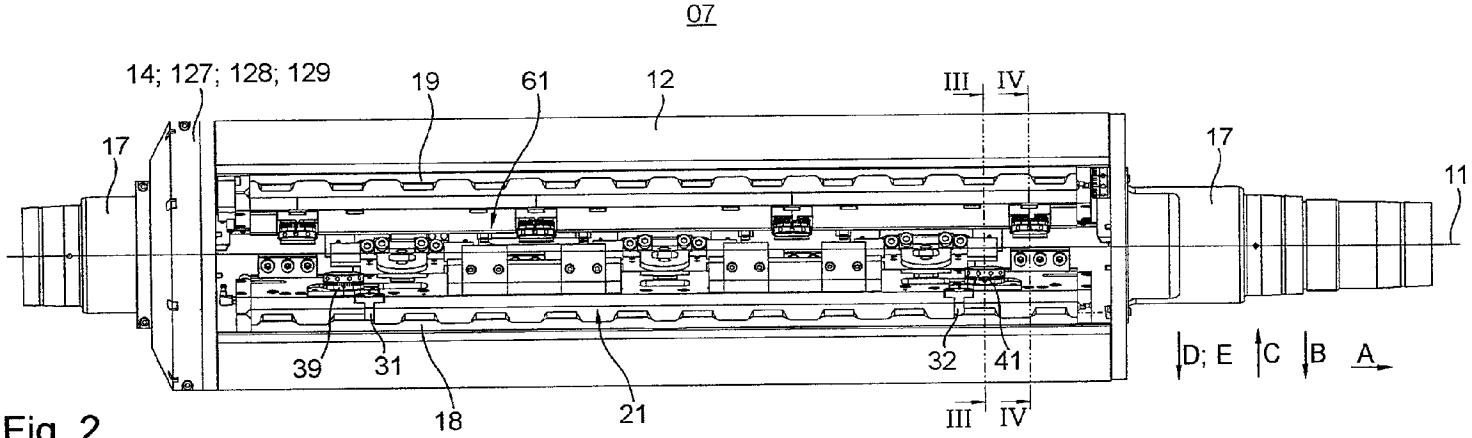
FIG. 2 a schematic representation of a top view of a plate cylinder of a printing press.
Figure 3:
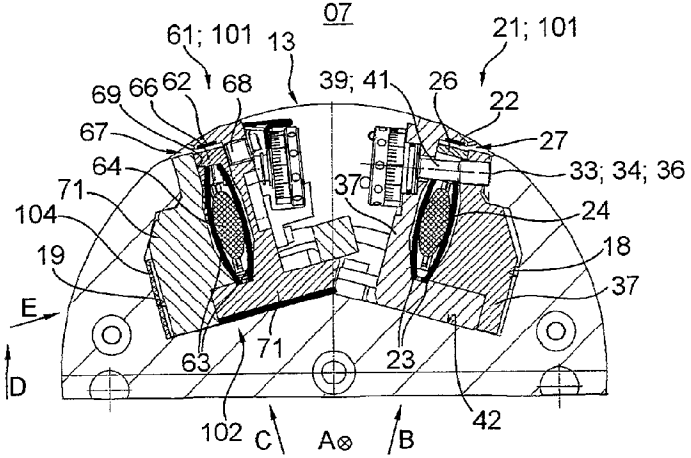
FIG. 3 a schematic representation of a cross-section of a tensioning device of the plate cylinder shown in FIG. 2 with opened clamping devices and a first fixing device.
Figure 4:
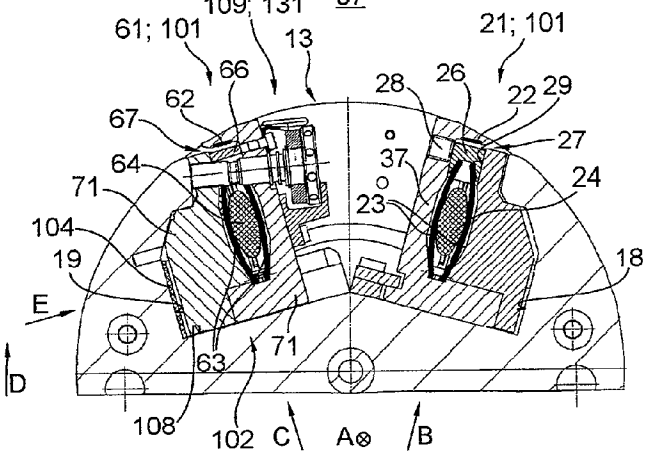
FIG. 4 a schematic representation of a cross-section of a tensioning device of the plate cylinder shown in FIG. 2 with opened clamping devices.
Figure 5:
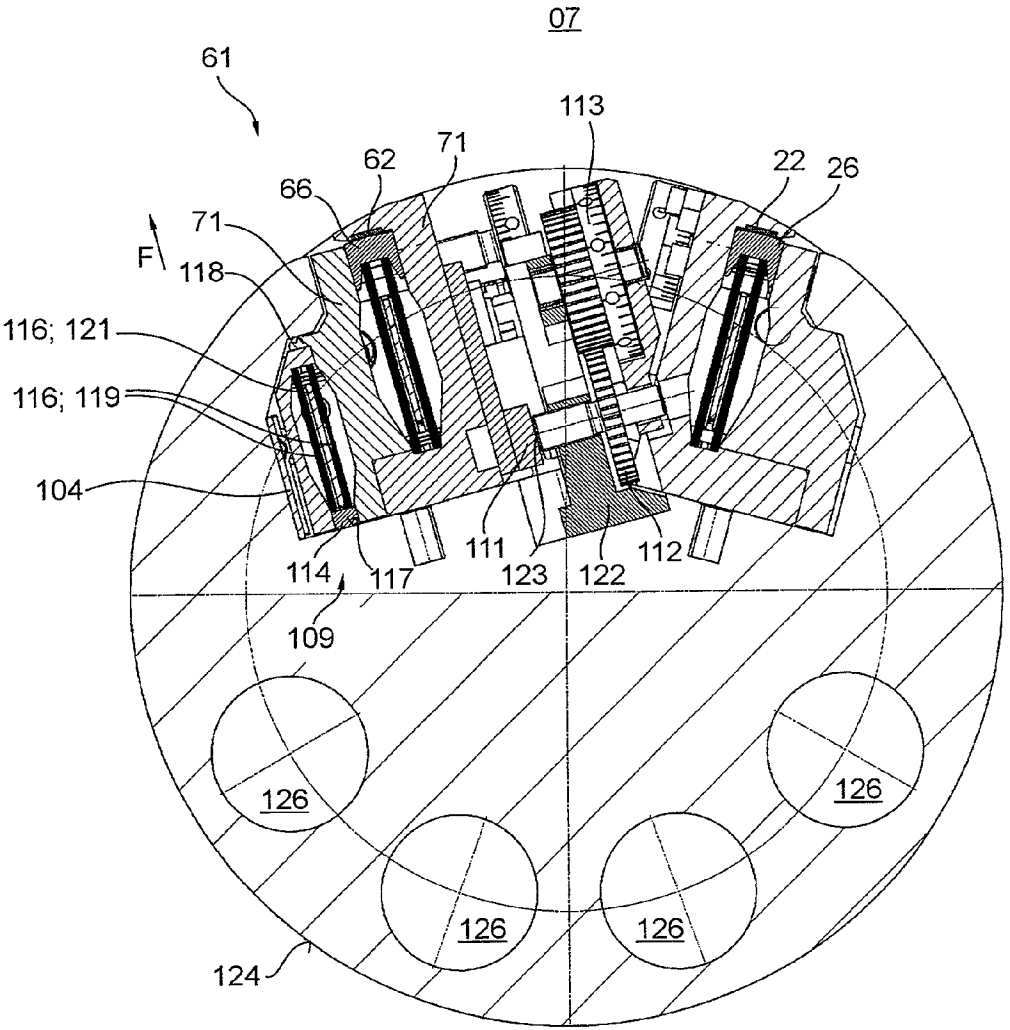
FIG. 5 a schematic representation of a tensioning device of the plate cylinder shown in FIG. 2 with a second fixing device.
Figures 6, 7, 8, 9:
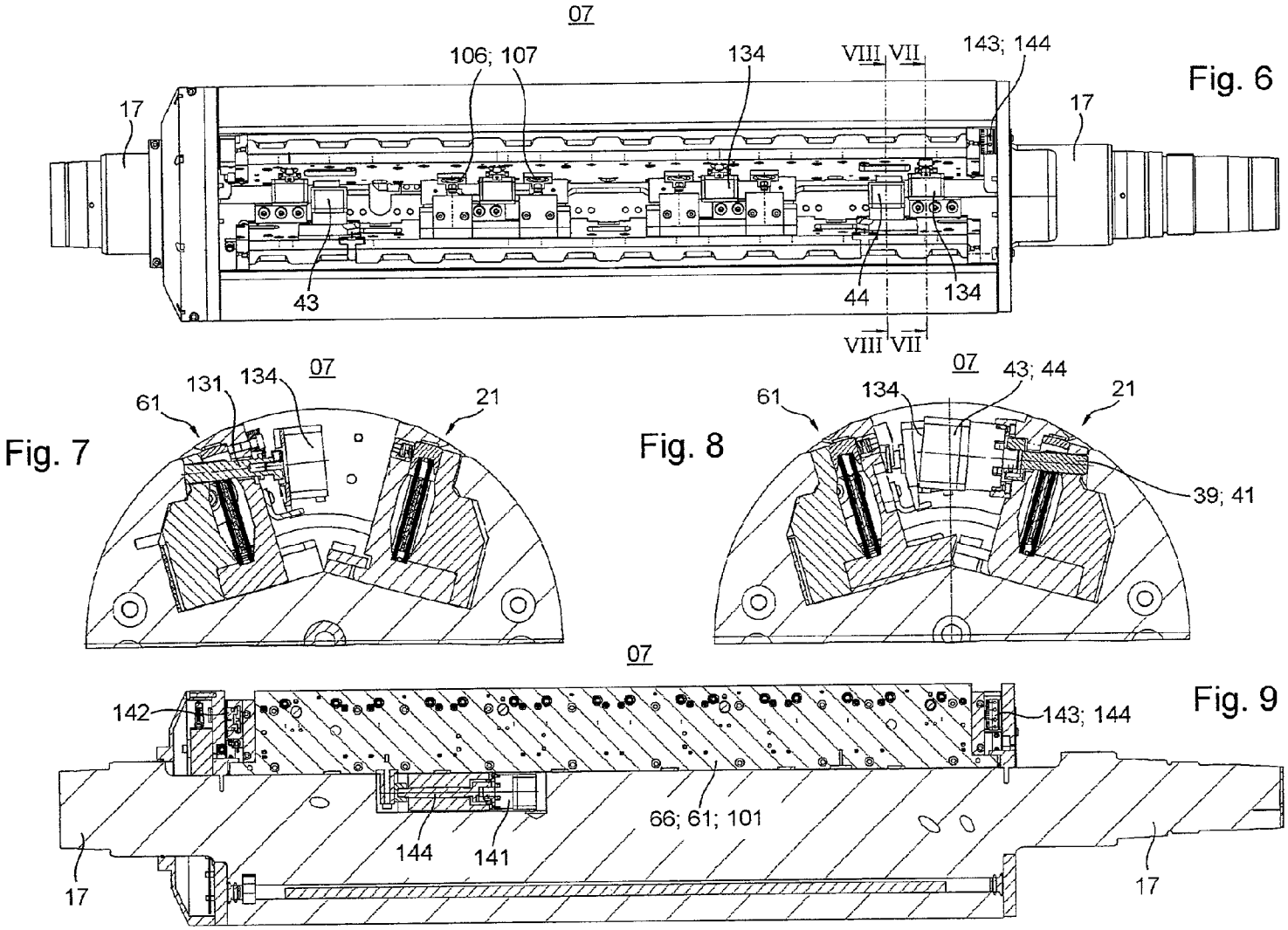
FIG. 6 a schematic representation of a top view of a plate cylinder of a printing press.
FIG. 7 a schematic representation of a cross-section of a tensioning device of the plate cylinder shown in FIG. 6.
FIG. 8 a schematic representation of a cross-section of a tensioning device of the plate cylinder shown in FIG. 6.
FIG. 9 a schematic representation of a longitudinal section of a plate cylinder of a printing press.
Figure 10:
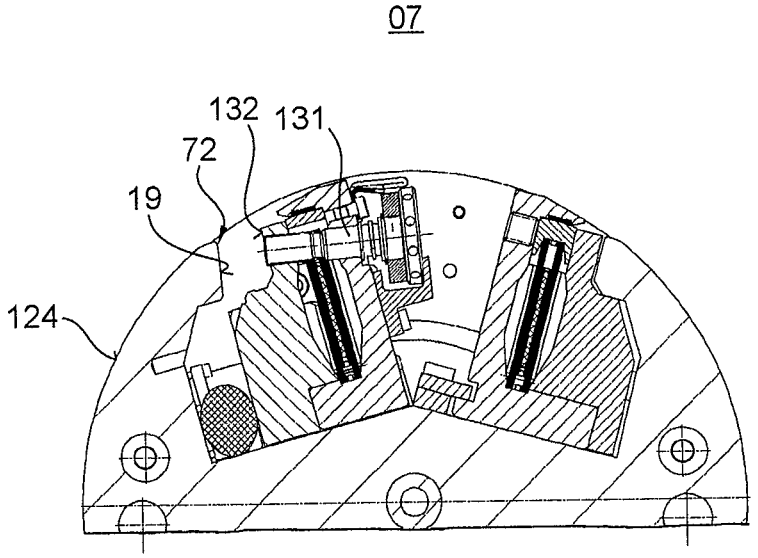
FIG. 10*a* a schematic representation of a cross-section of a tensioning device of the plate cylinder with shifted slides shown in FIG. 2.
FIG. 10*b* a schematic representation of a cross-section of a tensioning device of the plate cylinder shown in FIG. 2 with shifted slides and loaded printing plate.
Figure 10:
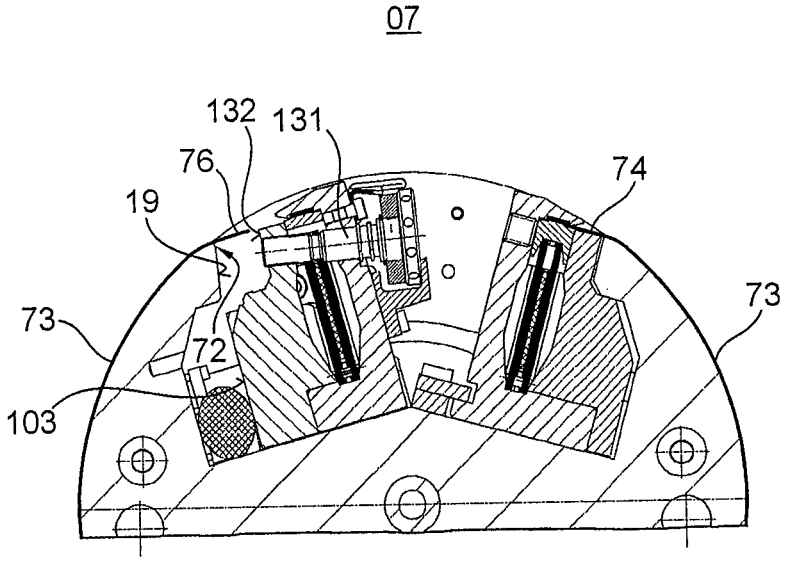
Figure 11:
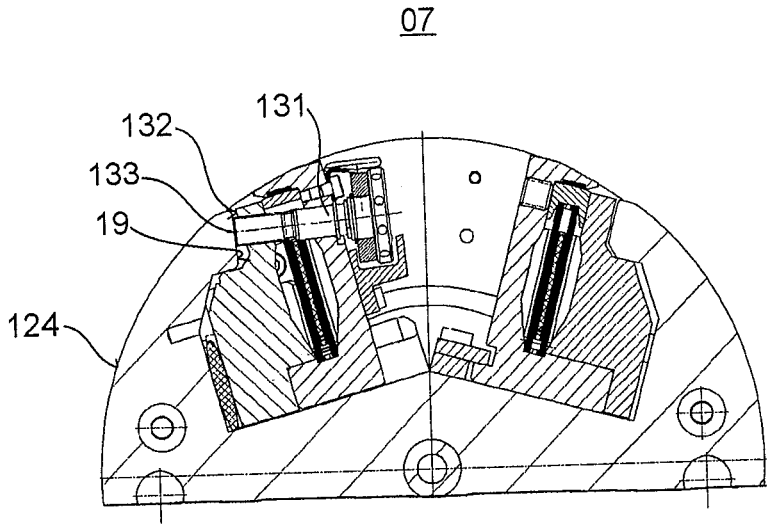
FIG. 11 a schematic representation of a cross-section of a tensioning device of the plate cylinder shown in FIG. 2 with shifted slides.
Figure 12:
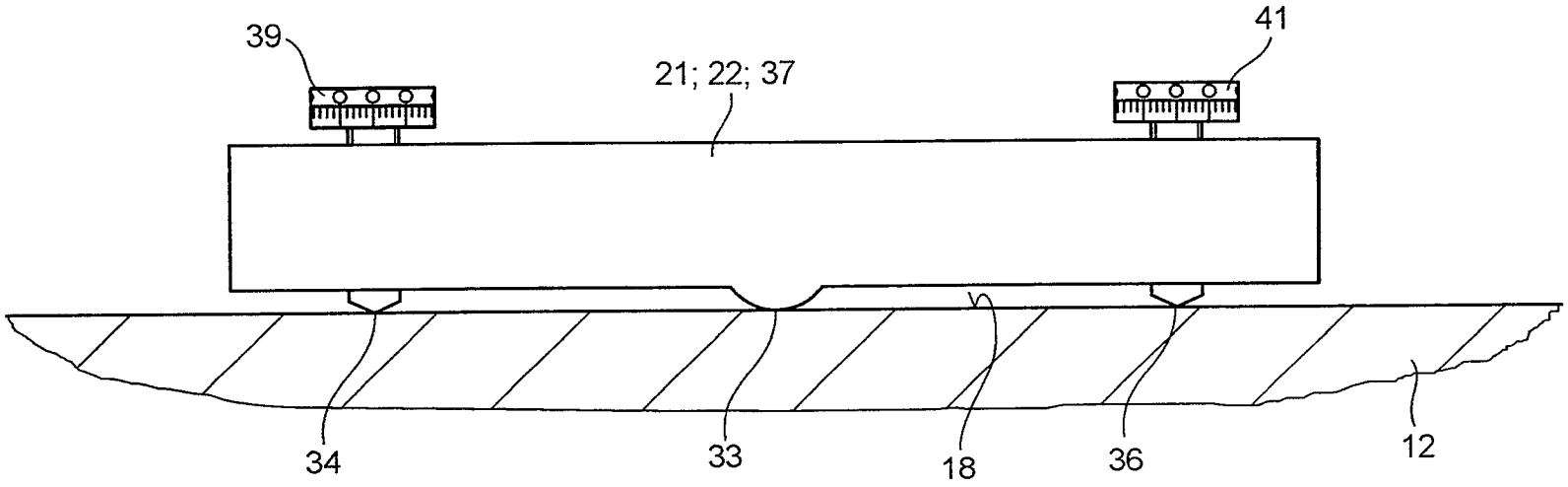
FIG. 12 a schematic representation of a front clamping device in a view orthogonal to an axis of rotation of the plate cylinder.
Figure 13:
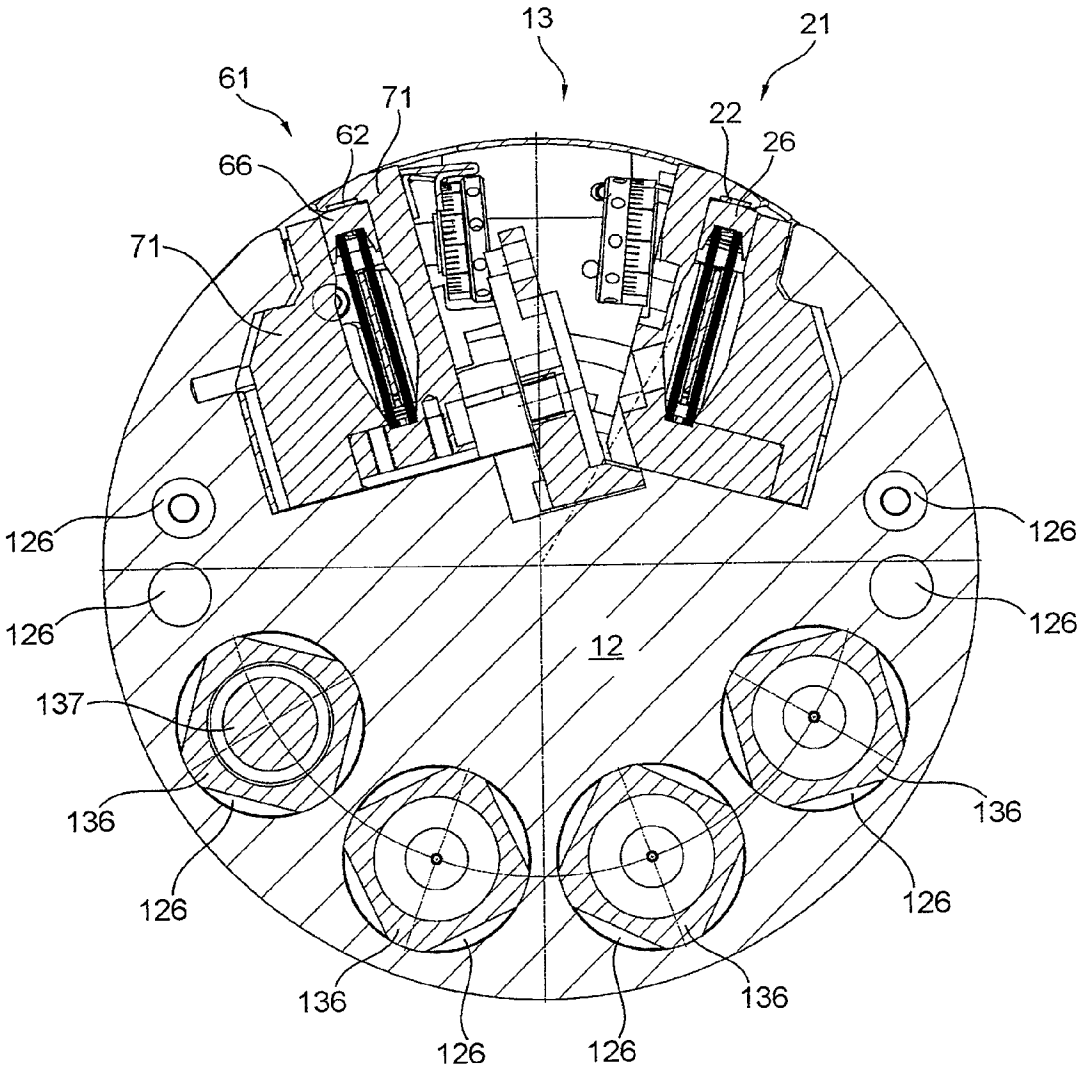
FIG. 13 a schematic representation of a cross-section of the plate cylinder.
Figure 15:
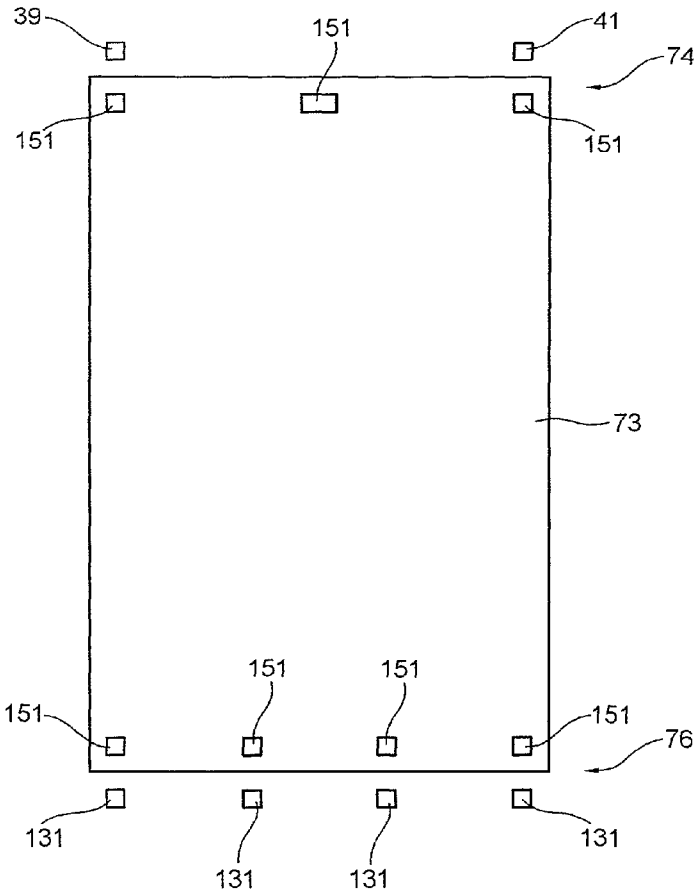
FIG. 15 a schematic representation of a printing plate having a number of register patterns.
Figure 14:
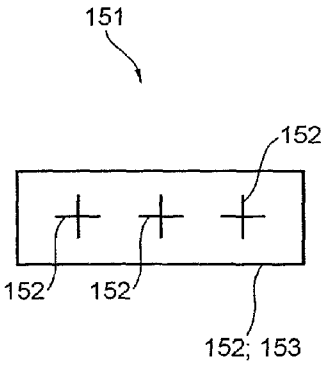
FIG. 14 a schematic representation of a register pattern.
Figure 16:
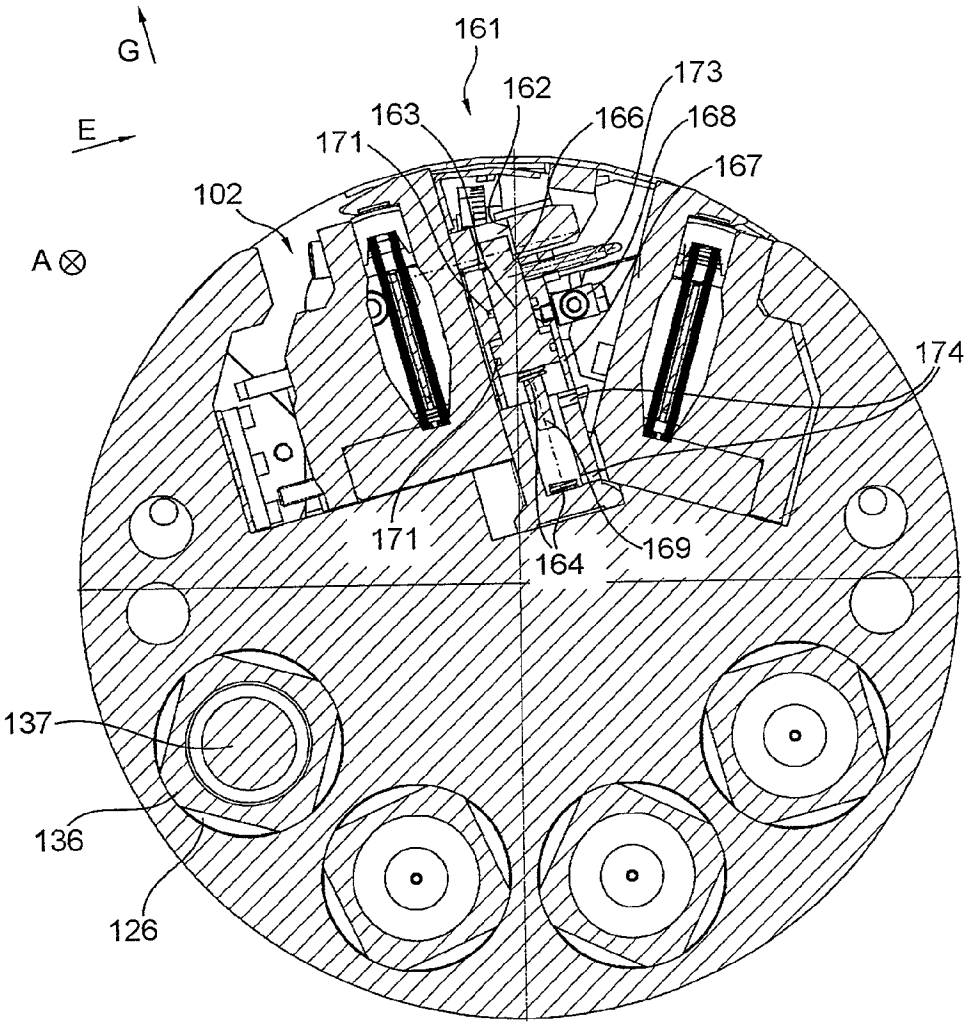
FIG. 16 a schematic representation of a cross-section of a safety device having security bodies located in a release position.
Figure 17:
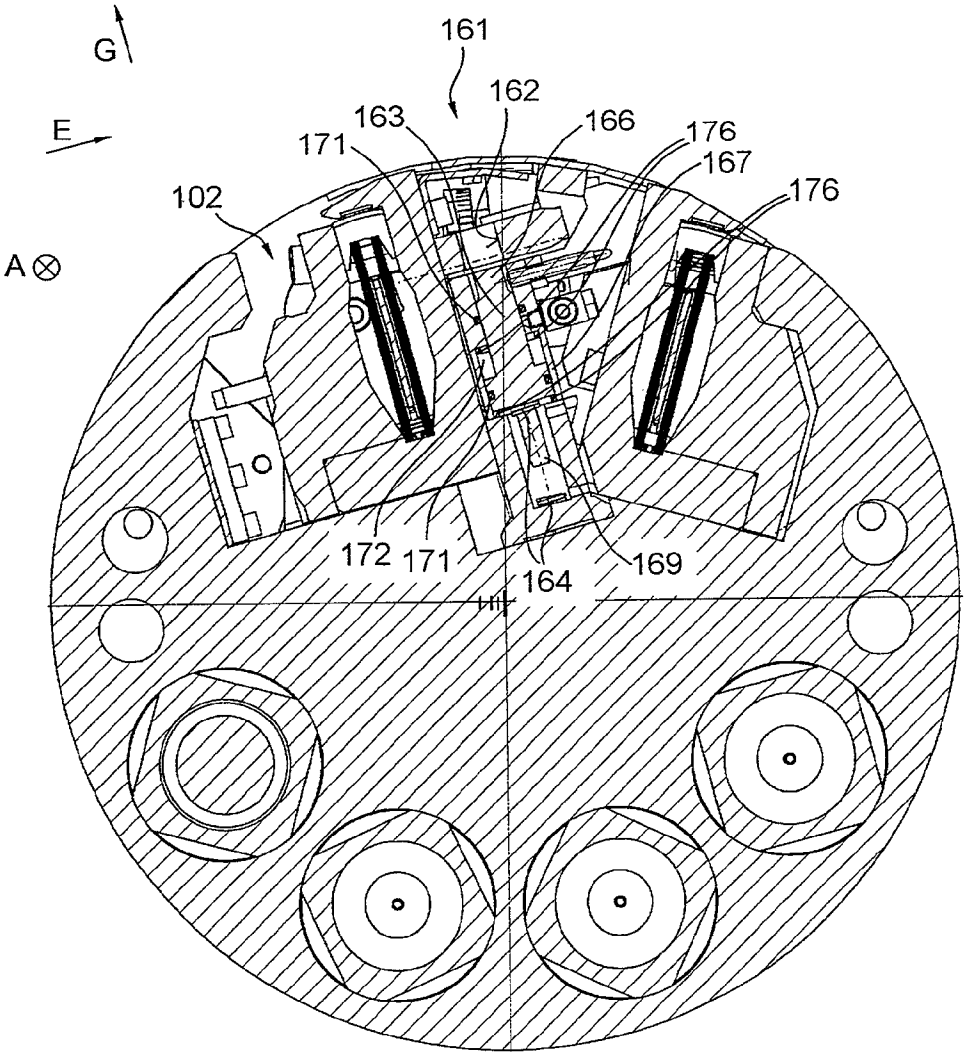
FIG. 17 a schematic representation of a cross-section of a safety device having security bosses located in a security position.

A printing press 01 designed as a rotary printing press 01, for example as a sheet-fed rotary printing press 01, is described by way of example below. The printing press 01 is, for example, a printing press 01 used in security document printing. The printing press 01 is designed as a printing press 01 preferably printing a sheet-form print substrate 09, that is as a sheet-fed printing press 01. The printing press preferably has at least one printing unit 02, which preferably has at least one printing couple 08 and preferably at least one inking unit, the at least one printing couple 08 preferably having at least one forme cylinder 07. The at least one forme cylinder 07 is preferably designed as at least one plate cylinder 07. Preferably, a number of printing couples 08 and a number of inking units are provided in the at least one printing unit 02 to print different printing inks on the same print substrate 09 in one and the same production, for example corresponding to the number of these inking units. In one embodiment, in the same printing unit 02 are arranged printing couples 08, which preferably operate according to different printing principles. For example, at least one printing couple 08 is designed as a flat printing couple 08, for example an offset printing couple 08 and/or at least one other printing couple 08 is designed as a letterpress printing couple 08, in particular a letterset printing couple 08. These different printing couples 08 then print, for example, the one and the same print substrate 09 in one and the same production, further preferably by means at least of a common transfer cylinder 06. In one embodiment, preferably at least one printing couple is designed as at least a steel intaglio printing couple 08.

The printing press 02 preferably has at least one print substrate source 03 in the form of a sheet feeder 03. The printing press 01 preferably has at least one sheet feeder 04, which preferably has at least one and further preferably at least three discard piles. Preferably, at least one dryer is arranged along a transport path of the print substrate 09 before the at least one discard pile, for example an infrared radiation dryer and/or an ultraviolet radiation dryer. For example, the printing press 01 has ten forme cylinders 07, in particular plate cylinders 07. A sheet-fed rotary printing press 01 having a printing unit 02 having a number of printing couples 08 is also shown by way of example in FIG. 1. For example, the printing press 01 has at least one printing couple 08 and at least one dryer, which in each case are arranged on the print substrate 09 acting along a transport part of the print substrate 09 before transfer cylinders 06 described below.

Preferably, the at least one printing unit 02 has at least one transfer cylinder 06 designed as a rubber cloth cylinder 06, in the contact area of which with a further cylinder a printing gap 16 is preferably established and which is preferably in contact with a plurality of plate cylinders 07. Further preferably, the at least one printing unit 02 has at least one pair of transfer cylinders 06 preferably designed as rubber cloth cylinders 06. Thus preferably at least two transfer cylinders 06 are arranged. Preferably, by means of a common contact area of this at least one pair of transfer cylinders 06 a print gap 16 is established. Preferably, at least one and further preferably each of the at least two transfer cylinders 06 is in preferably rolling contact with at least one plate cylinder 07 and further preferably with a plurality of, for example four, plate cylinders 07. Preferably, the printing unit 02 is designed as a multi-ink printing unit 02. Preferably, at least one printing form 73 in the form of at least one and preferably exactly one printing plate 73 is arranged on the at least one plate cylinder 07. Preferably, exactly one printing plate 73 is arranged or provided on each plate cylinder 07, the extension of which in an axial direction A of the plate cylinder 07 preferably corresponds to at least 75% and further preferably at least 90% of an extension of a cylinder barrel 12 of the at least one plate cylinder 07 in this axial direction A. Preferably, the at least one transfer cylinder 06 has a circumference that corresponds to a whole number multiple of the circumference of the at least one plate cylinder 07, for example three times.

Preferably, each inking unit cooperating with a plate cylinder 07 is arranged to be movable away from this respective plate cylinder 07. Thereby, the corresponding plate cylinder 07 is accessible for maintenance work and in particular for a printing plate change. Further preferably, the inking units of all plate cylinders 07 interacting with a common transfer cylinder 06 are arranged to be movable away together from these plate cylinders 07 and to this end are further preferably stored in a common subframe. For example, with corresponding arrangement of the at least one plate cylinder 07 and of the assigned inking unit at least one printing plate store is moved towards at least one printing plate store on the at least one plate cylinder 07. This at least one printing plate store contains at least one printing plate 73 to be replaced on the at least one plate cylinder 07. The at least one printing plate store preferably contains a number of printing plates 73, which are assigned and/or to be assigned to a number of plate cylinders 07. The at least one printing plate 73 store in addition to a controlled positioning of the printing plate relative to the corresponding plate cylinder 07 also serves for a protection of the printing plate 73 to be replaced. Preferably, at least one pressing means, for example a pressure roller, is arranged that serves, on placing the printing plate 73 on the plate cylinder 07, to press this printing plate 73 against the plate cylinder 07.

The printing plate 73 preferably has a dimensionally stable carrier plate and at least one plate coating. The dimensionally stable carrier plate consists, for example, of a metal or an alloy, for example aluminium or steel. In at least one indirect offset printing couple, preferably at least one carrier plate of steel is used. In at least one wet offset printing couple and/or at least one waterless offset printing couple, preferably at least one carrier plate of aluminium is used. Preferably, the carrier plate has a thickness, thus a smallest dimension, of 0.25 mm to 0.3 mm. The at least one plate coating defines a print image of the printing plate 73. The print image can be specified, for example, in that parts of a surface of the printing plate 73 have hydrophobic properties, while other parts of the surface of the printing plate 73 have hydrophilic properties. Depending on properties of a printing ink to be employed, then only selected areas of the printing plate 73 transfer this printing ink. A printing plate 73 of this type transfers printing ink according to a flat printing process, in particular offset printing process. Here, a waterless offset printing process can be employed or a so-called "wet offset printing process" can be employed, for which the printing couple then contains at least one moistening unit.

Alternatively to this, the print image is fixed in that the plate coating is firstly applied over the entire surface and is cured selectively in an exposure process, while the uncured areas are washed, for example with water. Alternatively, a coating is applied only selectively or removed selectively in another manner, for example by etching or mechanically by engraving. Areas thereby result, for example areas not washed, which relative to the carrier plate are arranged raised and areas, for example washed areas, that lie lower and are formed, for example, by the exposed carrier plate. Such a printing plate 73 transfers printing ink according to a letterpress process, preferably to the corresponding transfer cylinder 06, from where it is transferred to the print substrate 09. As the printed image is only transferred from the transfer cylinder 06 to the print substrate 09, this is a letterset process.

The printing plate 73 is alternatively designed as a template printing plate 73. Such a template printing plate 73 has, for example, relatively coarse raised surfaces, which are completely inked and from which printing ink is transferred directly or indirectly by means of a collecting cylinder to a steel engraving cylinder. Such a steel engraving cylinder has fine engravings, in which printing ink is stored, while it is removed outside of the engravings, for example wiped off. Preferably, different printing inks are collected from a number of printing plates 73 on the steel engraving cylinder, further preferably the areas of different inks on the steel engraving cylinder at most minimally overlapping. By rolling contact and, for example, by pressure, the printing ink on the engravings is transferred to a print substrate 09. The printing plate 73 is alternatively designed as a flexographic printing plate 73 for direct or indirect flexographic printing. Independently of the design of the printing plate 73, the printing plate 73 serves for a preferably targeted transfer of printing ink and/or lacquer. Correspondingly, in the foregoing and in the following always when there is question of printing ink, alternatively also a lacquer is meant, in particular in the case of the flexographic printing plate 73.

Independently of the material used, the printing plate 73 preferably has a front end 74 and a rear end 76. The front end 74 of the printing plate 73 is preferably an end 74 of the printing plate 73 preceding in a printing operation. The rear end 76 of the printing plate 73 is preferably an end 76 of the printing plate 73 trailing in the printing operation. The front end 74 of the printing plate 73 preferably has a front contact area 74, which serves for clamping of the printing plate 73 to the plate cylinder 07. Preferably, this contact area 74 has no plate coating transferring printing ink. The rear end 76 of the printing plate 73 preferably has a rear contact area 76, which serves for clamping of the printing plate 73 to the plate cylinder 07. Preferably, this contact area 76 has no plate coating transferring printing ink. Preferably, the printing plate 73 in the contact areas 74; 76 consists exclusively of the dimensionally stable carrier plate. Owing to the contact areas 74; 76, a high reproducibility and a high reliability at least of a clamping contact of the printing plate 73 with parts of the plate cylinder 07 is guaranteed. The front end 74 and/or the rear end 76 of the printing plate 73 is or are preferably designed as clamping areas 74; 76 differently curved from a middle part of the printing plate 73. The clamping areas 74; 76 are preferably in each case angled between 15° and 40° compared to the middle part of the printing plate 73, further preferably between 17° and 22° at the front end 74 and between 35° and 40° at the rear end 76. Preferably, the front end 74 and the rear end 76 of the printing plate 73 in each case have an elongation in the circumferential direction D, which is between 10 mm and 30 mm, further preferably at least 15 mm and still further preferably between 15 mm and 20 mm. An application of the printing plate 73 to the plate cylinder 07 preferably takes place at least partially by means of an application device, for example of an automatic plate feed.

In a printing operation of the printing press 01, at least one sheet 09 gripped by a sheet feeder 03, preferably a sequence of a number of sheets 09, is fed to the printing unit 02. The printing unit 02 preferably works in recto and verso printing, both sides of the print substrate 09 simultaneously being inked in the printing nip 16. Further preferably, in the printing nip 16 multicoloured print images are transferred to the print substrate 09 in a single printing step. These multicoloured print images are preferably composed of individual coloured partial print images, which have been transferred beforehand from a number of plate cylinders 07 to the corresponding transfer cylinder 06 and collected there. The printing unit 02 preferably consists of two essentially identically constructed halves. Each of the halves has a transfer cylinder 06 preferably designed as a rubber cloth cylinder 06. The plate cylinder 07 and in particular printing plates 73 arranged thereon are preferably inked by one inking unit each with a different printing ink in each case. The plate cylinders 07 preferably in each case transfer at least one print image to the corresponding transfer cylinder 06 on which they are employed. Thereby, a multicoloured print image is preferably created on each transfer cylinder 06, which further preferably is transferred to the print substrate 09 in a single step.

As described, for example, a number of, preferably four, plate cylinders 07 are assigned to each transfer cylinder 06 in each case, on each of these plate cylinders 07 in each case a printing unit being employed or at least being employable, such that preferably the two transfer cylinders 06 together can print, for example, up to eight printing inks. Preferably, at least in each case a common counter-pressure cylinder 06 and the plate cylinder 07 employed thereon and/or interacting therewith are coupled to one another by means of at least one gear wheel drive and by at least one common drive motor. The inking units are coupled or are couplable thereto, but in principal can in each case also have their own drive motors.

The at least one plate cylinder 07 of the printing press 01 is explained in greater detail below. At least the plate cylinders 07 interacting with the transfer cylinders 06 are preferably essentially designed to be structurally identical. Each plate cylinder 07 preferably contains the cylinder barrel and two cylinder journals 17. The cylinder barrel 12 preferably has at least one channel 13, which extends in the axial direction A with respect to an axis of rotation 11 of the plate cylinder 07 and which is open in the radial direction with respect to the axis of rotation 11 of the plate cylinder 07. The channel 13 preferably has a first channel wall 18 and a second channel wall 19, which at least partially restrict the channel 13 in the circumferential direction D. The first channel wall 18 is preferably a channel wall 18 of the at least one channel 13 trailing in the printing operation. The second channel wall 19 is preferably a channel wall 19 of the at least one channel 13 preceding in the printing operation. The cylinder journals 17 of the plate cylinder 07 concerned are preferably mounted in each case at least in a bearing preferably designed as a radial bearing, the respective bearing being arranged in or on a frame wall of the printing unit 02. A first end of the plate cylinder 07 relative to the axial direction A is designated as side I, a second end of the plate cylinder 07 relative to the axial direction A is designated as side II. On the side I of the plate cylinder 07 is preferably arranged a valve block 14 on a front side of the cylinder barrel 12 concerned. The cylinder journal 17 assigned to side II of the plate cylinder 17 is preferably connected or at least connectable to a rotational drive, by means of which the plate cylinder 07 concerned is driveable and/or driven to a rotational movement around the axis of rotation 11 of the plate cylinder 07. A connection of the cylinder journal 17 assigned to side II to the rotational drive assigned to the plate cylinder 07 concerned preferably has at least one obliquely toothed gear wheel. In a known manner, an adjustment of a circumferential register of the plate cylinder 07 concerned is thereby made possible. Alternatively, the at least one plate cylinder 07 has at least one separate individual drive. Preferably, the plate cylinder 07 has at least one preferably axial bore 126, which can be flowed through and/or is flowed through for the temperature control of a temperature control fluid, for example of a temperature control liquid.

In the at least one channel 13 of the plate cylinder 07 is arranged at least one tensioning device 101 of the plate cylinder 07. The at least one tensioning device 101 has at least one clamping device 21; 61, preferably at least one front clamping device 21 and at least one rear clamping device 61. The at least one front clamping device 21 is preferably arranged more closely to the first channel wall 18 of the at least one channel 13 than the second channel wall 19 of the at least one channel 13. The at least one rear clamping device 61 is preferably arranged more closely to the second channel wall 19 of the at least one channel 13 than the first channel wall 18 of the at least one channel 13. The at least one front clamping device 21 serves for clamping of a front end 74 of a printing plate 73, which is rolled and/or rollable onto and/or applied and/or applicable to the jacket surface 124 of the cylinder barrel 12 of the plate cylinder 07. The at least one rear clamping device 61 serves for clamping of a rear end 76 of a printing plate 73 and preferably of the same printing plate 73. In particular, it is the same printing plates 73 if, as preferred, the plate cylinder 07 has precisely one channel 13, which has both a front clamping device 21 as well as a rear clamping device 61. The front end 74 of the printing plate 73 is preferably an end 74 of the printing plate 73 preceding in a printing operation. The rear end 76 of the printing plate 73 is preferably an end 76 of the printing plate 73 trailing in a printing operation. For arranging the at least one printing plates 73 on the at least one plate cylinder 07, preferably the front end 74 of the printing plates 73 is first fixed in the at least one front clamping device 21 and subsequently this plate cylinder 07 is swivelled around its axis of rotation 11 to roll or to apply the printing plate 73 to the jacket surface 124 of the plate cylinder 07, and then the rear end 76 of the printing plate 73 is fixed in the rear clamping device 61. Subsequently, a tensioning of the at least one printing plates 73 preferably takes place.

Firstly, the at least one front clamping device 21 is described. The at least one front clamping device 21 has at least one radially outer front clamping element 22, which is arranged immovably relative to a front main body 37 of the at least one front clamping device 21. This front main body 37 is fixed to the cylinder barrel 12, but preferably for correction purposes arranged at least minimally movable relative to the cylinder barrel 12. The at least one radially outer front clamping element 22 is preferably designed as a radially outer front clamping strip 22, which extends in an axial direction A, preferably over at least 75% and further preferably at least 90% of an axial length of the at least one channel 13. This guarantees a uniform clamping and/or tensioning of the printing plate 73. The at least one front clamping device 21 has at least one front pressure element 23, which is arranged radially further inside than the at least one radially outer front clamping element 22. The at least one front pressure element 23 is preferably designed as at least one front leaf spring 23, further preferably as at least one front spring assembly 23, which consists of a number of leaf springs 23, in particular lying flat on each other. The at least one clamping device 21 has at least one front adjusting element 24, by means of which a relative movement of the at least one front pressure element 23 is effectable relative to the at least one radially outer front clamping element 22 and thereby preferably at the same time relative to the cylinder barrel 12 of the plate cylinder 07. Preferably, the at least one front pressure element 23 is deformable per se by means of the at least one front adjusting element 24. Preferably, the at least one front pressure element 23 is shortenable per se by means of the at least one front adjusting element 24 with respect to an essentially radial direction. Preferably, the at least one front pressure element 23 extends over at least 75% and further preferably at least 90% of an axial length of the cylinder barrel 12.

Preferably, the at least one front clamping device 21 has at least two front pressure elements 23 and/or at least one radially inner front clamping element 26. The at least two front pressure element 23 are in turn preferably in each case designed as at least one leaf spring 23 and further preferably in each case as at least one spring assembly 23, which in each case consist of this a number of, in particular flat, leaf springs 23 lying on each other. The at least one radially inner front clamping element 26 is preferably designed as at least one radially inner front clamping strip 26, which extends in axial direction A, preferably over at least 75% and further preferably at least 90% of the axial length of the at least one channel 13. The at least one radially inner front clamping element 26 is preferably arranged movably in and/or contrary to a front clamping direction B, in particular towards the at least one radially outer front clamping element 22 and/or away from the at least one radially outer front clamping element 22. The front clamping direction B preferably points essentially in a radial direction. This means the front clamping direction B preferably has at least one component in a radial direction, which is greater than an optionally present component in the circumferential direction D. The front clamping direction B is preferably aligned orthogonally to the axial direction A. The at least one radially inner front clamping element 26 is preferably arranged immovably with respect to the axial direction A. The at least one front pressure element 23 and preferably the at least two front pressure element 23 is or are preferably in contact with the at least one radially inner front clamping element 26. Radial directions B; C, the axial direction A and the circumferential direction D refer to the cylinder barrel 12 and/or the axis of rotation 11 of the plate cylinder 07.

Preferably, the at least one radially inner front clamping element 26 is applicable and/or applied with a force towards the least one radially outer front clamping element 22 by means of the least one front pressure element 23 and further preferably by means of the at least two front pressure elements 23 in the front clamping direction B. The at least one front adjusting element 24 is preferably in direct contact with the at least one front pressure element 23. Preferably, in the circumferential direction D with respect to the plate cylinder 07 the at least one front adjusting element 24 is arranged between at least two radially inner front pressure elements 23. The at least one front adjusting element 24 is preferably designed as at least one front clamp release drive 24, further preferably as at least one front release body 24 applicable and/or applied with a pressure means and even further preferably as at least one front release hose 24, in particular front clamp release hose 24, which further preferably is filled and/or fillable with a fluid, for example with compressed air. If, in the following, there is mention of the front clamp release hose 24, a front release body 24 applicable and/or applied with a pressure means is thus also generally meant. Preferably, the compressed air is applicable and/or applied in an interior of the at least one front clamp release hose 24 with a pressure of up to 8 bar or more. The at least one front adjusting element 24, however, can also be designed as at least one hydraulic cylinder 24 and/or at least one pneumatic cylinder 24 and/or at least one electric motor 24. The simplicity of construction in the case of a clamp release hose 24, however, is advantageous.

Independently of the design of the at least one front adjusting element 24, an activation of the at least one front adjusting element 24 preferably brings about a shortening of the at least one front pressure element 23 and preferably of the at least two front pressure elements 23 in at least the front clamping direction B, further preferably at least by an extension of the at least one front adjusting element 24 in a direction orthogonal to the axial direction A and orthogonal to the front clamping direction B. This takes place, for example, in the form of a deflection of the at least one front pressure element 23 and preferably by means of deflections opposed to one another of the at least two front pressure elements 23. This brings about a movement of the at least one radially inner front clamping element 26 away from the at least one radially outer front clamping element 22 and thus an opening of a front clamp gap 27. The front clamp gap 27 is preferably formed by the at least one radially outer front clamping element 22 on the one hand and the at least one radially inner front clamping element 26 on the other hand. The at least two front pressure elements 23 are preferably flexibly connected to the front main body 37, further preferably such that they cannot be removed from this, but nevertheless are movable relative to it, in particular during their deformation. The at least two front pressure elements 23 are preferably flexibly connected to the at least one radially inner front clamping element 26, further preferably such that they cannot be removed from this, but nevertheless are movable relative to it, in particular during their deformation. In particular, the at least one radially inner front clamping element 26 is thus flexibly connected to the at least two front pressure elements 23 such that a shortening of the at least one front pressure element 23 inevitably causes a movement of the at least one radially inner front clamping element 26 contrary to the front clamping direction B.

In a preferred embodiment, the at least two front pressure elements 23 are essentially, in particular apart from a deflection or curvature, arranged parallel to one another and extend in the axial direction A and essentially also in a second extension direction orthogonal thereto, which preferably has at least one radial component. Preferably, the second extension direction, however, is slightly curved and each front pressure element 23 is slightly curved, since the at least two front pressure elements 23 are continuously under a more or less great pre-tension. This is preferably also the case independently of a state of the front clamp release hose 24 caused in particular in that a construction space is dimensioned such that sufficient space is never available to the at least two front pressure elements 23, in particular not even with completely emptied front clamp release hose 24, to be completely relaxed. The at least one front clamp release hose 24 is preferably arranged between at least two front pressure elements 23 and preferably likewise extends in the axial direction A. The at least two front pressure elements 23 are movable, in particular swivellable with one another, by means of at least two front connecting elements, and/or connected to the main body 37 of the at least one front clamping device 21 and/or to the at least one front clamping element 26. The at least one front clamp release hose 24, at least considered from a preferably axial direction A, is arranged between the at least two front connecting elements.

At least one of the at least two front pressure elements 23 and preferably both front pressure elements 23 are preferably movably, further preferably swivellably, fixed to the main body 37 of the at least one front clamping device 21, further preferably by means at least of one of the least two front connecting elements. The at least two front pressure elements are preferably movable, further preferably swivellably fixed to the at least one radially inner front clamping element 26, further preferably by means at least of the at least two connecting elements. In each case, on both sides of the at least one front clamp release hose 24 at least one clamping element is arranged preventing a removal of ends of the at least two front pressure elements 23 from one another above a maximum distance. This causes, in the case of an inflation of the at least one front clamp release hose 24, the at least two front pressure elements 23 not only to swing away from one another, but to curve outwards away from the at least one front clamp release hose 24, as their ends in each case cannot be removed from the ends of the adjacent pressure elements 23. Preferably, at least one clamping element is formed by the at least one radially inner front clamping element 26. Preferably, at least one clamping element is formed by the main body 37 of the at least one front clamping device 21.

As a result of the curvature formed, the at least two front pressure elements 23, however, shorten, for example with respect to a direction of a connecting element through the at least one front clamp release hose 24 to another connecting element, in particular with respect to the front clamping device B. In particular, a linear distance of two ends of one and the same front pressure element 23 is shortened. Thereby the at least one radial inner front clamping element 26 moves relative to the main body 37 of the at least one front clamping device 21 and in particular towards this and the clamping is released. For example, the at least two connecting elements are designed as connecting pins, which project through oblong holes of the at least two front pressure elements 23 and at their two ends are in each case connected to the main body 37 of the at least one front clamping device or to the at least one radially inner front clamping element 26.

In the case of a deactivation of the at least one front adjusting element 24, a restoring force of the at least one front pressure element 23 causes a movement of the at least one radially inner front clamping element 26 towards the at least one radially outer front clamping element 22 and thus a closing of the front clamping gap 27. Such a deactivation of the least one front adjusting element 24 consists, for example, in a lowering of the pressure in the interior of the clamp release hose 24, for example down to an ambient pressure, in particular atmospheric pressure. Preferably, the at least one front pressure element 23 and further preferably the at least two front pressure elements 23 are at any time under an at least minimal pre-tension, independently of whether the at least one front clamping device 21 is opened or closed and independently of whether a printing plate 73 is situated in the front clamping gap 27 or not. In particular, the front leaf springs 23, further preferably the at least one front spring assembly 23, are slightly curved and preloaded at any time.

The at least one radially inner front clamping element 26 is preferably always held in a defined position, for example pressed against a front alignment surface 29, preferably by means at least of a front pressure element 28, for example at least a front pressure spring 28, with respect to the circumferential direction D. The front alignment surface 29 is preferably arranged between the at least one front pressure element 28 and the first channel wall 18. The front alignment surface 29 is preferably a surface 29 of the at least one front main body 37. In particular, a force exerted by the at least one front pressure element 28 on the at least one radially inner front clamping element 22 acts in a direction towards the first channel wall 18. The force exerted by the at least one front pressure element 28 is preferably smaller than the force exerted by the at least one front pressure element in the clamped state. It is thereby guaranteed that although the at least one radially inner front clamping element 26 is held in a defined position in a peripheral direction D, it is not adversely affected with respect to movements in the front clamping direction B of the at least one front pressure element 28. The defined position in the circumferential direction D guarantees that the printing plate 73 is not inadvertently moved in the clamping process. A high precision of the position of the printing plate 73 in its clamped state and in particular during the clamping process is thereby maintained.

The at least one radially inner front clamping element 26 and/or the at least one radially outer front clamping element 22 preferably has or have at least one surface consisting of a hardened material, for example hardened steel, which preferably is provided additionally or alternatively with a structure of regular and/or irregular elevations and/or indentations, for example criss-crossing linear grooves. In the case of a clamped printing plate 73, this improves a force closure between the printing plate 73 on the one hand and the at least one radially inner front clamping element 26 and/or the at least one radially outer front clamping element 22 on the other hand.

The at least one front clamping device 21 preferably has at least two register stops 31; 32. The at least two register stops 31; 32 serve as reference points in the case of an insertion of a printing plate 73 into the at least one front clamping device 21. The at least two register stops 31; 32 interact with corresponding counterparts of the printing plate 73 preferably designed as recesses. Preferably, the at least two register stops 31; 32 in each case have a sensor device in order to be able to check mechanically a correct position of the printing plate 73 relative to the at least two register stops 31; 32. These sensor devices are designed as electrical contacts in a preferred embodiment, further preferably at least one electric circuit being closed by means of the printing plate 73 as soon as this is correctly in contact with both register stops 31, 32. Preferably, these sensor devices are connected to a machine control. Further preferably, a closing of the at least one front clamping device 21 depends on a positive signal on the part of these sensor devices.

The counterparts preferably designed as recesses of the printing plate 73 are preferably applied to the printing plate 73 after an imaging and/or exposure of the printing plate 73, namely with high precision with respect to a position of the counterparts designed as recesses relative to respective print images of the printing plate 73. The accuracy of a position of the counterparts designed as recesses relative to respective print images is preferably in the range of a few micrometers.

The at least one front clamping device 21 is preferably stored by means of at least one anchorage, for example at least a rail extending along a first bottom face 42 of the channel 13 preferably essentially in a direction parallel to the axis of rotation 11. The entire front clamping device 21 is thereby at least minimally movable, in particular pivotable, relative to the cylinder barrel 12. The at least one front clamping device 21 is preferably pivotable parallel to the first bottom face 42 of the channel 13 around a compensation axis orthogonal to the first bottom face 42. Preferably, the at least one front clamping device 21 is pressed against a lateral stop wall in the axial direction A seen by means of an axial pressure means and therefore held in a defined position with respect to this axial direction A. The lateral abutment wall preferably limits the at least one channel 13 in the axial direction A. In particular, the at least one front clamping device 21 is preferably arranged immovably with respect to the axial direction A relative to the cylinder barrel 12 of the plate cylinder 07. The at least one front clamping device 21 preferably has at least a first support point 33 or first contact point 33 and at least two second support points 34; 36 or second contact points 34; 36, at which, at least in a tensioned state of a printing plate 73 and preferably always, the at least one front clamping device 21 is in contact with the first channel wall 18. The first support point 33 is preferably an unalterable bulge of the at least one front clamping device 21 and/or the first channel wall 18. This means that preferably the first channel wall 18 has a bulge facing towards the front clamping device 21, with which the at least one front clamping device 21 is in contact and/or in that further preferably the at least one front clamping device 21 has a bulge facing towards the first channel wall 18, which is in contact with the first channel wall 18. As a result of the bulge, an essentially linear or punctiform contact results between front clamping device 21 and first channel wall 18 and in particular preferably no surface contact between front clamping device 21 and first channel wall 18. This guarantees a particularly precise and reproducible position of the at least one front clamping device 21 related to the cylinder barrel 12 of the plate cylinder 07.

The at least two second support points 34; 36 are preferably adjustable and further preferably fixed by at least two front adjusting elements 39; 41 or contact bodies 39; 41 designed as front adjusting screws 39; 41. Preferably, the at least two front contact bodies 39; 41 are components of the at least one front clamping device 21. The at least two front contact bodies 39; 41 are preferably arranged adjustably in their position relative to the at least one main body 37 of the at least one front clamping device 21. Preferably, the at least two front contact bodies 39; 41 are connected by threads with the at least one front clamping device 21 and arranged movably relative to the at least one front clamping device 21 by rotation around a thread axis of this thread. In a preferred embodiment, the at least two front contact bodies 39; 41 are arranged adjustably in their position relative to the at least one front clamping device 21 by means of at least one and preferably in each case at least one drive 43; 44 designed as a front pre-tensioning drive 43; 44. The at least one pre-tensioning drive 43; 44 is preferably designed as at least one electric motor 43; 44, for example stepper motor 43; 44, which further preferably has a transmission, for example, a transmission with particularly high gearing. The at least one pre-tensioning drive 43; 44 can also be designed as a pneumatic and/or hydraulic drive 43; 44 or as a piezoelectric drive 43; 44. The at least one pre-tensioning drive 43; 44 and/or the at least two front contact bodies 39; 41 further preferably has or have at least one pre-tensioning sensor, which records a position of the at least one pre-tensioning drive 43; 44, for example an angular position of the at least one electric motor 43; 44 and/or of the one position of the least two front contact bodies 39; 41. Preferably, the at least one pre-tensioning sensor is connected to the machine control and/or the at least one pre-tensioning drive 43; 44 is connected to the machine control. Alternatively or additionally, a position of the at least two front contact bodies 39; 41 is adjustable manually.

Alternatively or additionally, the at least two front contact bodies 39; 41 are stored on the cylinder barrel 12 of the plate cylinder 07. The at least two front contact bodies 39; 41 are then preferably arranged adjustably in their position relative to the cylinder barrel 12. Preferably, the at least two front contact bodies 39; 41 are connected by thread to the at least one cylinder barrel 12 and are arranged movably relative to the cylinder barrel 12 by means of rotation around a thread axis of this thread. The at least two front contact bodies 39; 41 are then preferably connected at least temporarily and further preferably permanently with the at least one front clamping device 21, in particular at respective front contact sites. Preferably, the at least two front contact bodies 39; 41 are in turn arranged adjustably in their position relative to the cylinder barrel 12 by means of at least one and preferably in each case at least one drive 43; 44 designed as a front pre-tensioning drive 43; 44. The at least one pre-tensioning drive 43; 44 is preferably designed, as described, as at least one electric motor 43; 44, for example step motor 43; 44, which further preferably has a transmission. The at least one pre-tensioning drive 43; 44 can, as described, also be designed as a pneumatic and/or hydraulic drive 43; 44. The at least one pre-tensioning drive 43; 44 and/or the at least two front contact bodies 39; 41 in turn further preferably has or have at least one pre-tensioning sensor, which records a position of the at least one pre-tensioning drive 43; 44, for example an angular position of the at least one electric motor 43; 44 and/or which records a position of the at least two front contact bodies 39; 41. Preferably, the at least one pre-tensioning sensor is in turn connected to the machine control and/or the at least one pre-tensioning drive 43; 44 is connected to the machine control. Alternatively or additionally, in turn the position of the at least two front contact bodies 39; 41 is manually adjustable.

The first and second support sites 39; 41 serve in particular for the support of the at least one clamping device 21; 61, in particular the at least one front clamping device 21 in a common direction, which is preferably the circumferential direction D. The first and second support sites 33; 34; 36 are preferably divided in an axial direction A, along the at least one front clamping device 21, further preferably along a straight line. This means, in particular that the first and second support sites 34; 34; 36 seen in the axial direction A hot preferably arranged on in each case separate positions different from one another. Preferably, the first support point 33 is arranged between the at least two second support sites 34; 36 with respect to the axial direction A. Preferably, the first channel wall 18 and the at least one front clamping device 21, in particular in the form of the bulge and the at least two front contact bodies 39; 41, are in contact with one another at any time on all support sites 33; 34; 36.

Further preferably, the tensioning device 101 has at least one support body 107, designed, for example, as a spring 107, which is supported both on the at least one front clamping device 21 as well as on the at least one rear clamping device 61 and by means of which the at least one front clamping device 21 is pressed against the first channel wall 18 and by means of which the at least one rear clamping device 61 is pressed against the second channel wall 19. Preferably, four such support bodies 107 designed as springs 107 are arranged, which in total exert a force of 600 N to 1000 N (six hundred newtons to one thousand newtons). By adjustment of the least two second support points 33; 34, a flexure of the at least one first front clamping device 21 is optionally influenced.

Depending on the position of the front contact body 39; 41 relative to the front clamping device 21 and/or the cylinder barrel 12 and thus the support sites 33; 34; 36 to one another, the at least one radially outer front clamping element 22 and the at least one radially inner front clamping element 26 are either uniformly acted on by forces and designed to be designed to be linear and therefore curved convexly concavely if at least one force presses the front clamping device 21 against the first channel wall 18. This at least one force is preferably, as described above, at least a force exerted by the at least one support body 107, for example designed as a spring 107, and/or at least a tractive force exerted by tensioning of the printing plate 73. By appropriate selective adjustment of the position of the front contact body 39; 41 relative to the front clamping device 21 or the cylinder barrel 12 and thus the support points 33; 34; to one another, a selective tensioning of the printing plate 73 can thus be achieved, for example for the correction of a convex or concave distortion of a transmitted print image. Additionally or alternatively, for example, by in itself linear, but for the at least one front clamping device 21 overall oblique position of the support sites 33; 34; 36, an oblique position of the printing plate 73 on the plate cylinder 07 can be achieved, for example for the correction of an oblique position of the transmitted print image to the printing plate 73.

The at least one rear clamping device 61 is movable along a second bottom surface 108 of the channel 13 in and/or against the axial direction A and swivellable around at least one differential axle orthogonal to the second bottom surface 108. The arrangement with respect to the axial direction A preferably takes place by means of drive 141 designed as an axial drive 141. More details are described further below. Before a first tensioning of the printing plate 73, the front contact bodies 39; 41 are preferably adjusted such that equal forces prevail between the first channel wall 18 and the at least one front clamping device 21 at all support points 33; 34; 36.

The at least one rear clamping device 61 is described below. The at least one rear clamping device 61 has at least one radially outer rear clamping element 62, which is arranged immovably relative to a rear main body 71 of the at least one rear clamping device 61. This rear main body 71 is fixed to the cylinder barrel 12, but preferably arranged minimally movable relative to the cylinder barrel 12 for correction purposes. The at least one radially outer rear clamping element 62 is preferably designed as a radially outer rear clamping strip 62, which extends in the axial direction A, preferably over at least 75% and further preferably at least 90% of an axial length of the at least one channel 13. The at least one rear clamping device 61 has at least one rear pressure element 63, which radially is arranged further inside than the at least one radially outer rear clamping element 62. The at least one rear pressure element 63 is preferably designed as at least one rear leaf spring 63, further preferably as at least one rear spring assembly 63, which consists of a number of leaf springs 63, in particular lying flat on each other. The at least one rear clamping device 61 has at least one rear adjusting element 64, by means of which the relative movement of the at least one rear pressure element 63 is effectible relative to the at least one radially outer rear clamping element 62 and thereby preferably at the same time relative to the cylinder barrel 12 of the plate cylinder 07. Preferably, the at least one rear pressure element 63 is deformable per se by means of the at least one rear adjusting element 64. Preferably, the at least one rear pressure element 63 is shortenable with respect to an essentially radial direction by means of the at least one rear adjusting element 64. Preferably, the at least one rear pressure element 63 extends over at least 75% and further preferably at least 90% of an axial length of the cylinder barrel 12.

Preferably, the at least one rear clamping device 61 has at least two rear pressure element 63 and/or at least one radially inner rear clamping element 66. The at least two rear pressure elements 63 are in turn preferably in each case designed as at least one leaf spring 63 and further preferably in each case as at least one spring assembly 63, which in each case consists of a number of leaf springs 63, in each case lying flat on each other. The at least one radially inner rear clamping element 66 is preferably designed as at least one radially inner rear clamping strip 66 which extends in the axial direction A, preferably over at least 75% and further preferably at least 90% of the axial length of the at least one channel 13. The at least one radially inner rear clamping element 66 is preferably arranged movably in and/or against a rear clamping element C, in particular towards the at least one radially outer rear clamping element 62 and/or away from the at least one radially outer rear clamping element 62. The rear clamping direction C preferably points essentially in a radial direction. This means the rear clamping direction C preferably has at least one component in a radial direction that is greater than an optionally present components in a circumferential direction D. The rear clamping device C is preferably aligned orthogonally to the axial direction A. The at least one radially inner rear clamping element 66 is preferably arranged movably with respect to the axial direction A. The at least one rear pressure element 63 and preferably the at least two rear pressure elements 63 are or are preferably in contact with the at least one radially inner rear clamping element 66.

Preferably, the at least one radially inner rear clamping element 66 can be acted on and/or is acted on with a force by means of the at least one rear pressure element 63 and further preferably by means of the at least two rear pressure elements 63 in the rear clamping direction C towards the at least one radially outer rear clamping element 62. The at least one rear adjusting element 64 is preferably in direct contact with the at least one rear pressure element 63. Preferably, in the circumferential direction D with respect to the plate cylinder the at least one rear adjusting element 64 is arranged between the at least two radially inner rear pressure elements 63. The at least one rear adjusting element 64 is preferably designed as at least one rear clamp release drive 64, further preferably as a rear release body 64 which can be acted on and/or is acted on by a pressure means and even further preferably as at least one rear release hose 64, in particular rear clamp release hose 64, which further preferably is filled and/or fillable with a fluid, for example with compressed air. If the discussion below concerns the rear clamping hose 64, a rear release body 64 which can be acted on and/or is acted on by a pressure means is thus also generally meant. Preferably, the compressed air can be acted on and/or is acted on in an interior of the at least one rear clamp release hose 64 with a pressure of up to 8 bar or more. The at least one rear adjusting element 64 can, however, also be designed as at least one hydraulic cylinder 64 and/or at least one pneumatic cylinder 64 and/or at least one electric motor 64. The simplicity of construction in the case of a clamp release hose 64, however, is advantageous.

Independently of the design of the least one rear adjusting element 64, an activation of the at least one rear adjusting element 64 preferably causes a shortening of the at least one rear pressure element 63 and preferably of the at least two rear pressure elements 63 in at least the rear clamping direction C, further preferably at least by an extension of the at least one rear adjusting element 64 in a direction orthogonal to the axial direction A and orthogonal to the rear clamping device C. This takes place, for example, in the form of a deflection of the at least one rear pressure element 63 and preferably by means of deflections of the at least two rear pressure elements 63 opposed to one another. This causes a movement of the at least one radially inner rear clamping element 66 away from the at least one radially outer rear clamping element 62 and thus an opening of a rear clamping gap 67. The rear clamping gap 67 is preferably formed by the at least one radially outer rear clamping element 62 on the one hand and the at least one radially inner rear clamping element 66 on the other hand. The at least two rear pressure elements 63 are preferably flexibly connected to the rear main body 71, further preferably such that they cannot be removed from this, but nevertheless are movable relative to it, in particular during their deformation. The at least two rear pressure elements 63 are preferably flexibly connected to the at least one radially inner rear clamping element 66, further preferably such that they cannot be removed from this, but nevertheless are movable relative to it, in particular during their deformation. In particular, preferably the at least one radially inner rear clamping element 66 is thus flexibly connected to the at least two rear pressure element 63 such that a shortening of the at least one rear pressure element 63 the at least one radially inner rear clamping element 66 inevitably causes a movement of the at least one radially inner rear clamping element 66 against the rear clamping direction C.

In a preferred embodiment, the at least two rear pressure elements 63 are essentially, in particular apart from a deflection or curvature, arranged parallel to one another and extend in the axial direction A and essentially also in a second extension direction orthogonal thereto, which preferably has at least one radial component. Preferably, the second extension direction, however, is slightly bent and each rear pressure element 63 is slightly curved, as the at least two rear pressure elements 63 are continuously under a more or less great pre-tension. This is preferably also the case independently of a state of the rear clamp release hose 64 and in particular caused in that an installation space is dimensioned such that sufficient space is never available to the at least two rear pressure elements 63, in particular even not with a completely emptied rear clamp release hose 64, to be completely relaxed. The at least one rear clamp release hose 64 is arranged between the at least two rear pressure elements 63 and preferably likewise extends in the axial direction A. The at least two rear pressure elements 63 are movable by means of at least two rear connecting elements, in particular swivellably connected with one another and/or with the main body 71 of the at least one rear clamping device 61 and/or to the at least one rear clamping element 62. The at least one rear clamp release hose 64, at least considered from a preferably axial direction A, is arranged between the at least two rear connecting elements.

At least one of the at least two rear pressure elements 63 and preferably both rear pressure elements 63 are preferably fixed movably, further preferably swivellably on the main body 71 of the at least one rear clamping device 61, further preferably by means at least of one of the at least two rear connecting elements. The at least two rear pressure elements 63 are preferably fixed movably, further preferably swivellably, to the at least one radially inner rear clamping element 66, further preferably by means at least of one of the at least two connecting elements. In each case, on both sides of the at least one rear clamp release hose 64 is arranged at least one clamping element preventing a removal of ends of the at least two rear pressure elements 63 from each other beyond a maximum distance. This causes that in the case of an inflation of the at least one rear clamp release hose 64 the at least two rear pressure elements 63 not only swing away from each other, but curve outwards away from the at least one rear clamp release hose 64, as their ends can in each case not be removed from the ends of the adjacent pressure elements 63. Preferably, at least one clamping element is formed by the at least one radially inner rear clamp element 66. Preferably, at least one clamping element is formed by the main body 71 of the at least one rear clamping device 61.

As a result of the curvature formed, the at least two rear pressure elements 63, however, shorten with respect to a direction from one connecting element through the at least one rear clamp release hose 64 to another connecting element, in particular with respect to the rear clamping direction C. In particular, a linear distance of two ends of one and the same rear pressure element 63 is shortened. The at least one radially inner rear clamping element 66 thereby moves relative to the main body 71 of the at least one rear clamping device 61 and in particular towards this and the clamping is released. For example, the at least two connecting elements are designed as connecting pins, which project through longitudinal holes of the at least two rear pressure elements 63 and are connected at their two ends in each case with the main body 71 of the at least one rear clamping device 61 or with the at least one radially inner rear clamping element 66.

In the case of a deactivation of the at least one rear adjusting element 64, a restoring force of the least one rear pressure element 63 causes a movement of the at least one radially inner rear clamping element 66 towards the at least one radially outer rear clamping element 62 and thus to a closing of the rear clamping gap 67. Such a deactivation of the at least one rear adjusting element 64 consists, for example, in a lowering of the pressure in the interior of the rear clamp release hose 64, for example down to an ambient pressure, in particular atmospheric pressure. Preferably, the at least one rear pressure element 63 and further preferably the at least two rear pressure elements 63 are at any time under an at least minimal pre-tension, independently of whether the at least one rear clamping device 61 is opened or closed and independently of whether a printing plate 73 is situated in the rear clamping gap 67 or not. In particular, the rear leaf springs 63, further preferably the at least one rear spring assembly 63, is preferably slightly curved and pre-tensioned at any time.

The at least one radially inner rear clamping element 66 is preferably always preferably held in a defined position by means of at least one rear pressure element 68, for example of at least one rear pressure spring 68 with respect to the circumferential direction D, for example against a rear alignment surface 69. The rear alignment surface 69 is preferably arranged between the at least one rear pressure element 68 and the second channel wall 19. The rear alignment surface 69 is preferably a surface 69 of the at least one rear main body 71. In particular, a force exerted by the at least one rear pressure element 68 on the at least one radially inner rear clamping element 66 acts in a direction towards the second channel wall 19. The force exerted by the at least one rear pressure element 68 is preferably smaller than the force exerted in the clamped state by the at least one rear pressure element 63. It is guaranteed thereby that although the at least one radially inner rear clamp element 66 is held in a defined position in the circumferential direction D, it is not adversely affected with respect to movements in the rear clamping direction C by the at least one rear pressure element 68. The position defined in the circumferential direction D guarantees that the printing plate 73 is not unintentionally moved in the clamping process. A high precision of the position of the printing plate 73 in its clamped state and in particular during the clamping process is thereby maintained.

The at least one radially inner rear clamping element 66 and/or the at least one radially outer rear clamping element 62 preferably has or have at least one surface made from a hardened material, for example hardened steel, which preferably is additionally or alternatively provided with a structure of regular and/or irregular elevations and/or depressions, for example crossing linear grooves. In the case of a clamped printing plate 73, this improves a force closure between the printing plate 73 on the one hand and the at least one radially inner rear clamping element 66 and/or the at least one radially outer rear clamping element 62 on the other hand.

The at least one rear clamping device 61 is preferably part of at least one slide 102 of the at least one tensioning device 101. The at least one slide 102 and thus the at least one rear clamping device 61 is preferably arranged at least partly along a tensioning path and/or movably in a tensioning direction E. Preferably, the tensioning path extends orthogonally to the axis of rotation 11 of the plate cylinder 07. Preferably, the tensioning path extends within a plane whose surface normal is oriented parallel to the axis of rotation 11 of the plate cylinder 07. Preferably, the tensioning path extends essentially in and/or against the circumferential direction D or further preferably in and/or against a tensioning direction E preferably tangential to the circumferential direction D. Preferably, the at least one slide 102 is arranged to be movable along the tensioning path within the at least one channel 13 towards the at least one front clamping device 21. Preferably, at least one guide is arranged that guides the at least one rear clamping device 61 along its tensioning path. A maximum tensioning path, that is a maximum adjustment path of the least one slide 102 in and/or against the tensioning direction E is preferably between 10 mm and 35 mm, further preferably at least 15 mm and even further preferably between 15 mm and 20 mm. A length of the tensioning path covered for tensioning is preferably between 0.1 mm and 2 mm long, further preferably between 0.5 mm and 1.2 mm. The tensioning direction E is preferably aligned parallel to the second bottom surface 108 of the channel 13 in the area of the rear clamping device 61. The maximum adjustment path of the at least one slide 102 is preferably at least as great relative to the cylinder barrel 12 of the plate cylinder 07 in and/or against the tensioning direction E as an extension of an intended or actual contact surface of a printing plate 73 clamped in the at least one rear clamping device 61 measured in the tensioning direction E with the at least one radially outer clamping element 62 of the at least one rear clamping device 61, further preferably at least 2 mm and still further preferably at least 5 mm greater. If the maximum adjustment path is greater than the intended or actual extent of the contact surface, the printing plate 73 can in particular be inserted particularly simply into the at least one rear clamping device 61, as it corresponds to the extent of the contact surface. By this means, reserves with respect to intermittent location errors are possible. Moreover, the printing plate 73 thereby does not have to be clamped on its outermost edge.

The at least one rear clamping device 61 is preferably mounted by means of at least one anchorage, for example of at least one rail extending, for example, along this second bottom surface 108 of the channel 13 preferably essentially in a direction orthogonal to the axis of rotation 11 of the plate cylinder 07. The entire rear clamping device 61 is thereby movable preferably at least linearly relative to the cylinder barrel 12. This serves on the one hand for a simplified insertion of the rear end 76 of the printing plate 73 into the at least one rear clamping device 61 and on the other hand for a tensioning and/or an alignment of the printing plate 73 clamped in the at least one front clamping device 21 as well as the at least one rear clamping device 61.

At least one drive 104 designed as a tensioning drive 104 is arranged in connection with the at least one rear clamping device 61. By means of the at least one tensioning drive 104, at least one preferably adjustable force is exertable and/or exerted on the at least one slide 102, which points in a direction from the second channel wall 19 towards the at least one slide 102. Preferably, the at least one tensioning drive 104 is arranged between a first supporting surface 103 of the at least one slide 102 and a second channel wall 19. The at least one tensioning drive 104 is preferably designed as at least one control body 104 that can be acted on and/or is acted on by a pressure means. Such a pressure means is, for example, a hydraulic medium or a pneumatic medium, in particular air. The at least one tensioning drive 104 is further preferably designed as at least one tensioning hose 104. The at least one control body 104 and preferably the at least one tensioning hose 104 can preferably be acted on by pressures of up to 10 bar and more. The at least one tensioning drive 104 can, however, also be designed as at least one hydraulic cylinder 104 and/or at least one pneumatic cylinder 104 and/or at least one electric motor 104. The at least one tensioning drive 104 is preferably supported against a component arranged rigidly relative to the plate cylinder 07 or a constituent of the plate cylinder 07 itself, for example the second channel wall 19. If, in the preceding or in the following, there is mention of the at least one tensioning hose 104, then the least one control body 104 that can be acted on and/or that is acted on is thus likewise generally meant.

Preferably, at least one resetting element 106 is arranged, for example at least one spring 106; 107 designed as a resetting spring 106. The at least one resetting element 106 causes a resetting force on the at least one slide 102, which is oriented against the tensioning direction E. The at least one resetting element 106 is supported in one embodiment against a constituent arranged rigidly relative to the plate cylinder 07 or a component of the plate cylinder 07 itself. Preferably, however, the at least one resetting element 106 is identical to the supporting body 107 designed as a spring 107, which is supported both on the at least one front clamping device 21 as well as on the at least one rear clamping device 61 and by means of which the at least one front clamping device 21 is pressed against the first channel wall 18. As long as the at least one tensioning drive 104 is deactivated, the at least one slide 102 is arranged in a first position, also called peripheral location, of the at least one slide 102 nearer to the second channel wall 19, in particular because of the resetting force exerted by the at least one resetting element 106 on the at least one slide 102. As long as the at least one tensioning drive 104 is deactivated and at least one corresponding rear adjusting element 131 and/or rear spacer 131 is adjusted correspondingly, the at least one slide 102 is arranged in a position of the at least one slide 102 further removed from the second channel wall 19 by a reserve track compared to the peripheral location of the second channel, called a spaced peripheral location, in particular because of the restoring force exerted on the at least one slide 102 by the at least one restoring element 106 on the one hand and the action of the at least one rear adjusting element 131 on the other hand. The reserve track is preferably between 4 mm and 6 mm long.

The peripheral location of the at least one slide 102 is a position or location of the at least one slide 102, in which the at least one slide 102 touches the second channel wall 19. The spaced peripheral location of the at least one slide 102 is a position or location of the least one slide 102 in which the at least one slide 102 has a distance from the second channel wall 19 which is preferably more than 0 mm and less than 7 mm and further preferably between 4 mm and 6 mm. A central or inner location of the at least one slide 102 is a position or location of the at least one slide 102 in which the at least one slide 102 has a distance from the second channel wall 19 which is preferably between 9 mm and 31 mm and further preferably between 14 mm and 26 mm.

The at least one tensioning device 101 preferably has at least one fixing device 109, by means of which the at least one rear clamping device 61 is fixable in its location and in particular with maintenance of a tensioning of the printing plate 73, in particular at least with respect to movements of the at least one slide 102 towards the second channel wall 19. Below, two different embodiments of the fixing device 109 are described.

A first embodiment of the fixing device 109 is described below. In the first embodiment, the fixing device 109 has at least one preferably adjustable rear spacer 131, which is preferably designed as at least one rear adjustment screw 131. The at least one rear spacer 131 is mounted by means of a bearing, which preferably has at least one thread or is designed as a thread, preferably in the at least one slide 102 and in the at least one rear clamping device 61, in particular in the rear main body 71. However, it is also possible to mount the at least one rear spacer 131 by means of a bearing in a constituent of the cylinder barrel 12 or a component arranged rigidly relative to the cylinder barrel 12. The at least one rear spacer 131 is movable relative to the at least one slide 102, in particular adjustable in its relative position to the at least one slide 102, for example by a screw movement in the at least one thread. The at least one rear spacer 131 is preferably movable together with the at least one slide 102. The at least one rear spacer 131 can in particular be arranged in at least one retracted position and in at least one and preferably a number of extended positions relative to the at least one slide 102. In the at least one extended position of the at least one rear spacer 131, the at least one rear spacer 131 preferably projects further in a direction pointing towards the second channel wall 19 over a rear edge surface 132 of the at least one slide 102 facing towards the second channel wall 19 than in the retracted position.

If the at least one rear spacer 131 is mounted in a component of the cylinder barrel 12 or a constituent arranged rigidly relative to the cylinder barrel 12, the at least one rear spacer 131 can in particular be arranged in at least one retracted position and in at least one and preferably a number of extended positions relative to the cylinder barrel 12. In the at least one extended position of the at least one rear spacer 131, the at least one rear spacer 131 then preferably projects further in a direction pointing towards the at least one slide 102 over at least one second channel wall 19 facing towards a slide 102, than in the retracted position.

The at least one resetting element 106 causes, as already described, a resetting force on the at least one slide 102, which is oriented contrary to the tensioning direction E. If no opposed forces act, the at least one slide 102 is thus pressed against the second channel wall 19. Depending on the position of the at least one rear spacer 131, the at least one slide 102, however, is prevented from coming maximally close to the second channel wall 19 and in particular into its peripheral location. If the at least one rear spacer 131 is situated in the retracted position and the at least one rear spacer 131 and/or the at least one slide 102 itself is in contact with the second channel wall 19, the at least one slide 102 is arranged further removed from the at least one front clamping device 21 than if the at least one rear spacer 131 is situated in an extended position and in contact with the second channel wall 19. The smallest differences between the at least one front clamp gap 27 and the at least one rear clamp gap 67 also behave correspondingly. A printing plate 73 clamped in the at least one front clamping device 21 and in the at least one rear clamping device 61 and placed around the cylinder barrel 12 is thus tensioned more or less with a deactivated tensioning drive 104 depending on the position of the at least one rear spacer 131. The fixing device 109 in the first embodiment thus counteracts the tensioning force of the printing plate 73 and/or the resetting force of the least one resetting element 106 and thus fixes the at least one slide 102 and thus the at least one rear clamping device 61.

The fixing device 109 in the first embodiment is preferably operated such that a printing plate 73 clamped both in the at least one front clamping device 21 as well as in the at least one rear clamping device 61 is firstly tensioned, by the at least one tensioning drive 104 being activated, for example by the control body 104 that can be acted on and/or is acted on by a pressure means, in particular the tensioning hose 104, being acted on with a pressure and thus expanding such that it moves the at least one slide 102. Here, the at least one rear spacer 131 is firstly arranged in the retracted position relative to the at least one slide 102. The at least one slide 102 and thus the entire at least one rear clamping device 61 move towards the at least one front clamping device 21. The printing plate 73 wound around the plate cylinder 07 is thereby tensioned. The at least one slide 102 is preferably moved so far that a desired tensioning of the printing plate is achieved or further preferably at least slightly exceeded. Subsequently, the at least one rear spacer 131 is moved from the retracted position to a defined extended position. Subsequently, the tensioning drive 104 is deactivated, for example by reducing the pressure in the tensioning hose 104, for example to ambient pressure, in particular atmospheric pressure. Optionally, the at least one slide 102 moves again towards the second channel wall 19, until the at least one rear spacer 131 touches the second channel wall 19 at in each case at least one and preferably exactly one distance contact point 133 and thereby the at least one slide 102 is stopped. Alternatively, the at least one slide 102 touches the at least one spacer 131 mounted in the cylinder barrel 12 to stop the at least one slide 102.

The rear clamping device 61 is held in this state, as already described, in its position in that the resetting force of the at least one resetting element 106 and/or the tensioning of the printing plate 73 presses the at least one slide 102 and thus the at least one rear clamping device 61 against the second channel wall 19, though at a distance determined by the position of the at least one rear spacer 131. For this, no drive must remain permanently activated and in particular no hose must remain permanently acted on by pressure. The at least one tensioning drive 104, the at least one rear spacer 131 and the at least one rear adjusting element 64 are preferably supported against an identical component of the slide 102 and the at least one rear clamping device 62, further preferably against the rear main body 71. Actuations of the at least one tensioning drive 104, of the at least one rear spacer 131 and of the at least one rear adjusting element 64 are preferably feasible independently of one another.

The exact position of the at least one rear spacer 131 defines the minimal distance of the at least one slide 102 from the second channel wall 19. By means of the exact position of the at least one rear spacer 131, a maximal tensioning force acting on the tensioned printing plate 73 thus is set. Preferably a number, further preferably at least four, of the described rear spacers 131 are arranged spaced from one another in the axial direction A. In a preferred embodiment, the at least one rear spacer 131 is adjustable in its position by means at of least one drive 134 designed as a spacing drive 134. The at least one spacing drive 134 is preferably designed as at least one electric motor 134. The at least one spacing drive 134 can also be designed as a pneumatic and/or hydraulic drive 134. The at least one spacing drive 134 and/or the at least one rear spacer 131 further preferably have at least one spacing sensor, which records a position of the at least one spacing drive 134, for example an angular position of the at least one electric motor and/or records a position of the least one rear spacer 131.

Preferably, the at least one spacing sensor is connected to the machine control and/or the at least one spacing drive 134 is connected to the machine control. Alternatively or additionally, a position of the at least one spacer 131 is manually adjustable.

A second embodiment of the fixing device 109 has at least one stop body 111 and at least one rear stop adjusting element 112 preferably selectively alterable in its position relative to the cylinder barrel 12 and/or the at least one slide 102, for example at least one rear stop screw 112. The at least one rear stop adjusting element 112 preferably has at least one stop transmission 113, for example to make possible a finer adjustment of the position of the at least one rear stop screw 112. The at least one rear stop screw 112 is preferably supported in at least one bearing 122, which is designed, for example, as a bearing block 122. Preferably, the at least one rear stop screw 112 is connected to the at least one bearing 122 by means of at least one thread. The at least one bearing 122 is preferably arranged stationary relative to the cylinder barrel 12, for example designed as part of the cylinder barrel 12. The at least one stop body 111 is preferably arranged on the at least one slide 102 and movable together with it. The at least one rear stop screw 112 is preferably arranged limiting the maximal adjustment path of the at least one slide 102. The maximal adjustment path of the at least one slide 102 is then preferably limited at one end by the at least one rear stop element 112 and at another end by the second channel wall 19. By alteration of the position of the at least one rear stop screw 112 with respect to the tensioning direction E, the maximal adjustment path of the at least one slide 102 is adjustable, in particular extendable and/or shortenable.

Preferably, at least one slide clamp element 114 is arranged on the at least one slide 102. The at least one slide clamp element 114 is preferably arranged movably by means of at least one drive 116 designed as a slide release drive 116 relative to the at least one slide 102. By means of the at least one slide release drive 116, the at least one slide clamping element 114 can be brought into and/or out of contact with a first slide clamp surface 117 of the at least one channel 13. In a fixed position of the at least one slide 102, the at least one slide release drive 116 is supported on the one hand on the at least one slide 102 and thus on the at least one rear clamping device 61 and the at least one slide release drive 116 on the other hand is supported by means of the at least one slide clamping element 114 on the first slide clamping surface 117 of the channel 13. The at least one slide 102 and thus the at least one rear clamping device 61 are preferably supported in turn on a second slide clamp surface 118 of the channel 13 lying opposite to the first slide clamp surface 117 of the channel 13. The at least one slide 102 is thereby fixed in the channel 13. Preferably, the at least one slide release drive 116 is constructed analogously to the principle of the at least one front clamping device 21 and/or the at least one rear clamping device 61.

For this, the at least one slide release drive 116 preferably has at least one and further preferably at least two slide clinching elements 119. The at least one slide clinching element 119 is preferably designed as at least one slide leaf spring 119, further preferably as at least one front slide spring assembly 119, which consists of a number of leaf springs 119, in particular lying flat on one another. The at least one slide release drive 116 preferably has at least one slide releaser 121. The at least one slide releaser 121 is preferably designed as at least one slide release hose 121, which is filled and/or fillable with a fluid, for example with compressed air. Preferably, the compressed air in an interior of the at least one slide release hose 121 can be charged and/or is charged with a pressure of up to 10 bar or more. The at least one slide releaser 121 can also be designed as at least one hydraulic cylinder 121 and/or at least one pneumatic cylinder 121 and/or at least one electric motor 121.

Independently of the design of the at least one slide releaser 121, an activation of the at least one slide releaser 121 preferably causes a shortening of the at least one slide clinching element 119 and preferably of the at least two slide clinching elements 119 in at least one slide clamping direction F, which is further oriented preferably parallel to the rear clamping direction C. This takes place, for example, by means of a deflection of the at least one slide clinching element 119 and preferably by means of deflections opposed to one another of the at least two slide clinching elements 119. This causes a movement of the at least one slide clamping element 114 away from the first slide clamping surface 117 and thus a loosening of the at least one slide 102. The at least one and preferably the at least two slide clinching elements 119 are preferably flexibly connected to the at least one slide 102, further preferably such that they cannot be removed from it, but nevertheless are movable relative to it, in particular during their deformation. The at least one and preferably the at least two slide clinching elements 119 are preferably flexibly connected to the at least one slide clamping element 114, further preferably such that they cannot be removed from it, but nevertheless are movable relative to it, in particular during their deformation. In particular, preferably the at least one slide clamping element 114 is thus connected to the at least one slide clinching element 119 flexibly such that a shortening of the at least one slide clinching element 119 the at least one slide clamping element 114 inevitably causes a movement of the at least one slide clamping element 114 against the slide clamping device F and thus a loosening of the at least one slide 102 and thus of the at least one fixing device 109.

The at least two slide clinching elements 119 are preferably, in particular apart from a deflection or curvature, parallel to one another and extend in the axial direction A and essentially also in a further, for example third, extension direction orthogonal to this, which preferably has at least one radial component. Preferably, the further, for example third, extension direction, however, is slightly curved and each slide clinching element 119 is slightly curved, as the at least two slide clinching elements 119 are continuously under a more or less great pre-tension. This is preferably also the case independently of a state of the slide release hose 121 and is in particular caused in that the installation space is dimensioned such that there is never enough space available to the at least two slide clinching elements 119, in particular not even with a completely emptied slide release hose 121, to be completely relaxed. The at least one slide release hose 121 is arranged between the at least two slide clinching elements 119 and preferably likewise extends in the axial direction A. The at least two slide clinching elements 119 are movably connected by means of at least two connecting elements, in particular swivellably connected to one another and/or to the main body 71 of the at least one rear clamping device 61 and/or to the at least one slide clamping element 114. The at least one slide release hose 121, at least considered from a preferably axial direction A, is arranged between the at least two connecting elements.

At least one of the at least two slide clinching elements 119 and preferably both slide clinching elements 119 are preferably fixed movably, further preferably swivellably, on the main body 71 of the at least one rear clamping device 61, further preferably by means of at least one of the at least two connecting elements. The at least two slide clinching elements 119 are preferably fixed movably, further preferably pivotably, on the slide clamping element 114, further preferably by means at least of one of the at least two connecting elements. In each case, on both sides of the slide release hose 121 is arranged at least one clamp element preventing a distance of ends of the at least two slide clinching elements 119 from one another above a maximal distance. This causes in the case of inflation of the slide release hose 121 that the at least two slide clinching elements 119 not only swing away from one another, but bend away from the hose outwards, as their ends cannot move away from the ends of the adjacent slide clinching elements 119. Preferably, at least one clamping element is formed by the at least one slide clamping element 114. Preferably, at least one clamping element is formed by the main body 71 of the at least one rear clamping device 61.

As a result of the curvature formed, the at least two slide clinching elements 119 shorten, however, for example with respect to a direction from a connecting element through the slide release hose 121 to another connecting element. In particular, a linear distance of two ends of one and the same slide clinching element 119 is shortened. Thereby, the at least one slide clamping element 114 moves relative to the main body 71 of the at least one rear clamping device 61 and in particular towards it and the clamping is released. For example, the at least two connecting elements are designed as connecting pins, which project through longitudinal holes of the at least two slide clinching elements 119 and at their two ends are in each case connected to the main body 71 of the at least one rear clamping device 71 or to the at least one slide clamping element 114.

In the case of a deactivation of the at least one slide releaser 121, a restoring force of the least one front slide clinching element 119 causes a movement of the at least one slide clamping element 114 towards the first slide clamping surface 117 and thus a clamping of the at least one slide 102 and of the rear main body 71 and thus of the at least one fixing device 109. Such a deactivation of the at least one front slide releaser 121 consists, for example, in a lowering of the pressure in the interior of the slide release hose 121, for example down to an ambient pressure, in particular atmospheric pressure. Preferably, the at least one slide clinching element 119 and further preferably the at least two slide clinching elements 119 is/are at any time under an at least minimal pre-tension, independently of whether the at least one fixing device 109 is released or clamped and independently of where the at least one slide 102 is situated. In particular, the slide leaf springs 119, further preferably the at least one slide spring assembly 119, are slightly deflected and pre-tensioned at any time.

The fixing device 109 in the second embodiment is preferably operated such that a printing plate 73 clamped both in the at least one front clamping device 21 as well as in the at least one rear clamping device 61 is firstly clamped by pressurizing the at least one clamping drive 104, for example by acting on and thus expanding the clamping hose 104 with a pressure such that it moves the at least one slide 102. Here, the fixing device 109 is firstly released, for example by pressurizing the slide release hose 121 with pressure and thereby the two slide spring assemblies 119 are deformed such that the at least one slide clamping element 114 is pulled back. The at least one slide 102 and thus the entire at least one rear clamping device 61 moves towards the at least one front clamping device 21. The printing plate 73 wrapped around the plate cylinder 07 is thereby tensioned. The at least one slide 102 preferably moves so far until an equilibrium sets in between the force applied by the at least one tensioning drive 104 and forces counteracting this. This is the case, for example, if a certain pressure prevails in the interior of the tensioning hose 104. Then the at least one rear stop element 112 is preferably moved so far towards the at least one slide 102 until the at least one abutment body 111 touches the at least one rear abutment adjusting element 112 on an abutment contact 123. The at least one rear stop element 112 is then preferably already arranged in a location that guarantees an optimal position of the at least one slide 102 as soon as the at least one stop body 111 touches the at least one rear abutment adjusting element 112. The fixing device 109 is then clamped, for example by the pressure in the slide release hose 121 being reduced so far that the slide spring assemblies 119 relax and thereby press the at least one slide clamping element 114 is pressed against the first slide clamping surface 117. As soon as the fixing device 109 is clamped, the tensioning drive 104 is deactivated, for example by reducing the pressure in the tensioning hose 104, for example to ambient pressure, in particular atmospheric pressure.

The rear clamping device 61 is held in its position in this state in that the fixing device 109 firmly clamps the at least one slide 102 and thus the at least one rear clamping device 61 in its position in the channel 13. For this, no drive must remain permanently activated and in particular no hose must remain permanently pressurized. The at least one tensioning drive 104, the at least one slide releaser 121 and the at least one rear adjusting element 64 are preferably supported against a same component 71 of the slide 102 and of the at least one rear clamping device 61, further preferably against the rear main body 71. Actuations of the at least one tensioning drive 104, of the at least one slide releaser 121 and of the at least one rear adjusting element 64 are preferably feasible independently of one another.

The exact position of the at least one rear stop adjusting element 112 defines the maximal adjustment path of the least one slide 102. Owing to the exact position of the at least one rear stop adjusting element 112, a maximal tension acting on the tensioned printing plate 73 is thus fixed. Preferably, a number, further preferably at least two and even further preferably at least four, of the rear stop adjusting elements 112 described are arranged at a distance from one another in the axial direction A. In a preferred embodiment, the at least one rear stop adjusting element 112 is adjustable in its position by means at least of one drive designed as a stop drive. The at least one stop drive is preferably designed as at least one electric motor. The at least one stop drive can also be designed as a pneumatic and/or hydraulic drive. The at least one stop drive and/or at least one rear stop adjusting element 112 further preferably has at least one sensor, which records a position of the at least one stop drive, for example an angle of rotation position of the at least one electric motor and/or records a position of the at least one rear adjusting element 112. Preferably, the at least one sensor is connected to the machine control and/or the at least one stop drive is connected to the machine control. Alternatively or additionally, a position of the at least one rear stop adjusting element 112 is manually adjustable.

Preferably, the at least one stop body 111 is arranged movably between a stop position and a passing position, preferably in a direction orthogonal to the tensioning direction E, for example in the axial direction A. In the stop position, the at least one stop body 111 is situated opposite the at least one rear stop adjusting element 112 with respect to the tensioning direction E. The interaction then takes place as described above. In the passing position, the at least one stop body 111 is situated outside an extension of the at least one rear stop adjusting element 112 in the tensioning direction E. As long as the at least one stop body 111 is situated in the passing position, the at least one stop body 111 thus doesin particular not restrict the control part of the at least one slide 102. This allows a larger control path than the maximal control path of the at least one slide 102 set for tensioning processes without the at least one rear stop element 112 having to be adjusted differently for this. This facilitates a placement of the printing plate 73 on the plate cylinder 07 and thus allows a particularly effective introduction of the printing plate 73 into the at least one rear clamping device 61.

In a preferred embodiment, the at least one stop body 111 is adjustable in its position by means of at least one drive designed as a positioning drive, in particular movable between the stop position and the passing position. The at least one positioning drive is preferably designed as at least one electric motor. The at least one positioning drive can also be designed as a pneumatic and/or hydraulic drive. The at least one positioning drive and/or the at least one stop body 111 further preferably has at least one sensor, which records a position of the at least one positioning drive, for example an angle of rotation position of the at least one electric motor and/or the one position of the at least one stop body 111. Preferably, the at least one sensor is connected to the machine control and/or the at least one positioning drive is connected to the machine control. Alternatively or additionally, the position of the at least one stop body 111 is manually adjustable.

Independently of the embodiment of the fixing device 109, the at least one rear clamping device 61 and further preferably the at least one slide 102 is preferably arranged movably in and/or opposite to the axial direction A relative to the cylinder barrel 12. By means at least of an adjusting device 144, in particular at least a side adjusting device 144, for example, of a side adjusting screw 144, the at least one rear clamping device 61 and further preferably the at least one slide 102 is adjustable in its position in the axial direction A. Preferably, the side adjusting device 144 is driveable and/or driven by means of at least one drive 141 designed as an axial drive 141. In one embodiment, the at least one rear clamping device 61 and further preferably the at least one slide 102 is already set in its axial position by the at least one side adjustment device 144. In a preferred embodiment, the at least one rear clamping device 61 and further preferably the at least one slide 102 is pressed against a preferably adjustable side stop 143 in the axial direction A on one side, for example the side I, by means of a lateral pressure element 142, for example a lateral spring 142 and/or a lateral pneumatic piston 142 and/or hydraulic piston 142. The adjustable side stop 143 is preferably arranged on the opposite side, for example on the side II. The adjustable side stop 143 can be designed, for example, as the least one side adjustment device 144, in particular side adjustment screw 144, described beforehand. The at least one axial drive 141 is preferably arranged in a depression within the channel 13, for example between the at least one tensioning device 101 and the axis of rotation 11 of the plate cylinder 07.

The at least one plate cylinder 07 preferably has at least one feed device, for example at least one rotary introduction. The at least one feed device is preferably designed as an air supply and/or air outlet and/or current feedthrough and/or liquid supply and/or liquid discharge. The at least one feed device preferably serves for a supply and/or removal of compressed air and/or current and/or electrical control signals and/or at least one temperature control liquid. Preferably, the at least one feed device is designed as at least one rotary feed. Preferably, the at least one supply device has at least two compressed air feeds, of which, for example, a first compressed air feed serves for the supply of compressed air for the actuation of the tensioning drive 104 preferably designed as a tensioning hose 104 and/or of which, for example, a second compressed air feed serves for the supply of compressed air for the actuation of the front adjusting element 24 preferably designed as a front clamp release hose 24 and/or of the rear adjusting element 64 preferably designed as a rear clamp release hose 64 and/or of the slide releaser 121 preferably designed as a slide release hose 121 and/or of the at least one positioning drive of the at least one stop body 111. Preferably, at least one transmitting unit and one receiving unit connected or connectable therewith is arranged, by means of which electrical control signals and/or measuring signals and/or electric power via electromagnetic signals and/or fields are being transmitted and/or transmissible between the rotating and/or rotatable plate cylinder 07 on the one hand and a stationary machine component, for example the frame of the printing unit 02 and in particular the machine control on the other hand. The at least one supply is preferably assigned to a cylinder journal 17 of the plate cylinder 07, which is arranged on another side of the cylinder barrel 12 than a drive driving the plate cylinder 07. Such a drive driving the plate cylinder 07 can be present, for example, in the form of a motor or of a preferably helically toothed gear wheel.

Preferably, the plate cylinder 07 has at least one pneumatic control 127, which preferably has at least one valve. Preferably, the plate cylinder 07 has at least one electronic control 128. Preferably, the at least one pneumatic control 127 and/or the at least one electronic control 128 is/are arranged in at least one and further preferably precisely one control container 129, which is further preferably part of the plate cylinder 07. Preferably, the at least one control container 129 is arranged laterally to the cylinder barrel 12 in the area of a cylinder journal 17 with respect to the axial direction A.

A method for arranging, in particular for clamping and/or tensioning, the printing plate 73 on the plate cylinder 07 is described below.

In a first operating state of the plate cylinder 07 also designated as the starting state, preferably no printing plate 73 is in contact with the at least one tensioning device 101. The at least one front clamping device 21 and in particular the front clamping gap 27 is preferably closed. The at least one front adjusting element 24 is preferably deactivated. Further preferably, the at least one front clamp release hose 24 is under ambient pressure, in particular atmospheric pressure. The at least one rear clamping device 61 is preferably closed. The at least one rear adjusting element 64 is preferably deactivated. Further preferably, the at least one rear clamp release hose 64 is under ambient pressure, in particular atmospheric pressure. The at least one slide 102 is preferably in contact with the second channel wall 19, in particular in its peripheral location. Preferably, the at least one rear spacer 131 is located in the retracted position. Further preferably, the at least one rear spacer 131 is located in a position in particular extended by the reserve track and the at least one slide 102 is located in its spaced peripheral location.

In a first process operation, which is also designated as a front opening process, the at least one front clamping device 21 is opened. For this, the at least one front adjusting element 24 is preferably activated. Further preferably, the at least one front clamp release hose 24 is charged with compressed air, which is under a pressure of preferably between 3 bar and 10 bar, further preferably between 5 bar and 7 bar. The at least one front clamp release hose 24 thereby expands supports itself on the at least one and preferably on the two front pressure elements 23. The at least one front pressure element 23 is preferably deflected and the two front pressure elements 23 are preferably deflected in opposite direction. Preferably, the at least one radially inner front clamping element 26 is removed thereby from the at least one radially outer front clamping element 22, preferably by 0.9 mm to 1.5 mm, and the front clamping gap 27 is opened. Beforehand and/or during this and/or thereafter, the plate cylinder 07 is preferably brought with respect to its axis of rotation 11 into an angular position provided for an insertion of the printing plate 73. Preferably, in this intended angular position, the front clamping gap 27 is situated in immediate vicinity to the printing plate 73, which further preferably is arranged at least partially within the at least one printing plate store. Preferably, the printing plate 73 is arranged in the at least one printing plate store essentially along a tangent to the plate cylinder 07.

A second operating state, which is also referred to as forward opened operating state of the plate cylinder 07, differs from the first operating state preferably only in that the at least one front clamping device 21 and in particular the front clamping gap 27 is opened and the at least one front adjusting element 24 is activated and further preferably in that the at least one front clamp release hose 24 is under an increased pressure of preferably between 3 bar and 10 bar, further preferably between 5 bar and 7 bar and in that the at least one front pressure element 23 is more strongly deflected.

In a second process operation, which is also called front insertion method, a front end 74 of the printing plate 73 is inserted in the at least one front clamping device 21 and in particular in the front clamping gap 27. Beforehand, the printing plate 73 is preferably brought into a readiness position intended for this, in which further preferably a position and orientation relative to the front clamping gap 27 of the printing plate 73 on the subsequent insertion into the front clamping gap 27 is optimized, for example by means of the at least one printing plate store.

A third operating state, which is also called front insert state of the plate cylinder 07, differs from the second operating state preferably only in that the front end 74 of the printing plate 73 is inserted in the at least one front clamping device 21 and in particular in the front clamping gap 27.

In a third process operation, which is also called front clamping method, the at least one front clamping device 21 and in particular the front clamping gap 27 is closed and thereby the front end 74 of the printing plate 73 is clamped in the at least one front clamping device 21 and in particular in the front clamping gap 27. For this, the at least one front adjusting element 24 is preferably deactivated. Further preferably, the pressure in the at least one front clamp release hose 24 is reduced, in particular until the at least one front clamp release hose 24 is under an ambient pressure, in particular atmospheric pressure. The at least one front clamp release hose 24 thereby shrinks. The at least one front pressure element 23 preferably uses the liberated space and extends and the two front pressure elements 23 preferably extend and move partially in the opposite direction towards one another. Preferably, the at least one radially inner front clamping element 26 thereby moves towards the at least one radially outer front clamping element 22 and the front clamping gap 27 is closed. In a support operation, which, for example, is part of the third process operation, the printing plate 73 is preferably laid on the lateral surface 124 of the plate cylinder 07. This takes place, for example, by swivelling the plate cylinder 07 around its axis of rotation 11 and here, preferably by means of a support device, for example a pressure roller, by the printing plate 73 being pressed onto the lateral surface 124 of the plate cylinder 07. Optionally, at least one underlay can be arranged between the lateral surface 124 of the plate cylinder 07 and of the printing plate 73, for example to equalize deviations of the diameter from an ideal diameter. Preferably, the third process operation is only carried out if it is ensured that the printing plate 73 is correctly in contact with the at least two register stops 31; 32.

A fourth operating state of the plate cylinder 07, which is also called front clamping state, differs from the third operating state preferably only in that the at least one front clamping device 21 and in particular the front clamping gap 27 is closed and in that the front end 74 of the printing plate 73 is clamped into the at least one front clamping device 21 and in particular into the front clamping gap 27 and in that the at least one front adjusting element 24 is deactivated and further preferably in that the at least one front clamp release hose 24 is under an ambient pressure, in particular atmospheric pressure and in that the at least one front pressure element 23 is deflected less greatly and further preferably in that the printing plate 73 is pressed onto the lateral surface 124 of the plate cylinder 07.

In a fourth process operation, which is also called rear opening method, the at least one rear clamping device 61 is preferably opened. For this, the at least one rear adjusting element 64 is preferably activated. Further preferably, the at least one rear clamp release hose 64 is charged with compressed air, which is under a pressure of preferably between 3 bar and 10 bar, further preferably between 5 bar and 7 bar. Preferably, the at least one rear clamp release hose 64 expands thereby and supports itself on the at least one and preferably on the two rear pressure elements 63. The at least one rear pressure element 63 flexes and the two rear pressure elements 63 preferably flex in opposite direction. Preferably, the at least one radially inner rear clamping element 66 is removed from the at least one radially outer rear clamping element 62 thereby and the rear clamping gap 67 is opened. Beforehand and/or at the same time and/or thereafter, preferably the at least one slide 102 is moved by an insertion route from its peripheral location or spaced peripheral location along the tensioning path into a central or inner position towards the at least one front clamping device 21 and the first channel wall 18. The insertion route is preferably between 10 mm and 30 mm, further preferably at least 15 mm and even further preferably between 15 mm and 25 mm long. For this, the at least one drive 104 designed as a tensioning drive 104 is activated. Further preferably, the at least one tensioning hose 104 is charged with compressed air, which is under a pressure of preferably between 1 bar and 10 bar, further preferably between 4 bar and 6 bar. Since the at least one tensioning hose 104 preferably supports itself both on the second channel wall 19 as well as along the at least one slide 102, preferably the at least one slide 102 is thus moved. Preferably subsequently, the plate cylinder 07 is preferably rotated around its axis of rotation 11 and thereby the printing plate 73 is placed on its lateral surface. Preferably, it is pressed thereby by means of at least one pressure means, for example a pressure roller, against this lateral surface of the at least one plate cylinder 07.

A fifth operating state, which is also called rear opened operating state of the plate cylinder 07, differs from the fourth operating state preferably only in that the at least one rear clamping device 61 and in particular the rear clamping gap 67 is opened and that at least one rear adjusting element 64 is activated and further preferably in that the at least one rear clamp release hose 64 is under an increased pressure of preferably between 3 bar and 10 bar, preferably between 5 bar and 7 bar and in that the at least one rear pressure element 63 is more strongly deflected and in that the at least one slide 102 is situated in the central or inner position.

In a fifth process operation, which is also called rear insertion method, preferably a rear end 76 of the printing plate 73, which meanwhile is situated around the plate cylinder 07, was pressed in particular by means of the pressure roller, placed on the plate cylinder 07 such that the rear end 76 of the printing plate 73 projects over an edge 72 connecting the second channel wall 19 with the lateral surface 124 of the plate cylinder 07. In other words, the rear end 76 of the printing plate 73 is brought into an effective range of the at least one rear clamping device 61 in its peripheral or spaced peripheral location. Subsequently, the at least one slide 102 is preferably moved from its central or inner position along the tensioning path by the insertion route into its peripheral location or preferably into its spaced peripheral location towards the second channel wall 19. For this, the at least one tensioning drive 104 is preferably deactivated. Further preferably, the pressure in the at least one tensioning hose 104 is reduced, in particular until the at least one front tensioning hose 104 is under an ambient pressure, in particular atmospheric pressure. Preferably, the at least one radially outer rear clamping element 62 and the at least one radially inner rear clamping element 66 here enclose the rear end 76 of the printing plate 73, further preferably the at least one radially outer rear clamping element 62 or the at least one radially inner clamping element 66 at most touching the rear end 76 of the printing plate 73. Preferably, the rear end 76 of the printing plate 73 is at least partially enclosed by the at least one rear clamping gap 67 of the at least one rear clamping device 61, while the at least one slide 102 is moved along the tensioning path from its inner position towards the second channel wall 19 into its peripheral or spaced peripheral location. It is equally well possible to change the sequence of the fourth process operation and the parts of the fifth process operation, for example to open the at least one rear clamping element 61 only when the slide 102 is already located in its central or inner position.

A sixth operating state, which is also called rear insertion state of the plate cylinder 07, differs from the fifth operating state preferably only in that the rear end 76 of the printing plate 73 is inserted in the at least one rear clamping device 61 and in particular in the rear clamping gap 67 and in that the at least one slide 102 is located in the peripheral or spaced peripheral location.

In a sixth process operation, which is also called rear clamping process, the at least one rear clamping device 61 and in particular the rear clamping gap 67 is closed and thereby the rear end 76 of the printing plate 73 is clamped in the at least one rear clamping device 61 and in particular in the rear clamping gap 67. For this, the at least one rear adjusting element 64 is preferably deactivated. Further preferably, the pressure in the at least one rear clamp release hose 64 is reduced, in particular until the at least one rear clamp release hose 64 is under an ambient pressure, in particular atmospheric pressure. The at least one rear clamp release hose 64 thereby preferably shrinks. The at least one rear pressure element 63 preferably uses the liberated space and extends and the two rear pressure elements 63 preferably extend and at least partially move towards each other in opposite direction. Preferably thereby, the at least one radially inner rear clamping element 66 moves towards the at least one radially outer rear clamping element 62 and the rear clamping gap 67 is closed.

A seventh operating state of the plate cylinder 07, which is also called rear clamping state, differs from the sixth operating state preferably only in that the at least one rear clamping device 61 and in particular the rear clamping gap 67 is closed and in that the rear end 76 of the printing plate 73 is clamped into the at least one rear clamping device 61 and in particular into the rear clamping gap 67 and in that the at least one rear adjusting element 64 is deactivated and further preferably in that the at least one rear clamp release hose 64 is under an ambient pressure, in particular atmospheric pressure and in that the at least one rear pressure element 63 is less strongly deflected.

A seventh process operation, which is also called tensioning operation, depends on the embodiment of the fixing device 109. The seventh process operation is preferably carried out as described in the following in connection with the fixing device 109 in the first embodiment. Firstly, in a first section of the tensioning operation the printing plate 73 is preferably prepared. Preferably, the at least one rear adjusting element 131 is firstly brought into a retracted position and is preferably moved towards the second channel wall 19 for the utilisation of the reserve track of the at least one slide 102. Preferably, the at least one slide 102 is then moved towards the at least one front clamping device 21 and the first channel wall 18, further preferably minimally further than is provided for a printing operation using this printing plate 73. In particular, the at least one slide 102 is thereby moved away from the second channel wall 19. Preferably, the printing plate 73 is thereby tensioned with a first force. Preferably, the printing plate 73 is thereby tensioned at least minimally more strongly than is provided for a printing operation using this printing plate 73, for example with a pressure higher by 0.5 bar in the at least one tensioning hose 104. For this, the at least one tensioning drive 104 is activated. Further preferably, the at least one tensioning hose 104 is charged with compressed air that is under a pressure of preferably between 3 bar and 10 bar, further preferably between 6 bar and 8 bar. As the at least one tensioning hose 104 preferably supports itself both on the second channel wall 19 as well as on the at least one slide 102, the at least one slide 102 is thus moved. The pressure is preferably chosen to be higher than is provided in the rear insertion process, because it must be operated against the tension building up in the printing plate 73. Alternatively, the at least one first slide 102, however, can interact with a stop such that it is possible to work with an identical pressure in the rear insertion operation and in the tensioning operation. Subsequently, in a second section of the tensioning operation the printing plate 73 is again relieved by the at least one slide 102 being moved again towards the second channel wall 19, further preferably to its peripheral position. For this, at least one tensioning drive 104 is deactivated. Further preferably, the pressure in the at least one tensioning hose 104 is reduced, in particular until the at least one front tensioning hose 104 is under a lower pressure, for example an ambient pressure.

Subsequently, in a third section of the tensioning operation preferably the at least one slide 102 is moved again towards the at least one front clamping device 21 and the first channel wall 18, further preferably minimally further than is provided for a printing operation. Preferably, the printing plate 73 is tensioned here with a second force. Preferably, the second force is just as great as the first force. The preferred rapid tensioning exceeding the degree provided in the printing operation guarantees that a tensioning force can act on the printing plate 73 along the entire circumference of the printing plate 73 and not due to static friction only an edge region is influenced, in particular is stretched, by the tensioning force. For this, the at least one tensioning drive 104 is activated in turn. Further preferably, the at least one tensioning hose 104 is charged with compressed air, that is under a pressure of preferably between 2 bar and 8 bar, further preferably between 2 bar and 5 bar for a printing plate 73 with a backing plate of aluminium, and between 3 bar and 7 bar for a printing plate 73 with a backing plate of steel.

Preferably, the printing plate 73 and in particular its rear end 76 remains clamped in the rear clamping device 61 at least from the beginning of the first section of the tensioning operation up to the end of the third section of the tensioning operation. The at least one slide 102 is firstly arranged in an intermediate state at least minimally, for example less than 1 mm, nearer to the first channel wall 18 and the at least one front clamping device 21 than provided in the printing operation. Now the at least one rear spacer 131 is adjusted to a position relative to the at least one slide 102 that specifies a certain distance of the at least one rear clamping device 61 from the second channel wall 19, which guarantees a tensioning of the printing plate 73 provided in the printing operation. Preferably, for this the at least one rear adjusting screw 131 is rotated around its thread axis relative to the least one slide 102 and/or relative to the cylinder carriage 12, further preferably by means of the at least one drive 134 designed as a distance drive 134, further preferably up to the at least one rear spacer 131 with the second channel wall 19. Subsequently, the printing plate 73 is again partially relieved by reducing the tensioning force and, for example, by moving the at least one slide 102 minimally again towards the second channel wall 19, preferably until the at least one rear spacer 131 is in contact with the second channel wall 19 at the at least one distance contact point 133. For this, at least one tensioning drive 104 is preferably at least partly deactivated. Further preferably, the pressure in the at least one tensioning hose 104 is reduced, in particular until the at least one tensioning hose 104 is under a lower pressure than beforehand, for example under an ambient pressure, in particular atmospheric pressure. The printing plate 73 is now tensioned and the plate cylinder 07 is located in an eighth operating state in a first embodiment. In particular, in the first section of the tensioning process and in the third section of the tensioning process at least temporarily the pressure within the tensioning hose 104 is in each case greater than in the second section of the tensioning process. Preferably, a third force, with which the printing plate 73 is tensioned in the eighth operating state, is at least minimally smaller than the first force and/or the second force, with which the printing plate 73 is tensioned during the first section and/or during the third section of the tensioning process.

The eighth operating state in the first embodiment, which is also called tensioning state or printing operation state, differs in use of the fixing device 109 in the first embodiment from the seventh operating state preferably only in that the at least one slide 102 has a greater distance from the second channel wall 19 than in the seventh operating state and in that the at least one slide 102 has a smaller distance from the first channel wall 18 than in the seventh operating state and in that the at least one rear spacer 131 is changed in its position relative to the at least one slide 102 in that the at least one rear spacer 131 is to be arranged with respect to the circumferential direction D relative to the at least one slide 102 further in a direction towards the second channel wall 19 than in the seventh operating state and in that the printing plate 73 is tensioned on the lateral surface 124 of the plate cylinder 07. In this eighth operating state, the plate cylinder 07 is ready for a printing operation and/or the plate cylinder is in the printing operation.

The seventh process operation, which is also called tensioning process, is, however, preferably carried out as described below in connection with the fixing device 109 in the second embodiment. Firstly, in a first step of the tensioning process, the printing plate 73 is preferably prepared by moving the at least one slide 102 towards the at least one front clamping device 21 and the first channel wall 18, further preferably further than is provided for a printing operation. In particular, here the at least one slide 102 is moved away from the second channel wall 19. For this, preferably the fixing device 109 is firstly detached by activating the at least one drive 116, preferably designed as a slide release drive 116. For this, for example, the pressure in the slide release hose 121 is increased so far that the slide spring assemblies 119 deform and thereby the at least one slide clamping element 114 releases from the first slide clamping surface 117. Preferably, the at least one stop body 111 is moved in its passing position to facilitate the movements of the at least one slide 102 described below, further preferably by means of the at least one drive designed as at least one positioning drive. Now, the at least one tensioning drive 104 is activated. Further preferably, the at least one tensioning hose 104 is charged with compressed air, which is under a pressure of preferably between 3 bar and 10 bar, further preferably between 6 bar and 8 bar. Since the at least one tensioning hose 104 supports itself both on the second channel wall 19 as well as on the at least one slide 102, the at least one slide 102 is thus moved. The pressure is preferably chosen to be higher than provided in the rear insertion process, because it must be operated against the tension building up in the printing plate 73.

Subsequently, in a second section of the tensioning process the printing plate 73 is again relieved by moving the at least one slide 102 again to the second channel wall 19, further preferably into its peripheral position. For this, at least one tensioning drive 104 is deactivated. Further preferably, the pressure in the at least one tensioning hose 104 is reduced, in particular until the at least one front tensioning hose 104 is under a lower pressure, for example an ambient pressure, in particular atmospheric pressure. Then, preferably firstly the at least one rear stop element 112, with respect to the tensioning direction E, is moved preferably relative to the cylinder barrel 12 into a stop setpoint position, further preferably by means of the at least one drive designed as a stop drive.

Now, preferably in a third section of the tensioning process the at least one slide 102 is moved again towards the at least one front clamping device 21 and the first channel wall 18 and in particular away from the second channel wall 19 until a desired tensioning force achieved. For this, in turn the at least one tensioning drive 104 is activated. Further preferably, the at least one tensioning hose 104 is charged with compressed air which is under a pressure of preferably between 2 bar and 8 bar, further preferably between 2 bar and bar for a printing plate 73 with a backing plate of aluminium and between 3 bar and 7 bar for a printing plate 73 with a backing plate of steel. Beforehand and/or subsequently and/or simultaneously, the at least one stop body 111 is moved to the stop position, further preferably by means of the drive designed as at least one as a [sic] positioning drive, preferably until the at least one rear stop element 112 touches the at least one rear stop body 111.

Further preferably, for this the at least one rear stop screw 112 is rotated around its thread axis. Thereby, as described, the maximum adjustment path of the at least one slide 102 and thus the maximum tension force acting on the tensioned printing plate 73 is fixed. A continuation of the movement of the at least one slide 102 is then not possible because of the contact of the at least one rear stop element 112 with the at least one stop body 111.

Subsequently, the fixing device 109 is clamped, for example by reducing the pressure in the slide release hose 121 so far that the slide spring assemblies 119 relax and thereby press the at least one slide clamping element 114 against the first slide clamping surface 117, for example at ambient pressure, in particular atmospheric pressure. As soon as the fixing device 109 is clamped, the tensioning drive 104 is deactivated, for example by reducing a pressure in the tensioning hose 104, for example to ambient pressure, in particular atmospheric pressure. The rear clamping device 61 is held in its position in this state in that the fixing device 109 firmly clamps the at least one slide 102 and thus the at least one rear clamping device 61 in their position in the at least one channel 13. The printing plate 73 is now tensioned and the plate cylinder 07 is in an eighth operating state in a second embodiment.

The eighth operating state in the second embodiment, which is also called tensioning state or print operation state, differs in use of the fixing device 109 in the second embodiment from the seventh operating states preferably only in that the at least one slide 102 has a greater distance from the second channel wall 19 than in the seventh operating state and in that the at least one slide 102 has a smaller distance from the first channel wall 18 than in the seventh operating state and in that the at least one stop body 111 touches the at least one rear stop adjusting element 112 and in that the printing plate 73 is tensioned on the lateral surface 124 of the plate cylinder 07. In this eighth operating state, the plate cylinder 07 is ready for a printing operation and/or the plate cylinder is in the printing operation.

Independently of the embodiment of the tensioning process, the printing plate 73 and in particular its rear end 76 preferably remain clamped in the rear clamping device 61 at least from the start of the first section of the tensioning process up to the end of the third section of the tensioning process. Independently of the embodiment of the tensioning process, preferably in the first section of the tensioning process the at least one slide 102 is moved by means of a first force towards the at least one front clamping device 21 and the first channel wall 18 and thereby the printing plate 73 is tensioned, which is preferably just as great as a second force, with which in the third section of the tensioning process the at least one slide 102 is to be moved towards the at least one front clamping device 21 and the first channel wall 18 and thereby the printing plate 73 is tensioned. Preferably, a first central or first inner position, in which the at least one slide 102 stops in the first section of the tensioning process, is closer here to the second channel wall 19 than a second central or second inner position, in which the at least one slide 102 stops in the third section of the tensioning process. This is based on the fact that the printing plate 73 settles in the first section of the tensioning process and thereby tensions are relaxed and any voids are reduced, the printing plate 73 is thus seated overall.

Preferably, independently of the embodiment of the fixing device 109, in at least an eighth process operation at least one sample print is carried out. A specimen of a printing product, for example of a sheet of paper 09, is printed for this sample print. With the aid of the resulting print image, it is evaluated whether and how far the plate tension should be changed and/or whether and how far a slant of the printing plate 73 on the plate cylinder 07 should be changed and/or whether and how far a convex and/or concave deformation of the front end 74 of the printing plate 73 and/or of the rear end of the printing plate 73 should be changed. Should the print image already be perfect, all adjustments of the tensioning device 101 are maintained. This process is preferably repeated as often as necessary. Further preferably, not more than this one sample print is necessary to specify a complete and final adjustment of the plate cylinder 07 and even further preferably all plate cylinders 07 interacting with a common transfer cylinder 06.

If required, in at least a ninth process operation, adjustments to the settings of the tensioning device 101 corresponding to the evaluation in the eighth process operation are preferably carried out. The ninth process operation is also called adjustment operation. Independently of the type of adjustments, the fixing device 109 is firstly released again and the printing plate 73 is at least partly relieved.

When using the first embodiment of the fixing device 109 in the ninth process operation, firstly the at least one slide 102 is removed again from the second channel wall 19 and moved towards the first channel wall 18 and/or the at least one front clamping device 21. Preferably, for this the at least one tensioning drive 104 is activated. Further preferably, the at least one control body 104 that can be charged and/or is charged with a pressure medium, in particular the at least one tensioning hose 104, is charged with a pressure medium, in particular with compressed air, which is under a pressure of preferably between 3 bar and 10 bar, until the at least one slide 102 performs the said movement towards the first channel wall 18 and/or the at least one front clamping device 21. The at least one slide 102 is then stopped, for example, by contact with at least one stop and/or by an equilibrium of forces between the at least one control body 104 and the at least one restoring element 106. Now, the at least one rear spacer 131 is adjusted to a position relative to the at least one slide 102 and/or relative to the cylinder barrel 12 which allows a smaller distance of the at least one rear clamping device 61 from the second channel wall 19. Preferably, here the at least one rear setting screw 131 is rotated around its thread axis relative to the at least one slide 102 and relative to the cylinder barrel 12, further preferably by means of the at least one distance drive 134. Subsequently, the printing plate 73 is again released by moving the at least one slide 102 again towards the second channel wall 19, and is moved away from the first channel wall 18 and/or from the at least one front clamping device 21, preferably until the at least one slide 102 is again situated in its peripheral position and/or until the at least one rear spacer 131 is in contact with the second channel wall 19 and at the same time with at least one slide 102 at the at least one distance contact point 133. For this, the at least one tensioning drive 104 is preferably at least partly deactivated. Further preferably, the pressure in the at least one control body 104 charged with the pressure medium, in particular clamping hose 104, is reduced, in particular until the at least one control body 104, in particular clamping hose 104 is under a lower pressure than beforehand, for example under an ambient pressure, in particular atmospheric pressure.

When using the second embodiment of the fixing device 109, in the ninth process operation the at least one tensioning drive 104 is preferably first activated. Further preferably, the at least one tensioning hose 104 is charged with compressed air, which is under a pressure of preferably between 3 bar and 10 bar. The at least one slide 102 and in particular the least one rear stop adjusting element 112 is now pressed with sufficiently great force against the at least one stop body 111 by the at least one tensioning drive 104. Now the fixing device 109 is preferably firstly released, for example by increasing the pressure in the slide release hose 121 to the extent that the slide spring assembly 119 deform and thereby the at least one slide clamp element 114 releases from the first slide clamp surface 117. Subsequently, the printing plate 73 is again released by moving the at least one slide 102 again to the second channel wall 19, preferably until the at least one slide 102 is again situated in its peripheral position and/or until the at least one rear spacer 131 comes into contact with the second channel wall 19 at the at least one distance contact point 133. For this, at least one tensioning drive 104 is preferably at least partially deactivated. Further preferably, the pressure in the at least one tensioning hose 104 is reduced, in particular until the at least one tensioning hose 104 is under a lower pressure than beforehand, for example under an ambient pressure, in particular atmospheric pressure.

Independently of the embodiment of the fixing device 109, one or more of the following partial processes are then carried out as part or parts of the adaptation process.

In a partial process of the adaptation process for the correction of a slant position of the printing plate 73 and/or in a partial process for the correction of a convex and/or concave deformation of the front end 74 of the printing plate 73, at least one of the at least two and preferably the at least two second support sites 34; 36 are readjusted if required. For this, preferably the at least two front contact bodies 39; 41 preferably designed as front adjusting screws 39; 41 are adjusted in their position relative to the at least one front clamping device 21, in particular to the at least one radially outer front clamping element 22 and/or relative to the cylinder barrel 12. Further preferably, the at least two front contact bodies 39; 41 are readjusted in their position by means of the at least one drive 43; 44 designed as a front pretensioning drive 43; 44. Further preferably, at least one and in particular the at least two front adjusting screws 39; 41 is/are rotated around their thread axis relative to the least one front clamping device 21 and/or relative to the cylinder barrel 12. As preferably at any time the first channel wall 18 and the at least one front clamping device 21, in particular the at least one radially outer front clamping element 22, in particular in the form of the bulge and the at least two front contact bodies 39; 41, are in contact with one another at all support points 33; 34; 36, a preferably elastic deflection and/or a slanted position of the at least one first clamping device 21 relative to the first channel wall 18 is influenced by adjustment of the at least two second support sites 33; 34. By this means, corresponding malpositioning of a print image originating from a specific printing plate 73 relative to positions at least of a print image originating from at least one other printing plate 73 can be corrected.

If, for example, the at least two front contact bodies 39; 41, in particular adjusting screws 39; 41, are moved away from the first channel wall 18 in their adjustment relative to the bulge of the at least one front clamping device 21, ends of the at least two front contact bodies 39; 41, in particular adjusting screws 39; 41, facing towards the first channel wall 18 together with the bulge preferably arranged in between with respect to the axial direction A do not form a straight line and/or a curved line other than beforehand. As a result of forces acting, for example, on account of the support body 107 designed as a spring 107 and/or the tensioned printing plate 73, then at least the at least one front clamping device 21 is elastically deformed such that axially outer regions of the at least one front clamping device 21 and the clamped printing plate 73 are moved and/or, for example, drawn more strongly to the first channel wall 18 than an axially intermediate region of the at least one first clamping device 21 and the clamped printing plate 73. The clamped printing plate 73 is thus deformed convexly on its front end 74. Such a convex deformation on the front end 74 of the printing plate 73 can be preferably propagated at least partially through the entire printing plate 73 in the circumferential direction D. The convex deformation that the front end 74 of the printing plate 73 is preferably adjusted such that it counteracts a concave deformation of the print image on the printing plate 73. It is also necessary, if appropriate, to adopt appropriate measures at the rear end 76 of the printing plate 73, for example, to correspondingly adjust at least one rear adjusting element 131 in a modified manner.

If, for example, the at least two front contact bodies 39; 41, in particular adjusting screws 39; 41, are moved towards the first channel wall 18 in their adjustment relative to the bulge of the at least one first clamping device 21, the ends of the at least two front contact bodies 39; 41, in particular adjusting screws 39; 41, facing towards the first channel wall 18 together with the bulge preferably arranged in between with respect to the axial direction A, for example, do not form a straight line and/or a curved line just as strong as beforehand. As a result of forces acting, for example on account of the supporting bodies 107 designed as springs 107 and/or the tensioned printing plate 73, at least the at least one front clamping device 21 is then preferably elastically deformed such that axially outer regions of the at least one front clamping device 21 and/or, for example, drawn less strongly to the first channel wall 18 than an actually sensual region of the at least one front clamping device 21 and the tensioned printing plate 73. The tensioned printing plate 73 is thus concavely deformed at its front end 74. Such a concave deformation at the front end 74 of the printing plate 73 can be propagated at least partially through the entire printing plate 73 in the circumferential direction D. The concave deformation at the front end 74 of the printing plate 73 is preferably adjusted such that it counteracts a convex deformation of the print image on the printing plate 73. It is in turn necessary, if appropriate, also to adopt corresponding measures at the rear end 76 of the printing plate 73, for example, to adjust at least one rear adjustment element 131 in a correspondingly modified manner.

If, for example, the at least two front contact bodies 39; 41, in particular adjustment screws 39; 41, in their adjustment relative to the bulge of the at least one front clamping device 21 are moved contrary to one another, the ends facing towards the first channel wall 18 of the at least two front contact bodies 39; 41, in particular adjusting screws 39; 41, together with the bulge arranged in between with respect to the axial direction A preferably furthermore form a straight line, which, however, is aligned obliquely relative to the front clamp gap 27 and/or the first channel wall 18. As a result of acting forces, for example on account of the support body 107 designed as a spring 107 and/or the tensioned printing plate 73, the at least one front clamping device 21 is then pressed on the first channel wall 18, preferably together with the tensioned printing plate 73, such that the at least one front clamping device 21 preferably rotates around an essentially radial alignment axis together with the tensioned printing plate 73 relative to the first channel wall 18. This alignment axis preferably runs through the first support site 33. This takes place in particular because a first axially outer region of the at least one front clamping device 21 and the tensioned printing plate 73 are drawn further to the first channel wall 18 than a second axially outer region of the at least one front clamping device 21 and the tensioned printing plate 73, which is situated on another axial side of the first support site 33, than the first axially outer region. For example, the first axially outer region is assigned to side I and the second axially outer region is assigned to side II. The tensioned printing plate 73 is thus placed on its front end 74 diagonally to the plate cylinder 07. Such a diagonal position of the printing plate 73 is preferably reproduced by the entire printing plate 73 in the circumferential direction D and is further preferably adjusted such that it counteracts a diagonal position of the print image on the printing plate 73.

If necessary, that is in particular with a correspondingly deformed print image on the printing plate 73, the at least two front adjusting screws 39; 41 are adjusted such that in superposition of the above described effects a mixture of an oblique position of the printing plate 73 on the plate cylinder 07 results on the one hand and a convex and/or concave deformation of the printing plate 73 per se on the other hand.

An oblique position of the printing plate 73 by means of the at least one front clamping device 21 optionally at the same time requires an equalising oblique position and/or a movement in the axial direction A of the at least one slide 102 connected to the printing plate 73 by the at least one rear clamping device 61 and/or of the at least one rear clamping device 61 itself. As a result of the flexible mounting and/or anchorage of the at least one slide 102 and/or the at least one rear clamping device 61 on the one hand and as a result of the at least one side adjustment device 144, in particular the at least one drive 141 designed as an axial drive 141 on the other hand, the at least one rear clamping device 61 and further preferably the at least one slide 102 are adjustable in the axial direction A in its position. A maximal offset of the at least one slide 102 and the at least one rear clamping device 61 in the axial direction A, in particular from end position to end position, is preferably between 1 mm and 10 mm, further preferably between 3 mm and 6 mm.

A subprocess of the adaptation process for the correction of the plate tensioning and thus the length of the printing plate 73 in the circumferential direction on the one hand and the correction of convex and/or conclave deformations of the rear and 76 of the printing form 73 on the other hand, is carried out depending on the embodiment of the fixing device 109, preferably analogously to the respective seventh process operation. Here, however, on the one hand preferably the first tensioning and subsequent relieving of the printing plate 73 is omitted and on the other hand, depending on embodiment of the fixing device 109, the at least one rear stop adjusting element 112 of the at least one rear spacer 131 is adjusted according to the desired new plate tensioning. Should the adjustments of the at least one rear stop adjusting element 112 or of the at least one rear spacer 131 already have assumed the ideal value in the sample print in the eighth process operation, then preferably as described above the seventh process operation for the tensioning of the printing plate 73 is performed again, but using the adjustments of the at least one rear stop adjusting element 112 or of the at least one rear spacer 131 already used beforehand. An advantage of the renewed tensioning of the printing plate 73 lies, for example, in that reproducible ratios prevail and the plate tensioning can be adjusted uniformly over the entire extent of the printing plate 73. Therefore in the case of any adjustment of the at least two front adjusting screws 39; 41 and/or the at least one rear stop adjusting element 112 or the at least one rear spacer 131 the printing plate 73 is completely re-tensioned.

After the register for all printing inks and/or printing plates 73 has been measured and compared with a reference print image, necessary corrections of the print image are preferably determined in an inspection process and an evaluation process and converted to corrections of the adjustment of the at least one rear clamping device 61. Should a partial image originating from a certain printing plate 73 be too short, a revised adjustment of the at least one rear spacer 131 is determined therefrom and preferably calculated, which causes a greater stretching of the corresponding printing plate 73. Should a partial image originating from a certain printing plate 73 be too long, a revised adjustment of the at least one rear spacer 131 is determined and preferably calculated therefrom, which causes a weaker stretching of the corresponding printing plate 73. In one embodiment, these corrections are performed independently of one another on different rear spacers 131, spaced apart from one another in the axial direction, of a same plate cylinder 07 performed independently of one another and in particular differently from one another, further preferably on the basis of different correction values, which are determined for different axial positions.

Below, in particular an inspection operation, evaluation operation and adaptation operation are described in more detail. By means of these operations, for example, register errors can be recorded and compensated particularly rapidly and safely.

Preferably, firstly the forerunning end 74 of the respective printing plate 73 is clamped in the in each case at least one front clamping device 21 and the rear end 76 of this respective printing plate 73 is clamped in the in each case at least one rear clamping device 61. Preferably, in the inspection operation at least one print image printed on the print substrate 09 and further preferably at least one register pattern 151 of the preferably sheet-form print substrate 09 is recorded, further preferably by means of at least one sensor, in particular a register sensor. Preferably, in dependence thereon, thus on the at least one recorded print image and further preferably on the at least one register pattern 151 recorded in the evaluation operation, new adjustments for at least one adjusting element 39; 41; 131; 144, in particular at least a front adjusting element 39; 41 in the circumferential direction D and/or at least a rear adjusting element 131 in the circumferential direction D at least of one of the tensioning devices 101 are determined and preferably calculated. The least one register sensor is preferably designed as at least an optical register sensor, for example, as at least an area camera. Preferably, the at least one register sensor is connected by circuitry to the machine control.

As already described, the at least one adjusting element 39; 41; 131; 144 of the at least one tensioning device 101 is preferably designed as at least one front contact body 39; 41, by means of which the distance of the at least one front clamping device 21 from the first channel wall 18 of the least one channel 13 is adjustable and/or the at least one adjusting element 39; 41; 131; 144 of the at least one tensioning device 101 is designed as at least one rear spacer 131, by means of which the distance of the at least one rear clamping device 61 from the second channel 19 of the at least one channel 13 is adjustable and/or the at least one adjusting element 39; 41; 131; 144 of the at least one tensioning device 101 is designed as the at least one axial drive 144, by means of which the position of the at least one rear clamping device 61 with respect to the axial direction A is adjustable parallel to the axis of rotation 11 of the respective plate cylinder 07.

Preferably, a sample printing operation takes place next, that is in particular before the inspection operation, in which at least one print image and preferably at least one register pattern 151 and further preferably at least two register patterns 151 are printed on the print substrate 09, which in each case is or are composed at least partially of in each case at least two reference elements 152 originating from at least two different printing plates 73, for example register marks 152. This means that the printing ink of the corresponding reference elements 152 originally emanates from two different printing plates 73, before it is finally disposed on the print substrate 09. Preferably, the reference elements 152 or register marks 152 are thus parts of a print image printed on the print substrate 09, further preferably parts at least of a register pattern 151. The print substrate 09 thus preferably has at least one print image, which in each case has at least two reference elements 152, in particular register marks 152, which originate from different printing plates 73 and are preferably printed with different printing inks. The print substrate 09 further preferably has at least one register pattern 151, that in each case has at least two reference elements 152, in particular register marks 152, which originate from different printing plates 73 and are preferably printed using different printing inks. Preferably, with respect to each print image and/or with respect to each register pattern 151, a reference element 152, in particular a register mark 152, is or will be set as a base reference element 153, in particular base register mark 153. Register marks 152 are thereby, for example, components of a print image and further preferably set patterns, which additionally are transferred to a usable print image on the print substrate and have, for example, certain geometric shapes. The at least one reference element 152, however, can also be a constituent of the usable print image, which would anyway transfer to the print substrate 09.

In one embodiment, the at least one register pattern 151 is preferably formed in the following way. A first register mark 152, which is preferably the base register mark 153, is formed as at least a preferably rectangular framework. Further register marks 152 are contained therein, which are formed, for example, as simple crosses. Other geometric shapes, such as, for example, triangles or circles are likewise possible. The base register mark 153 and in the further register marks 152, preferably all printed using different printing inks in each case. For example, a four-coloured register pattern 151 is formed from a framework and three crosses preferably arranged therein in a row. For example, a six register pattern 151 is formed from a framework and five crosses preferably arranged therein in a row. Preferably, the crosses or geometric shapes have dimensions along their lines of at most 4 mm, further preferably at most 3 mm. Preferably, the frame has a dimension of at most 5 mm, further preferably at most 4 mm in a first direction, preferably parallel to a transport direction of the print substrate 09. A dimension of the frame in a direction A oriented orthogonal to this, for example, parallel to the axis of rotation 11 of the plate cylinder 07 and/or orthogonal to the transport direction of the print substrate 09 is preferably at most 16 mm, further preferably at most 13 mm in the case of a four-coloured register pattern 151 and preferably at most 26 mm, further preferably at most 21 mm in the case of a six-coloured register pattern 151. Preferably, all register patterns 151 arranged on a first page of the print substrate 09 are constructed identically to one another, for example four-coloured. Preferably, all register patterns 151 arranged on a second page of the print substrate 09 are constructed identically to one another, for example, six-coloured. By means of the dimensions of the register pattern 151, it is possible to provide particularly now areas as a start, and at an end of a respective print substrate 09 with the register patterns 151 and thereby to keep an amount of waste paper low. A thickness of the lines of the reference elements 152 is preferably at most 0.5 mm.

Preferably, at least one printing plate 73 and further preferably each printing plate 73 in each case has at least one register form element and further preferably a plurality of register form elements, even further preferably in each case a register form element each reference element 152 to be produced using this printing plate 73. A register form element here is an area of the printing form 73, which by preferably selective transfer of printing ink serves for a production of at least a respective reference element 152, for example at least of a respective register mark 152. A relative position of register form elements of different printing plates 73 thus determines a relative position of the reference elements 152, in particular of the respective reference elements 152 of each register pattern 151 to one another and the relative position of a plurality of reference patterns 151 to one another. In the example mentioned, register form elements then have, for example, the form of frames and/or crosses and/or triangles and/or circles.

In the inspection operation, actual positions of all reference elements 152 are preferably recorded, in particular compared to theoretical positions of all reference elements 152 of the at least one register pattern 151. Preferably, register marks 152 of the at least one register pattern 151 are recorded preferably relative to the base reference element 153, in particular the base register mark 153 of the respective at least one register pattern 151 and/or preferably by means of the least one register sensor, in particular compared to theoretical positions of all reference elements 152 of the at least one register pattern 151. This means in particular that the actual positions of the reference elements 152 of the at least one register pattern 151 are compared with the theoretical positions of the reference elements 152 of the at least one register pattern 151.

Preferably, in the inspection operation at least two register patterns 151 are recorded, which in each case have at least one reference elements 152 originating from an identical printing plate 73, in particular at least one register mark 152 originating from an identical printing plate 73. For the sake of simplicity, register patterns 151 are preferred which are arranged on a same side of the print substrate 09 and in each case comprise a number of printing inks, recorded in succession, while register patterns 151, which are arranged on different sides of the print substrate 09, are recorded simultaneously to increase register accuracy. The successive recording of a number of register patterns 151 can be carried out by an operator and/or by a preprogrammed or calculated programme course of an appropriate alignment device, which serves for appropriate alignments of the print substrate 09 and of the least one register sensor to one another. The at least one register sensor is preferably designed as an area camera and has, for example, at least one CCD sensor. Preferably, the print substrate 09, which is investigated in the inspection operation, is fixed to a measuring table, for example, by means of a low pressure.

In the case of at least one deviation occurring in the circumferential direction D exceeding a tolerance range of an actual position compared to a theoretical position in the evaluation operation, preferably and in particular taking into consideration further recorded register patterns 151, new adjustments for at least one adjusting element 39; 41; 131; 144 of that at least one tensioning device 101 are determined and preferably calculated, in which the least one printing plate 73, for example, is or was erroneously tensioned, which has caused the at least one register mark 151 deviating in circumferential direction D. Further preferably, in the evaluation operation new adjustments for in each case at least one adjusting element 39; 41; 131; 144 at least of two, still further preferably all tensioning devices 101 are determined and preferably calculated, in which in each case at least one printing plate 73, for example, is or was erroneously tensioned.

Further preferably, in the evaluation operation new adjustments for a number of adjusting elements 39; 41; 131; 144 of one or more tensioning devices 101 are determined and preferably calculated at the same time and/or taking into consideration mutual influences of the number of adjusting elements 39; 41; 131; 144. Preferably, at least two register patterns 151 spaced diagonally from one another to a transport direction with respect to the print substrate 09 and/or at least to register patterns 151 spaced from one another along the transport direction are recorded in the inspection operation and processed in the evaluation operation. Preferably, at least two register patterns 151 arranged on opposite surfaces of the print substrate 09 are preferably recorded by register sensors coupled mechanically and/or by circuitry in the inspection operation and further preferably simultaneously and jointly processed in the evaluation operation. The tolerance range is below 10 μm (ten micrometers).

In particular, in the case of at least one deviation of an actual position compared to a theoretical position exceeding the tolerance range with respect to the axis of rotation 11 of the at least one plate cylinder 07 occurring in an axial direction A, preferably new adjustments for at least one temperature at least of a printing plate 73 arranged on the at least one plate cylinder 07 and incorrect, for example, in its axial extent and/or at least a cylinder barrel 12 of the least one plate cylinder 07 and/or at least a temperature control means, in particular temperature control fluid, interacting with this printing plate 73 and/or this at least one plate cylinder 07 are determined and preferably calculated. This takes place, in turn, preferably taking into consideration further recorded register patterns 151. A change in the temperature of a cylinder barrel 12 here preferably also causes a change in the temperature of the printing plate 73 arranged thereon and conversely. Accordingly, a temperature-caused change in an elongation of the cylinder barrel 12 in particular in the axial direction A is preferably coupled with a temperature-caused change in an elongation of the printing form 73, in particular in the axial direction A.

Further preferably, in the evaluation operation at least one temperature at least of a further printing plate 73 and/or at least one temperature at least of a cylinder barrel 12 of a further plate cylinder 07 and/or at least one temperature at least of a temperature control means, in particular temperature control fluid, of another plate cylinder 07 and/or an ambient temperature of the printing press 01 and/or a temperature of the print substrate 09 flows in in the determination and preferably calculation of the new settings for the at least one temperature of the at least one, for example, printing plate 73 incorrect in its axial extent and/or of the at least one cylinder barrel 12 and/or of the temperature control means. Preferably, in the evaluation operation, in particular taking into consideration further recorded register patterns 151 new adjustments for at least one temperature at least of two and preferably of all, for example, printing plates 73 incorrect in their axial extent and/or respective cylinder barrels 12 of the respective plate cylinder 07 and/or temperature control medium are determined and preferably calculated.

An absolute position of different register patterns 151, arranged on a same side of the print substrate 09 to one another is not absolutely relevant, as long as a relative position of the reference elements 152 within any register pattern 151 to one another is given with sufficient accuracy. An absolute position of register patterns 151 directly opposite to one another, arranged on different sides of the print substrate 09, is very relevant in particular in security printing. Preferably, therefore, in the evaluation process in each case a reference element 152 of a first register pattern 151, arranged on the first side of the print substrate 09, is set as the first base reference element 153. Preferably, then a reference element 152 of a second register pattern 151 lying opposite to the first register pattern 151 on the second side of the print substrate 09 is set as the second base reference element 153. Preferably, then adjustments for plate cylinder 07 are determined and preferably calculated, by means of which the further reference elements 152 of the first register pattern 151 are aligned to the first base reference element 153. Preferably, then adjustments for plate cylinder 07 are determined and preferably calculated, by means of which the further reference elements 152 of the second register pattern 151 are aligned to the second base reference element 153.

Preferably, an operator can influence the process, for example, in that after the evaluation process of the machine control proposed new adjustments can be confirmed or amended, or in that the inspection process and/or the evaluation process can be started again, in particular with manual selection of another reference element 152 as the base reference element 153. This can be advantageous if, for example, only the previous base reference element 153 differs greatly from the other reference elements 152.

In a first fitting process, preferably at least one, for example, wrongly tensioned printing plate 73 is at least partially and further preferably completely relaxed at least with respect to the circumferential direction D and here remains clamped in the at least one front clamping device 21 and the at least one rear clamping device 61 and is subsequently tensioned in circumferential direction D on the respective plate cylinder 07 corresponding to the newly determined and preferably newly calculated adjustments for the at least one adjusting element 39; 41; 131; 144, in particular the at least one front adjusting element 39; 41 and/or the at least one rear adjusting element 131. An at least partial slackening of the printing plate 73 is understood here as meaning that a tensioning force acting on this printing plate 73 is reduced by preferably at least 50%, further preferably at least 75% and even further preferably at least 90%. Preferably, for this a pressure in the tensioning drive 104 preferably designed as an at least one adjusting body 104 that can be acted upon and/or is acted upon by a pressure medium is reduced by preferably at least 50%, further preferably at least 75% and even further preferably at least 90%. A complete slackening of the printing plate 73 is understood here as meaning that the tensioning force acting on this printing plate 73 is reduced by 100%, that is to zero, in that thus subsequently no force tensioning the printing plate 73 in the corresponding direction, here, the circumferential direction D, any longer occurs.

Further preferably, in the first fitting process at least two and even further preferably all, for example, wrongly tensioned printing plates 73 are at least partially and further preferably completely slackened, at least concerning the respective circumferential direction D, and remain clamped here preferably in the respective at least one front clamping device 21 and the respective at least one rear clamping device 61 of the respective at least one tensioning device 101 and are subsequently preferably tensioned by means of the respective at least one tensioning device 101 corresponding to the newly determined and preferably newly calculated adjustments for the respective at least one adjusting element 39; 41; 131; 144 changed in circumferential direction D to the respective plate cylinder 07. Preferably, the first fitting process at least of two, for example, wrongly tensioned printing plates 73 takes place simultaneously at least timewise. Preferably, in the first fitting process a tensioning within the at least one printing plate 73 with respect to the axial direction A remains unchanged. Preferably, the adjustment of the at least one adjusting element 39; 41; 131; 144 and further preferably all newly adjusted adjusting elements 39; 41; 131; 144 takes place machine-controlled and is performed by means at least of one appropriate drive 43; 44; 134; 141. Preferably, the at least one printing plate 73 after the renewed tensioning of the at least one printing plate 73 is at least minimally relieved, until at least two rear adjusting elements 131 are in contact both with at least a slide 102 carrying the at least one rear clamping device 61 as well as with the second channel wall 19.

In the fitting process or preferably in a second fitting process, preferably the at least one temperature of the at least one printing plate 73 and/or of the at least one cylinder barrel 12 and/or of the temperature control means, in particular temperature control fluid, is changed according to the new adjustments. In particular, in the evaluation process new adjustments for a temperature of a temperature control means are thus preferably determined and preferably calculated, which flows through that plate cylinder 07 on which the at least one printing plate 73, faulty in its axial extent for example, is tensioned and in the second fitting process the temperature of this temperature control means designed as a temperature control fluid is changed according to the new adjustments.

Preferably, the temperature of the temperature control means, in particular temperature control fluid, is measured and controlled. For example, it can be detected beforehand empirically or arithmetically what temperature changes are necessary in order to achieve desired length changes in the print image. The temperature control fluid is preferably controlled with an accuracy of 0.3° C. or better. The temperature of the temperature control fluid is preferably changed within a temperature range of at most 20° C. The temperature control medium can also contain, for example, an alternative or additional heating system, which is designed, for example, as at least an electrical heating resistance and/or at least a radiant heating system.

Preferably, the at least one temperature of the at least one printing plate 73 and/or of the at least one cylinder barrel and/or of the temperature control means, in particular temperature control fluid, is changed according to the new adjustments in such a way that thereafter, in particular only thereafter, at least one printing form elements and further preferably register form element, arranged on the at least one printing plate 73, and at least one image form element, further preferably register form element, arranged on another of the at least two printing plates 73, and at least one image form element, further preferably register form element, arranged on another of the at least two printing plates 73, is situated, at least with respect to an axial direction A relative to at least one plate cylinder 07, in a specified relative position to one another, where further preferably this specified relative position to one another is specified independently of a recording and further preferably before the recording of the at least one register pattern 151. It is then further preferred, that is after the changing of the temperature and in particular only thereafter, [lacuna] at least a distance measured in the axial direction A between centres of at least two register form elements 73, arranged on the at least one printing plate 73, equal to a distance measured in the axial direction A between centres of at least two register form elements arranged on another of the at least two printing plates 73

A temperature difference between two different printing plates 73, which are arranged on different plate cylinders 07 after the fitting process, of greater or less than before the fitting process is preferred. This includes, in particular, those processes in which no temperature difference prevails before the fitting process, but thereafter a temperature difference is present and those cases in which a temperature difference is present before the fitting process, but no longer thereafter and those cases in which, before the fitting process and after the fitting process, temperature differences are present, but different. Preferably, in the optionally second fitting process the temperatures of two and preferably all, for example, printing plates 73 and/or respective cylinder barrels 12 of the respective plate cylinder 07 incorrect in their axial extent and/or temperature control medium are changed according to the new adjustments. Preferably, in the optionally second fitting process a tensioning within the at least one printing plate 73 with respect to its circumferential direction D is maintained unchanged. As an angular position of image points, in particular with a change in length of the printing forme 73, does not depend on the temperature, but due to expansions at most a radial position of the image points is changed, it is not necessary, after the temperature change, to still perform adjustments which concern the angular position and/or circumferential direction D. The angular position is set solely by the corresponding drive of the plate cylinder 07. Radial changes of the position of the printing forme 73 at most have effects such that a minimally changed rolling behaviour of the printing forme 73 on the transfer cylinder 06 is produced. The [sic], however, preferably at least not perceptibly adversely affects a print quality.

Preferably, a number of register patterns 151 detected and evaluated under mutual consideration is at least as great as a sum of adjusting elements 39; 41; 131 designed as front contact bodies 39; 41 and/or rear spacers 131 of one of the at least two plate cylinders 07. Preferably, a number of register patterns 151 detected and evaluated under mutual consideration is at least eight per printing plate 73, further preferably fourteen per printing plate 73. A preferred arrangement of the register patterns 151 provides that with respect to the axial direction A in each case at least one pattern 151 has an identical axial position as at least one adjusting element 39; 41; 131. Another arrangement of the register patterns 151 provides that at least one adjusting element 39; 41; 131 does not agree in its position with respect to the axial direction A with a register pattern 151. In this case, appropriate conversions are necessary. This is in particular the case if a particularly narrow print substrate 09 is employed that is narrower than a greatest distance of two adjusting elements 39; 41; 131 in the axial direction A.

The evaluation process can also overlap with the fitting process, for example firstly such that at least one printing plate 73, for example, is partially or completely slackened and that then the evaluation process is carried out and that then the at least one printing plate 73 is tensioned again.

In the case of a new adjustment at least of a temperature, for example of a temperature control means, in particular temperature control fluid, a particularly rapid adjustment is preferably achieved by means of an overriding of the temperature control. The temperature control fluid is preferably at least partially arranged within the at least one drilling 126 and further preferably able to flow through this. Preferably, the plate cylinder 07 contains at least one drilling 126, in which a temperature control fluid, for example water containing a rust inhibitor, is arranged and/or can be arranged and/or which can be flowed through and/or is flowed through by a temperature control fluid. Further preferably, the plate cylinder 07 contains a number of drillings 126, which further preferably in each case extend over at least 90% of the axial length of the cylinder barrel 12 of the plate cylinder 07. A contact surface of the cylinder barrel 12 with the temperature control fluid is thus enlarged. Further preferably, in at least one drilling 126 is arranged at least one flow body 136; 137 and/or compensation body 136; 137. A flow body 136; 137 serves to decrease a relatively large cross-section of the at least one bore 126 and thereby on the one hand to increase a flow rate of the temperature control fluid in the at least one bore 126 and on the other hand to make for a turbulent flow and thus a better transfer between cylinder barrel 12 and temperature control fluid. The cylinder barrel 12 and thus also the printing plate 73 arranged thereon is therefore more effectively temperature-controlled. A compensation body 136; 137 serves to equalize imbalances of the plate cylinder 07. Preferably, at least one first flow body 136; 137 is of tubular design, so that a temperature control medium flowing past outwardly thereto remains uninfluenced thereby, whether a second compensation body 137 is arranged in the interior of the first compensation body 136 to equalize imbalances or not.

Preferably, the fitting operation of a number of plate cylinders 07 to the printing press 01 and further preferably to all plate cylinders 07 of the printing press 01 proceeds simultaneously at least timewise.

For a correction of a circumferential register error and/or a page register error, a circumferential register adjustment and/or page register adjustment preferably arranged on a cylinder journal 17 of the plate cylinder 07 is preferably used. The printing plate 73 itself remains tensioned unchanged on the plate cylinder 07 in the case of such adjustment of the circumferential register and/or of the page register.

Preferably, the process for clamping and/or tensioning the printing plate 73 on the plate cylinder 07 proceeds in a machine-controlled manner. For this, preferably all drives 43; 44; 104; 116; 134; 141, in particular the at least one front pre-tensioning drive 43; 44 and/or the at least one tensioning drive 104 and/or the at least one slide release drive 116 and/or the at least one distance drive 134 and/or the at least one axial drive 141 and/or the at least one stop drive are connected to the machine control and/or controlled and/or controllable by the machine control and further preferably regulated and/or regulatable by the machine control. Preferably, the at least one front adjusting element 24 and/or the at least one rear adjusting element 64 are also connected to the machine control and/or controlled and/or controllable by the machine control and further preferably regulated and/or regulatable by the machine control. In the case of tensioning drives 104 and/or adjusting elements 24; 64 designed as hoses and/or slide release hoses 121, a control and/or regulation by means of the machine control consists preferably in a control and/or regulation of the pressure prevailing thereon by means of the machine control.

In particular, preferably an adjustment of all adjusting elements 39; 41; 131; 144, in particular of the front adjusting elements 39; 41 designed as front contact bodies 39; and the rear adjusting elements 131 designed as rear spacers 131, is driven by motor and/or machine-controlled, further preferably regulated by means of the machine control.

A precision of the printing result can be increased still further if for each plate cylinder 07 a profile is created that represents deviations of the shape of this plate cylinder 07 from an ideal cylinder shape and if in the imaging and/or exposure of the printing plate 73 in each case this respective profile is then taken into consideration. In this manner, for example, errors in the print image can be avoided which would materialize in that a circumferential speed of the printing plate 73 varies on account of the shape of the plate cylinder 07, although an angular velocity of the plate cylinder 07 remains constant. The printing plate 73 can compensate such regular, geometrically caused variations, for example by at least partially stretched and/or compressed sections of the print image to be printed.

The process for arranging, in particular for clamping and/or tensioning, the printing plate 73 on the plate cylinder 07 thus preferably at least comprises that in one process operation the at least one front clamping device 21 and in particular the front clamping gap 27 is closed and thereby the front end 74 of the printing plate 73 is clamped into the at least one front clamping device 21 and in particular in the front clamping gap 27, in that in a process operation the plate cylinder is rotated around its axis of rotation 11 and thereby the printing plate 73 is placed on its lateral surface, in that in a process operation the rear end 76 of the printing plate 73 is brought into the effective range of the at least one rear clamping device 61 in its peripheral position and is laid on the plate cylinder 07, in that in one process operation the at least one rear clamping device 61 and in particular the rear clamping gap 67 is closed and thereby the rear end 76 of the printing plate 73 is clamped into the at least one rear clamping device 61 and in particular into the rear clamping gap 67, in that in one process operation the at least one slide 102 is moved in a central or inner position towards the at least one front clamping device 21 and the first channel wall 18, in that this central or inner position is specified as a reference position of the at least one slide 102, in that a sample print is carried out and here in particular a register sustainability of the printing inks of different plate cylinders is compared to one another and here a corrected central or inner position of the slide 102 is determined, then the printing plate 73 is again relieved, preferably by moving the at least one slide 102 again towards the second channel wall 19, further preferably in its peripheral position, in that then the at least one slide 102 is again moved towards the at least one front clamping device 21 and the first channel wall 18, specifically up to the corrected central or inner position, which corresponds to a desired tensioning of the printing plate 73 and in that the processes from the carrying out of the printing test on are optionally repeated several times until the register sustainability turns out to be satisfactory.

Further preferably, the process additionally comprises that the at least one slide 102 is clamped, as soon as it is situated in the respective corresponding central or inner position and is detached before it is to be moved from the central or inner position towards the second channel wall 19. Further preferably, the process additionally or alternatively comprises that the reference position of the at least one slide 102 is or becomes set by means of appropriate adjustment of the at least one rear spacer 131 or stop adjusting element 112.

Further preferably, the process additionally or alternatively comprises that the at least one slide 102 is in each case moved pneumatically into a central or inner position towards the at least one front clamping device 21 and the first channel wall 18.

Further preferably, the process additionally or alternatively comprises that in the case of an insertion of the front end 74 of the printing plate 73 into the at least one front clamping device 21 recesses in the printing plate 73 are brought into contact with the at least two register stops 31; 32 and the at least one front clamping device 21 is closed when sensor devices signal a correct position of the printing plate 73 relative to the at least two register stops 31; 32.

Further preferably, the process additionally or alternatively comprises that the printing plate 73 out of a printing plate store is placed around the lateral surface 124 of the plate cylinder 07 and/or in that the printing plate 73, while it is placed around the lateral surface 124 of the plate cylinder 07, is pressed against this lateral surface 124 by means of at least one pressing means.

Further preferably, the process additionally or alternatively comprises that the recesses of the printing plate 73 are applied to the printing plate 73 in register relative to a print image on the printing plate 73 after the printing plate 73 has been provided with the print image. Further preferably, the process additionally or alternatively comprises that the clamping areas of the printing plate 73 are in each case angled away, before the placing of the printing plate 73 on the plate cylinder 07, in each case between 15° and 40° with respect to the middle part of the printing plate 73.

Further preferably, the process additionally or alternatively comprises that on a number of plate cylinders 07 in each case at least one and preferably exactly one printing plate 73 is placed thus on the respective plate cylinder 07.

Further preferably, the process is distinguished in that the rear adjusting elements 131, in particular the rear spacers 131 are only readjusted if the at least one slide 102 is situated in its inner position.

At least if the at least one slide 102 is situated in its inner position and no printing plate 73 is arranged in the rear clamping gap 67, it could occur that an operator, for example, sticks a finger in a gap resulting between the at least one slide 102 and the second channel wall 19. If in this situation the at least one tensioning drive 104 should fail, for example, in that the at least one tensioning hose 104 ruptures, then there would be a risk of injury for this operator. Therefore the plate cylinder 07 preferably has at least one safety device 161. This at least one safety device 161 decreases the risk of injury in that it prevents in this situation the gap between slide 102 and second channel wall 19 being able to be closed in an uncontrolled manner. The plate cylinder 07 of the printing press 01 comprises, arranged in the channel 13 of the plate cylinder 07, the at least one tensioning device 101, which preferably comprises the at least one slide 102 movable in and/or contrary to the tensioning direction E. The at least one slide 102 is preferably movable by means of the at least one tensioning drive 104 and/or is preferably movable between the edge position and the inner position.

The safety device 161 preferably comprises at least one safety stop 162, for example, in the form at least of a safety surface 162. The safety device 161 preferably has at least one securing body 166 movable in and/or contrary to a safety direction G different from the tensioning direction E. The at least one securing body 166 is preferably movable by means of at least one safety drive 163 and/or at least one securing spring 164. Preferably, the at least one securing body 166 is movable at least contrary to the securing direction G by means of the least one safety drive 163. Preferably, the at least one securing body 166 is movable in the securing direction G by means of the at least one securing spring 164. The at least one securing spring 164 is preferably arranged such that the it permanently exerts a force acting in the securing direction G on the at least one securing body 166.

The at least one securing body 166 can preferably be brought into contact with the at least one safety stop 162 and/or is at least time eyes, in particular in the case of a failure of the least one tensioning drive 104, in contact with the at least one safety stop 162. The at least one securing body 166 is preferably designed as at least one safety pin 166. The at least one securing body 166 is preferably arranged movably between the safety position and the release position. The at least one safety body 166 is preferably arranged movably at least with slide 102 arranged in the inner position between a safety position and a release position.

Preferably, with safety body 166 arranged in the safety position, a projection of the at least one safety body 166 in the tensioning direction E and a projection of the at least one safety stop 162 in the tensioning direction E overlap at least partially. It is thereby ensured that a movement of the at least one slide 102 contrary to the tensioning direction E is not possible or possible at most up to a contact of the at least one safety body 166 with the at least one safety stop 162. Preferably, with safety body 166 arranged in the release position, the projection of the at least one safety body 166 in the tensioning direction E and the projection of the at least one safety stop 162 in the tensioning direction E. Do not overlap. It is thereby ensured that no contact is possible between the at least one safety body 166 and the at least one safety stop 162 and as a movement of the at least one slide 102 is possible in and/or contrary to the tensioning direction E.

Preferably, the at least one safety body 166 in the safety position is not in contact with the at least one safety stop 162. Thereby, in particular, a lower friction movement of the at least one safety body 166 in, and/or contrary to the safety direction G is guaranteed, as would be possible if the at least one safety body 166 was in contact with the at least one safety stop 162. Preferably, however, the at least one safety body 166 in the safety position can be brought into contact with the at least one safety stop 162 by movement of the at least one slide 102 contrary to the tensioning direction E. This is preferably only the case, however, if the tensioning drive 104 of the at least one slide 102 fails and the safety device 161 prevents case springing back of the at least one slide 102 contrary to the tensioning direction E. Such a case can occur, for example, if a tensioning drive 104 designed as a tensioning hose 104 bursts.

Preferably, the at least one safety stop 162 is arranged stationary relative to the at least one slide 102 and/or firmly connected to the at least one slide 102. Preferably, the at least one safety drive 163 of the at least one safety body 166 is arranged stationary relative to the cylinder barrel 12 of the plate cylinder 07 and/or firmly connected to the at least one cylinder barrel 12. It is not necessary then to connect supply lines, for example, compressed air lines and/or electrical lines to the movable slide 102. Preferably, the at least one safety stop 162 is designed wider in the axial direction A than the at least one safety body 166. It is thereby guaranteed that the at least one slide 102 is also then movable with respect to the axial direction A if the at least one safety body 166 is located in the safety position, for example, to be adjusted to a position of the at least one printing plate 73. The at least one safety stop 162 can be designed, for example, as at least one boundary surface at least of a slot extending in the axial direction A.

Preferably, the at least one safety drive 163 is designed as an electrical, and/or as a hydraulic and/or as a manual and/or further preferably as a pneumatic safety drive 163. Further preferably, the at least one safety drive 163 of the at least one safety body 166 is designed as at least one pneumatic safety drive 163. For example, at least one reciprocating piston 163, which is designed at least as part of the at least one safety drive 163, is firmly connected to the at least one safety body 166 and/or is designed as a common component. Preferably, at least one of the at least one pneumatic cylinder 167 guiding the at least one reciprocating piston 163 is arranged stationary relative to the cylinder barrel 12. Preferably, the at least one safety spring 164 is arranged such that it acts upon the at least one security body 166 together with the at least one reciprocating piston 163 in the safety direction G with a force, further preferably permanently. Preferably, the at least one safety body 166 is pressed in the safety direction G against a constituent of the at least one slide 102 by means of the at least one safety spring 164, as long as the at least one slide 102 is not in the inner position. Preferably, at least one guide bolt 169 extends through the at least one safety spring 164 to maintain this at least essentially in its shape. Such a guide bolt is shown by way of example in the figures, where for better visibility thereof the at least one safety spring 164 is shown hatched.

Preferably, the least one pneumatic cylinder 167 and the at least one reciprocating piston 163 are in contact with at least one and preferably two, sealing rings 171. By means of the sealing rings 171, preferably at least one printing compartment 172 is fixed to the at least one reciprocating piston 163 and the at least one pneumatic cylinder 167. Preferably at least one unsecuring valve 168, in particular pneumatic valve 168, is arranged on the at least one pneumatic cylinder 167. For example, to change over the at least one slide 102 from a secured state in the inner location to the peripheral location, preferably in an appropriate position of the least one unsecuring valve 168, compressed air is supplied to the at least one pneumatic cylinder 167 and in particular to the at least one printing chamber 172, such that the at least one reciprocating piston 163 together with the at least one securing body 166 is moved contrary to the safety direction G and preferably contrary to the spring force of the at least one securing spring 164. Thereby, the at least one safety body 166 is moved from the securing position to the release position. By this means, the at least one slide 102 is released for movements in and/or contrary to the tensioning direction E. As is already described, the at least one slide 102 is then arranged movably in and/or contrary to the tensioning direction E to the channel 13 based between the peripheral location and the inner location, the edge location being a location of the at least one slide 102 in which the at least one slide 102 touches the second channel wall 19, and where the inner location is a location of the at least one slide 102, in which the at least one slide 102 has a distance from the second channel wall 19 which is preferably at least 9 mm and at most 31 mm.

Preferably, at least one damping element 176 is arranged. The at least one damping element 176 is preferably arranged on the at least one securing body 166 and/or on a site delimiting the travel range of the least one securing body 166 in and/or against the safety direction G. By means of the at least one damping element 176, it is prevented that the at least one securing body 166 is damaged or unintentionally clamped. Preferably, at least one opening 174 serving as an aerating opening 174 and/or as deaerating opening 174 is arranged, which prevents that in the movement range of the least one safety body 166 apart from the at least one printing chamber 172 a further closed volume forms, the interior pressure of which could otherwise adversely affect, for example, movements of the at least one securing body 166. Preferably, at least one structural body, on which the at least one security stop 162 is arranged, acts as a cover of the at least one security body 166 and/or of the at least one safety drive 163, at least as long as the at least one slide 102 is located in the at least one edge location or the at least one inner edge location. Thereby, less or no dirt is carried into the movement range of the at least one security body 166 and/or of the at least one safety drive 163.

Preferably, at least one position sensor 173 is arranged, by means of which a position of the at least one security body 166 is ascertainable. For example, the at least one position sensor 173 is designed as at least one proximity switch 173 and preferably in the position to record areas of the at least one security body 166 with different expansions. From this, a conclusion can be drawn on the position of the at least one safety body 166.

Below, a method or process operation for securing the plate cylinder 07 of the printing press 01 is described. Thereby, preferably the at least one side 102 of the tensioning device 101 of the plate cylinder 07 is moved in the tensioning direction E, preferably from the edge position to the inner position, where firstly the at least one security body 166 of the security device 161 of the plate cylinder 07 is arranged in the release position, in which the projection of the at least one security body 166 in the tensioning direction E and the projection at least of one security stop 162 in the tensioning direction E do not overlap and where in connection the at least one security body 166 is preferably moved in the security direction G from the release position to the security position, in which the projection of the at least one security body 166 in the tensioning direction E and the projection of the least one security stop 162 in the tensioning direction E at least partially overlap and in which preferably the at least one security stop 162 is arranged further in the tensioning direction E than the at least one safety body 166. Preferably, the at least one security body 166 is moved by means of the at least one security spring 164 in the security direction G. Alternatively or additionally, the at least one security body 166 is moved by means of the at least one security drive 163 in the security direction G. Preferably, it is evaluated, for example, by means of the machine control whether the at least one position sensor 173 has recorded the at least one security body 166 within a specified time span of, for example, less than 10 s (ten seconds) after an activation of the at least one tensioning drive 104. Should this not be the case, this points to a malfunction and is communicated to the operator, for example, by means of at least one optical and/or at least one acoustic signal. Such an optical signal can be, for example, a warning lights and/or a display on a display device of the printing press. Preferably, the process is then terminated at this point and/or the at least one tensioning drive 104 is deactivated.

Preferably, the process is distinguished in that the at least one slide 102 in the tensioning device E is moved from a peripheral position to an in a position and in that the peripheral position is a position of the at least one slide 102, in which the at least one side 102 touches a channel wall 19, and in that the inner position is a position of the at least one side 102, in which the at least one slide 102 has a distance from the channel wall 19.

Preferably, the process operation for securing the plate cylinder 07 between the fourth process operation, which is also called rear opening operation, and the fifth process operation, which is also called rear insertion operation, is carried out.

In a process operation for cancelling a securing of the plate cylinder 07 of the printing press 01, preferably firstly the at least one security body 166 is preferably moved contrary to the security direction G from the security position, in which the projection of the at least one security body 166 in the tensioning direction E and the projection of the at least one security stop 162 in the tension direction E at least partially overlap and in which preferably the at least one security stop 162 is arranged further in the tensioning direction E than the at least one security body 166, to the release position, in which the projection of the at least one security body 166 in the tensioning direction E and the projection at least of one security stop 162 in the tensioning direction E do not overlap and preferably in connection the at least one slide 102 of the tensioning device 101 of the plate cylinder 07 is moved contrary to the tensioning direction E, preferably from the inner position to the peripheral position. Preferably, here, the at least one security body 166 is moved contrary to the security direction G by means of the at least one security drive 163, further preferably contrary to a force exerted by the at least one safety spring 164 on the at least one security body 166 in the security direction G.

Preferably, the process operation for cancelling the securing of the plate cylinder 07 between the fifth process operation, which is also called rear insertion operation, and the sixth process operation, which is also called rear clamping operation, is carried out.

While preferred embodiments of an in-register arrangement of printing plates on printing-press cylinders with a temperature-control system, in accordance with the present invention, are set forth fully and completely hereinabove, it will be apparent to one of skill in the art that various changes in, for example, the specific structure of the plate cylinders, the drive for the printing press and the like could be made without departing from the true spirit and scope of the present invention which is accordingly to be limited only by the appended claims.

What is claimed is:

1. A method for accomplishing an in-register arrangement of at least two printing plates positioned on at least two plate cylinders of a printing press to each other, the printing press having at least one printing unit and at least one transfer cylinder forming a print gap in a contact area of the at least one transfer cylinder with a further cylinder, the at least one transfer cylinder being in contact with a plurality of plate cylinders of the printing unit wherein, depending on at least one print image printed on a print substrate by the printing press, adjustments for at least one of a temperature of at least one printing plate arranged on at least one of the at least two plate cylinders, at least one cylinder barrel of at least one plate cylinder of the at least two plate cylinders of the printing press and at least one temperature control means interacting with this at least one printing plate and this at least one plate cylinder are determined, and the at least one of the one temperature of this at least one printing plate and of this at least one cylinder barrel and of this at least one temperature control means is changed in accordance with the adjustments, and where the at least one plate cylinder has at least one channel having at least one tensioning device, the at least one tensioning device including at least one front clamping device for clamping a front end of a respective printing plate and including at least one rear clamping device for clamping a rear end of this respective printing plate and wherein at least one register pattern of the print substrate is recorded and, depending on the at least one register pattern, determining adjustments for at least one adjusting element of the at least one tensioning device, the at least one adjusting element of the at least one tensioning device including at least one of a front contact body for adjusting a distance of the at least one front clamping device from a first channel wall of the at least one channel, at least one rear spacer for adjusting a distance of the at least one rear clamping device from a second channel wall of the at least one channel and at least one axial drive for adjusting a position of the at least one rear clamping device with respect to an axial direction which is parallel to an axis of rotation of the at least one plate cylinder.

2. The method according to claim 1, further including changing the at least one of the temperature of the at least one printing plate and of the at least one cylinder barrel and of the at least one temperature control means according to the adjustments and thereafter locating at least one image form element arranged on the at least one printing plate of the at least two printing plates and at least one image form element arranged on another printing plate of the at least two printing plates in specified relative positions to one another at least with respect to the axial direction of the at least one plate cylinder.

3. The method according to claim 2, further including specifying the relative position of the at least one printing plate and of the another printing plate of the at least two printing plates to one another based at least on one of the axial direction independently of a recording of the at least one print image applied to the print substrate and that this relative position of the at least one printing plate and the another printing plate to one another, at least with regard to the axial direction, is already specified before a recording of the at least one print image applied to the print substrate.

4. The method according to claim 2, further including finding the at least one image form element arranged on the at least one printing plate and the at least one image form element arranged on the another of the at least two printing plates in the specified relative position to one another after the one of the change of the at least one temperature of this at least one printing plate and of this at least one cylinder barrel and of this at least one temperature control means at least with respect to the axial direction relative to the at least one plate cylinder.

5. The method according to claim 1, further including recording, in an inspection process, the at least one print image printed on the print substrate and in dependence thereon determining, in an evaluation process, adjustments for the at least one of the at least one temperature of the at least one printing plate arranged on the at least one plate cylinder and for the at least one cylinder barrel of the at least one plate cylinder and for the at least one temperature control means interacting with this printing plate and for this at least one plate cylinder and changing, in an adjustment process, the at least one of the temperature of this at least one printing plate and of this at least one cylinder barrel and of this at least one temperature control means in accordance with the adjustments.

6. The method according to claim 5, further including maintaining in the adaptation process, a tension within the at least one printing plate unchanged with respect to a circumferential direction of the at least one plate cylinder.

7. The method according to claim 1, further including printing on the print substrate at least one print image, which has at least two reference elements which originate from different printing plates and recording, in an inspection process, actual positions of all reference elements of the at least one print image.

8. The method according to claim 1, further including, in at least one sample printing operation, printing one of at least two print images on the print substrate, which at least two print images each contain at least two reference elements originating from at least two different printing plates and in the at least one sample printing operation printing at least two register patterns on the print substrate, which two register patterns are each composed of at least two reference elements originating from at least two different printing plates.

9. The method according to claim 1, further including recording in an inspection process and processing in an evaluation process at least one of at least two print images spaced from one another transverse to a transport direction of the print substrate and parts of at least one print image and at least two print images and parts of at least of one print image spaced from one another along the transport direction and parts at least of one print image.

10. The method according to claim 1, further including recording in an inspection process and processing in an evaluation process at least one of at least two register patterns spaced from one another transverse to a transport direction of the print substrate and at least two register patterns spaced from one another along the transport direction.

11. The method according to claim 1, further including equilibrating least one of at least a temperature of at least a further printing plate and at least a temperature of at least a cylinder barrel of a further plate cylinder and at least a temperature of at least a temperature control means of another plate cylinder and an ambient temperature of the printing press and a temperature of the print substrate in the determining of the adjustments for the at least one of the temperature of the at least one printing plate and of the at least one cylinder barrel and of the at least one temperature control means.

12. The method according to claim 1, further including at least one of recording at least two print images and parts of print images, which have at least one reference element originating from an identical printing plate and at least two register patterns which have at least one reference element originating from an identical printing plate.

13. A system for register control, the system having at least one printing press, at least one machine control of the at least one printing press and at least one data input to the machine control for the recording of register data of a print image printed on a print substrate by at least one printing plate of the printing press, the printing press having at least one printing unit which has at least one transfer cylinder having a contact area with a further cylinder to form a print gap, wherein the at least one transfer cylinder is in contact with a plurality of plate cylinders of the at least one printing press and wherein the system has at least one temperature control system connected by circuitry to the machine control, by the use of which at least one temperature control system at least one temperature of at least one of the at least one printing plate arranged on at least one of the plate cylinders of the printing press and at least a cylinder barrel of the at least one plate cylinder and at least a temperature control means interacting with the at least one printing plate and this at least one plate cylinder is at least one of controllable and regulable in dependence on the register data recorded and where, in at least one channel of the at least one plate cylinder, there is arranged at least one tensioning device of the plate cylinder, which at least one tensioning device has at least one front clamping device and at least one rear clamping device and wherein at least a first adjusting element of the at least one tensioning device is configured as at least one front contact body, by the use of which at least one adjusting element a distance of the at least one front clamping device from a first channel wall of the at least one channel is adjustable and at least a second adjusting element of the at least one tensioning device is configured as at least one axial drive, by the use of which a position of the at least one rear clamping device, with respect to an axial direction parallel to an axis of rotation of the respective plate cylinder, is adjustable and the at least one rear clamping device is part of at least one slide of the at least one tensioning device and the at least one slide is movable by at least one tensioning drive within the at least one channel along a tensioning path with respect to the at least one front clamping device and at least a third adjusting element of the at least one tensioning device is configured as at least one rear spacer, by the use of which a distance of the at least one rear clamping device from a second the channel wall of the at least one channel is adjustable.

14. The system according to claim 13, wherein the printing press has at least one printing unit, which has at least a pair of transfer cylinders which establish a common contact area forming a print gap.

15. The system according to claim 14, characterized in that each of the at least pair of transfer cylinders is in contact with a plurality of plate cylinders.

* * * * *